US005585582A

United States Patent [19]

Stanwood

[11] Patent Number: 5,585,582

[45] Date of Patent: Dec. 17, 1996

[54] METHODS FOR INERTIAL BALANCING OF PIANO KEY MECHANISMS

[76] Inventor: David C. Stanwood, R.F.D. 340, Vineyard Haven, Mass. 02462

[21] Appl. No.: 226,155

[22] Filed: Apr. 11, 1994

Related U.S. Application Data

[63] Continuation-in-part of Ser. No. 981,277, Nov. 25, 1992.

[51] Int. Cl.[6] ..... G10C 3/12

[52] U.S. Cl. ..... 84/432; 84/433; 84/438

[58] Field of Search ..... 84/432, 433, 438

[56] References Cited

U.S. PATENT DOCUMENTS 1,510,663 10/1924 Finnimore ..... 84/433
1,589,745 6/1926 Federle ..... 84/433

*Primary Examiner*—Patrick J. Stanzione
*Attorney, Agent, or Firm*—William Nitkin

[57] ABSTRACT

In the balancing of piano key mechanisms according to the invention, counterweights are placed in each piano key to balance said key mechanism in order to create a smooth linear progression of key front weights along a keyboard, thereby providing a keyboard with a more uniform "feel" to the piano keys when played by a pianist.

46 Claims, 15 Drawing Sheets

Front weight, minus the front weightof the preceding note.

METHODS FOR INERTIAL BALANCING OF PIANO KEY MECHANISMS

CROSS-REFERENCE TO RELATED APPLICATION

This application is a continuation-in-part of U.S. patent application Ser. No. 07/981,277, filed Nov. 25, 1992, by the present inventor.

BACKGROUND OF THE INVENTION

1. Field of the Invention

The invention relates generally to processes for balancing piano key mechanisms and similar mechanisms for stringed keyboard instruments and particularly to the balancing of individual key mechanisms forming a keyboard to create a consistent "feel" of the keys.

2. Description of the Prior Art

In the manufacture of stringed keyboard instruments such as pianos and the like, a critical manufacturing procedure resulting in the "feel" of the action of the instrument is known as "key balancing". Key balancing occurs in the manufacturing process after the action is assembled and working. The key balancing procedure is of utmost importance due to the fact that stringed keyboard instruments using key activated mechanical systems, generally referred to as "actions", for production of musical tone of varied intensity from the strings and soundboard of the instrument, require a consistent pressure for depression of the keys across the keyboard. For example, a pianist must "feel" a consistent pressure necessary to depress each piano key so that the pianist can easily play a series of notes at the same tone volume by application of the same pressure to each key. Therefore, when touch is uniform, that is, when every key "feels" alike, the piano is easier to play and the musical result is more satisfying. In the event that each key requires that a different pressure be applied by the pianist to play that key at a given volume, the pianist must learn that pressure necessary to apply to each key, a difficult task at best even for the most accomplished of musicians. Further, the overall level of touch resistance which is to be applied to the keys must not be too light or too heavy or the pianist will otherwise encounter difficulty in controlling the sound of the piano.

Key balancing processes of the prior art involve the placement of lead counterweights called "keyleads" into the front of a key lever of each piano key mechanism. This weighting of each key lever attenuates the upwards force at the playing end of the key mechanism exerted by the weight and the leverage of the action parts resting on the back of the key lever. These parts of the action include a hammer for each key mechanism which is attached to a shank pivoted at a hammer shank flange. The weight of the shank and the hammer attached thereto exerts a downward force on a part known as the wippen at a contact point known as the knuckle contact point. An action part known as a knuckle is attached to the hammer shank and that point at which the knuckle contacts the wippen is known as the knuckle contact point. The downward force exerted by the hammer and the shank of the hammer combines with the weight of the wippen, pivoted at a flange of the wippen, to exert a downward force on the back of the key at a point known as the capstan contact point, this downward force translating through the key lever to an upwardly directed force at the playing end of the key lever. The weight of the hammer at the end of the hammer shank exerts considerable influence on the amount of keylead used in the key. Maximum keylead usage occurs on the bass side of the keyboard where the hammers of the respective keys are heaviest. Keylead usage dwindles down to little or none in the treble side of the keyboard where hammers are lightest. Without keyleads, the amount of force required to depress the keys would be too great to produce an appropriate feel to the keys on playing.

A conventional method for key balancing which has been used by piano manufacturers for many years involves the placement of a specified amount of weight, known as the "downweight" and usually being set at approximately 50 grams, on the playing end of the key lever at a specified point, i.e., the measuring point. An appropriate number of keyleads are placed on top of the key lever between the measuring point and the key lever balance point. In some cases, keylead may also be used on the back of the key lever balance point. The keyleads are then slid in small increments along the key lever until positions are found which will cause the key to go slowly down at the front and the hammer to slowly rise at the back of the mechanism, thereby indicating that the specified downweight has been provided. A weight value known as the "upweight", that is, the amount of weight which the depressed key can slowly lift, may be then checked to determine whether a sufficient lifting force exists in order to return the key to rest after being played. Keylead positions are then marked, holes drilled in the key at the marks, and the keyleads permanently mounted in the holes. While the manufacturing procedure just described has been common in the art for a number of years, this prior art method of key balancing is significantly flawed. These flaws result in part from the fact that these newly manufactured actions which are being key balanced have new parts and felts. In particular, the key bushings tend to be tight when the action is new. In fact, piano manufacturers consider this tendency to be normal since it is actually desired by the manufacturer for the key bushings to be as tight as possible while still working freely in order to prevent premature wear in the field. If a particular key bushing is too tight at the time of key balancing in the factory, then more keylead will be placed in that key in order to overcome the resulting high friction and to start the key moving downwardly in achieving a specified downweight. When the key bushing becomes free, that is, more loose, at a later time and therefore produces less friction, the greater amount of lead weight in the key remains, thereby causing the key to have a significantly higher inertia compared to adjoining keys. Accordingly, the prior art practice of balancing keylead against high friction which usually exists during key balancing occurring in the manufacturing process creates chaotic inconsistencies in downweight measurements once the piano is out of the factory and in use. It is thus readily seen that the downweight measurement, the primary key balancing indicator in prior art manufacturing procedures, has a friction component which creates wide and inconsistent results.

The commonly accepted and widely used prior art key balancing technology presents an additional problem which relates to the inconsistent use of key balancing weights. For example, when a key is struck during the act of playing a piano, the inertia of the key becomes the significant force resistance which is felt by the pianist. The force, exerted by the finger of the pianist, needed to overcome key inertia can be in the hundreds or even thousands of grams. The amount of force required to overcome key inertia is proportional to the sum of inertial moments within each key. The inertial moment of a part referred to as the keystick, within which are mounted the key balancing weights, is a significant component of inertia. When the use of key balancing weights varies widely as occurs in the prior art, the moment of inertia of the keystick is likely to be inconsistent from note to note with the result being an uneven playing quality. Another problem which results from the presently used method for key balancing results from the fact that the method itself mirrors inconsistencies in the weight and/or leverage of the parts. Small inconsistencies in the weight of the parts and in the length of the lever arms of the parts in the various parts of each key mechanism add up to create significant random inconsistency from note to note in the amount of upward force exerted at the front of each key. Even when the keys are balanced under ideal conditions, that is, with uniform friction from key to key, these inconsistencies result in varied amounts of keylead being used from note to note. One result of this fact is a significant variation in the inertial moments within each key which create an uneven playing quality, thereby causing the pianist to compensate for the inconsistencies and thus causing the piano to be more difficult to control and therefore to play.

Still another problem inherent in the prior art key balancing process results from the fact that the hammers and parts wear out as the instrument is played over time, it then being necessary for the hammers and associated parts to be replaced. Since replacement parts invariably provide a new and entirely different set of weight and leverage inconsistencies than were originally present in the manufacture of the instrument, the keys must be rebalanced each time new parts are installed in order to maintain even those standards inherent in the prior art key balancing process.

Another prior art key balancing process is utilized with certain types of pianos which use a wippen support spring combined with keyleads to balance the action. This wippen support spring reduces the downward force exerted by the combined weight of the parts of the action on the capstan of the key mechanism. Wippen support spring actions typically require less keylead usage and result in keysticks having substantially lower inertial moment and which thereby require substantially lower force to propel the key to a given acceleration. When the key is played with rapid repetition, the repetition spring need not accelerate as much mass in the keystick and a faster, more solid repetition is possible. However, the prior art does not provide for a method specifying the proportion of wippen support spring tension to the amount of keylead usage, thereby resulting in underutilization of a useful application of wippen support springs.

The metrology of the prior art is therefore seen to be limited to the measured values of downweight and upweight along with their respective calculated weight and friction components. Downweight is the minimum amount of weight that, when placed on the measuring point of the key, causes the key to go down slowly. Upweight is the amount of weight that, when placed on the measuring point of the depressed key, allows the key to slowly lift. The weight component of downweight and upweight is known as the balance weight and is equal to the amount of weight placed on the measuring point of the key which counterbalances the upward force exerted by the weight and leverage of the parts of the action. The friction component is known as the friction weight and is the amount of weight which when added to the balance weight causes the key to move slowly downwardly or when subtracted from the balance weight allows the key to slowly lift. The balance weight and friction weight are determined by calculation with the balance weight being the average of downweight and upweight. Friction weight is calculated as downweight minus upweight with the resulting value being divided by two. However, even the most ideal realization of the prior art methodology of key balancing during manufacture to produce a uniformly consistent balance weight is too time consuming for practical application in the manufacture of pianos and similar stringed keyboard instruments.

Prior patents have addressed the problems referred to above. For example, Hardesty et al, in U.S. Pat. No. 4,286,493 attempts to provide a graduated leverage piano action by reducing overall touch forces and by causing the touch forces at one end of the keyboard to be substantially equal to the touch forces at the other end of the keyboard. However, Hardesty et al provide a piano action which reduces playing forces and which does not provide for a balancing of piano keys and the like to eliminate the problems referred to hereinabove which continue to plague the industry in the manufacture of keyboard actions and in the refurbishment of actions which must be at least in part replaced due to wear.

Accordingly, a long-felt need continues to exist in the art for methodology useful in the manufacture and/or refurbishment of keyboard actions to produce a consistent "feel" of the action when played and which can be incorporated into the manufacture of stringed keyboard instruments in a practical, timewise manner.

SUMMARY OF THE INVENTION

The invention provides methodology for balancing key mechanisms of stringed keyboard instruments such as pianos and the like either during an original manufacturing process or during replacement of some or all of key mechanisms or portions of key mechanisms which have deterioriated due to wear. Of particular note in the present methodology is the balancing of the key mechanisms independently of the effects of friction within the key mechanisms. The present methodology provides for installing keyleads into a keystick of a key mechanism with consistency of keylead usage from note to note. A higher degree of inertial moment uniformity from key to key is thereby created attendantly with the production of a playing quality which is significantly more consistent from note to note at all levels of volume. A piano or the like wherein the key mechanisms are balanced according to the invention can be played expressively with significant ease. A further advantage produced by the present methodology is a reduction in the time and skill necessary for manufacture of the piano as well as in the elimination of the need for rebalancing of the keys when the action parts wear out and require replacement. The invention further allows predictable production for a desired "feel" when the instrument is played.

The present methodology particularly provides for utilization of wippen support springs in the production of piano actions which require less physical force in play and which allow for substantial reduction in keylead usage. The methodology of the invention can be best referred to as a "balance weight system" as opposed to the "downweight" system of the prior art as described hereinabove due to the fact that the present key balancing processes use balance weight and its constituents as the primary indicator of touchweight quality rather than downweight.

Accordingly, it is an object of the invention to provide methodology for key balancing of the actions of stringed keyboard instruments such as pianos and the like to provide a more uniform "feel" to the keys when played.

It is another object of the invention to provide methodology for balancing keys in an action that is significantly faster and more accurate than heretofore possible, requires less skill and labor than prior art methodology and can be incorporated into the mass production of piano actions.

It is a further object of the invention to provide piano actions and the like having measured inertial moments which are substantially more smooth and consistent than can be manufactured using prior art methodology.

It is a still further object of the invention to provide methodology capable of establishing a calibrated standard of weight uniformity by the addition of a smoothly decreasing weight to the front of a key.

It is yet another object of the invention to provide methodology for balancing of keyboard actions which allow the conforming of balancing technology to desired standards such that manufacturers and rebuilders of pianos and the like are able to achieve significantly higher standards while improving work efficiency.

BRIEF DESCRIPTION OF THE DRAWINGS

FIG. 1 is a side elevational view of a key mechanism such as is typically utilized in a piano or the like;

DESCRIPTION OF THE PREFERRED EMBODIMENTS

Figure 1:
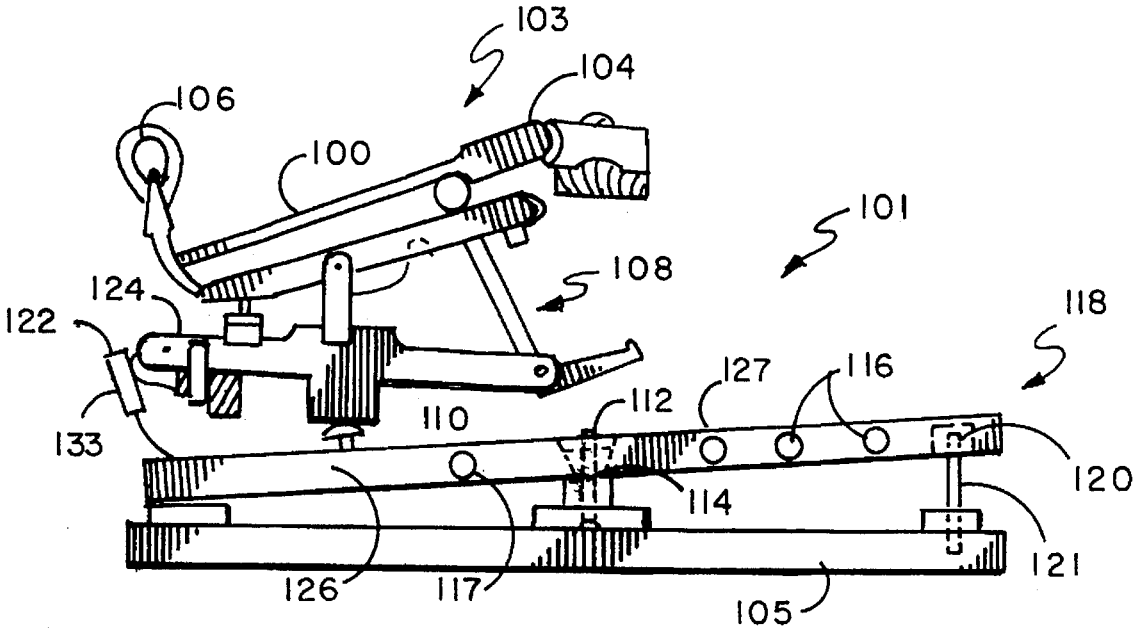

Referring now to the drawings and particularly to FIG. 1, a key mechanism indicated generally at 101 is seen to be of conventional design and to include a keystick 126 conventionally mounted by balance rail pin 112 and front rail pin 121 as is well known in the art. The balance rail pin 112 is essentially disposed at key balance point 125 of the keystick 126. A hammer assembly 103 is seen to be comprised of a hammer 106, a hammer shank 100 and a hammer flange 102 pivoted to the hammer shank 100 at hammer shank pivot 104. As will be apparent to those skilled in the art, the hammer assembly 103 also includes other structural features which need not be described herein. The key mechanism 101 further includes a wippen 108 pivoted at the wippen pivot 124 and a keystick 126 having an attached capstan 110 and attached back check 133, the keystick 126 pivoting at the key balance point 125. The wippen 108 further includes an optional wippen support spring 122 and a wippen flange pivot 124.

The keystick 126 of FIG. 1 is seen to be provided with keyleads 116 which are disposed in holes (not shown) which have been drilled in a distal portion of the keystick 126. Similarly, a backlead 117 can be provided in a hole (not shown) in the proximal end of the keystick 126. The front rail pin 121 extends from a base element 105 of the key mechanism 101 and into guide slot 120 which may be lined with felt or similar material (not shown).

Figure 2:
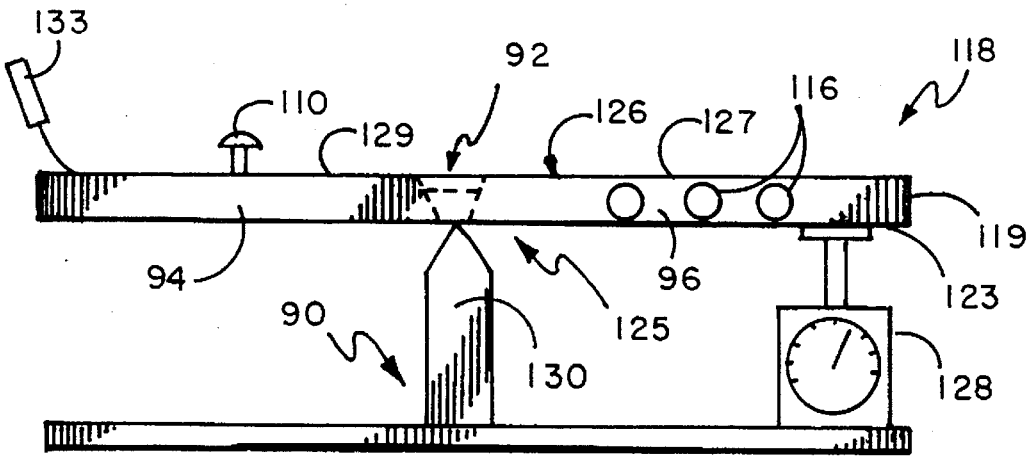
FIG. 2 is a side elevational view of a keystick shown in a jig intended to facilitate balancing of the keystick according to the invention.

Referring now to FIG. 2, a jig 90 is shown which facilitates the measurement of various values utilized in the practice of the several embodiments of the invention. In utilizing the jig 90, a given keystick 126 is removed from the key mechanism 101 of FIG. 1 and placed on the jig 90 with a balance hole position 92 being disposed on a low friction pivot 130, the keystick 126 then being effectively divided into a back half 94 and a front half 96. The keystick 126 further is seen to have a front top 127 and a back top 129. The keystick 126 is essentially balanced at key balance point 125 on the low friction pivot 130. Since the back check 133 is essentially a portion of the keystick 126, this element 133 remains with the keystick 126 during the measuring operation as is shown in FIG. 2. As is seen in FIG. 2, a front end 119 of the keystick 126 is rested on a low friction roller pan 123 which may be formed of roller bearings or other material which will relieve friction between the keystick 126 and that portion of scale 128, that is, the pan 123, which contacts the keystick 126. If motion exists between the keystick 126 and the pan 123, then the resulting friction must be relieved. The pan 123 could be a simple flat pan having a double-up portion of felt or the like formed thereon since the intent of the structure is simply to allow movement of the keystick 126 with a minimum of friction when the pan 123 is subject to vertical motion. The "point" at which the keystick 126 contacts the pan 123 is taken to be measuring point 118 which is a set specified point centered on the front top 127 of the keystick 126 and which is usually approximately 13 mm from the front end 119, that is, from a front vertical edge of the keystick 126. The measuring point 118 is taken to be the same point for each of the key mechanisms 101 being balanced in a particular piano (not shown). Measurements according to the invention are taken when the front end 119 of the keystick 126 contacts the pan 123 essentially in a horizontal attitude which is similar to the attitude of the keystick 126 when said keystick 126 is located in the corresponding key mechanism 101 as seen in FIG. 1.

With the keystick 126 in the position shown in FIG. 2, a number of keyleads 116 are placed on the front top 127 of the keystick 126 (the keyleads not being shown on the front top 127 in FIG. 2). The keyleads 116 are then slid in small increments along the front top 127 until positions are found which achieve a specified reading on the scale 128. In this example, the keylead positions are shown to be those locations wherein the keyleads 116 are seen to be disposed after marking of the positions and the drilling of holes in the body of the keystick 126 at the marked positions. The keyleads 116 are thus permanently mounted in the holes. The holes per se are not shown since the keyleads 116 are shown to be disposed in said holes and thus fill the holes. The process of balancing each keystick 126 is thus repeated for each of the key mechanisms 101 of the piano or other stringed instrument within which such a key mechanism is employed.

The methodology of the present invention results in the production of front weight values in the "finished" key mechanisms 101 of relatively continuous smooth values from note to note. In contradistinction, the prior art creates significant random dissimilarity in the front weights of the several key mechanisms relative to adjacent notes. Front weight is defined as the downward force at the measuring point 118 exerted by the extra weight disposed on the front half 96 of the keystick 126. Front weight is measured by finding the weight of the keystick 126 at the measuring point 118 with the keystick 126 removed from the key mechanism 101 and by resting the keystick 126 on the low friction pivot 130 at the balance point 125 and with the front end 119 of the keystick 126 resting on the low friction roller pan 123 (as described above) in a vertical line with the measuring point 118 of the keystick 126 such that the horizontal attitude of the key is similar to that attitude which the keystick 126 assumes in the key mechanism 101. The methodology of the invention produces front weight specifications of smooth decremental value from note to note from the bass end of a keyboard (not shown) to the treble end of such a keyboard.

Characteristic of an instrument balanced according to the invention is the more smoothly continuous inertial moments in the keysticks 126 and the amount of force required to propel the hammers 106 at any given acceleration being substantially more smoothly continuous from note to note, thereby causing the piano keys to be easier to control during playing. An added advantage is that the significant inconsistencies from note to note which invariably occur in the cumulative weight and leverage effects of each note in the prior art are not compensated for according to the present methodology through the use of correspondingly higher or lower amounts of keylead from key to key. Accordingly, when replacement parts are installed at a later time, the keys need not be rebalanced in order to maintain that improvement gained by the present invention.

In order to define the metrology underlying the present methodology thereby to understand the static force which each component of an action exerts at the playing end of a key, it is necessary to refer to at least three basic units of measurement, that is, a balance weight, a front weight and a top action balance weight. Additional subunits of measure are strike weight, strike balance weight, shank weight, wippen weight, wippen balance weight, key weight, key ratio and strike ratio. These measurements relate to the touchweight metrology which allows understanding of the methodology of the invention.

Balance weight, as described in the prior art, is the net static force in an upward direction at a measuring point such as the measuring point 118 seen in FIG. 2 determined as the mean of the measured upweight and downweight. The frontweight is the downward force exerted by the keystick 126 at the measuring point 118 determined by measurement on the scale 128 of the keystick weight at the measuring point 118 with the keystick 126 removed from the key mechanism 101 and pivoted at the low friction pivot 130 (or balance point) in a horizontal attitude similar to that attitude at which the keystick 126 is installed into the key mechanism 101 of FIG. 1. The top action balance weight is the upward force at the measuring point 118 which results only from the leveraged weight of the wippen 108, hammer 106 and hammer shank 100 determined by measuring the downweight, upweight and front weight of the keystick 126, then calculating the balance weight and adding the balance weight to the front weight.

The relationship between the top action balance weight, front weight and the balance weight may be demonstrated by setting the front weight to zero and determining the balance weight of the keystick 126. With the front weight being set to zero, the balance weight will be equal to the top action weight. If the top action balance weight and the front weight of a key mechanism 101 are known, the balance weight is predicted and can be found to be that value obtained by subtracting the front weight from the top action balance weight.

In the methodology of the invention, the front weight specifications are computed from hypothetical smooth decremental values of top action balance weight which relate to the measured top action balance weight as found in the finished key mechanisms 101. Using hypothetical smooth top action balanced weight values for computation of front weight specification gives rise to several key balancing methods according to the invention. In a first method, the upweight, downweight and front weight of sample keys are measured and the top action balance weight is calculated. The average trend of the top action balance weight is computed using an appropriate statistical method. Calculation of the average trend may be based on a sampling of all of the keys of an instrument. However, satisfactory results useful in a manufacturing situation are achieved by measuring a scattered sampling of only a few notes. The result thus obtained is a set of hypothetical smooth average top action balance weight values. The front weight specification is determined by subtracting a specified balance weight from the hypothetical top action balance weight. The average trend of the balance weight in the finished key mechanisms 101 will equal the balance weight specification. The time savings of being able to calculate key balancing specification for all the notes by measuring only a few notes causes the method to be of substantial utility in the manufacture of pianos and the like.

Considering the particular method steps of this first embodiment of the invention, the method is taken to involve the derivation of front weight specifications by measuring sample key mechanisms. Accordingly, a first step is the measurement of the upweight, downweight and the front weight of a sample key mechanism 101. The balance weight is thus calculated as half of the value obtained by adding upweight to the downweight. The upweight and downweight are determined while the keystick 126 is mounted in the key mechanism 101 and, of course, while the key mechanism 101 is disposed in its appropriate location in an action (not shown). The keystick 126 is then removed for determination of front weight. Of course, the front weight is determined with the keystick 126 being worked with in the jig 90 as described herein.

Considering now the second step, the top action balance weight is determined by adding the balance weight and the front weight with the resulting value being the top action balance weight. For each key mechanism 101 sampled, the first and second steps are repeated. All eighty-eight notes or as few as ten (or appropriate number in between) may be sampled.

The next step of the invention is the derivation of the average trend of the top action balance weight values by an appropriate statistical method such as is conventional in the art of statistics. Various methods can be utilized such as the use of a locally weighted regression for computation of the average trend of the top action balance weight values. An algorithm which can be used is described in an article by R. M. Ingels and M. Pallette in Volume 6, No. 3, 1987 of the periodical "Access", the disclosure of which is incorporated hereinto by reference. Such algorithms are common and conventional in the art and allow the creation of locally weighted regressions.

A further step involves the derivation of smooth front weight specifications by subtracting a specified smooth balance weight from the smooth top action balance weight. The keystick 126 is then balanced to its front weight specification as described herein through the use of keyleads 116.

It is of substantial importance to consider further at this point that all methodology of the invention is based upon a computation from a hypothetical smooth decremental value of top action weights. In other words, it is necessary to derive a smooth top action weight in order to practice the methodology of the invention.

Considering now a further method of the invention intended to derive front weight specifications for wippen support spring type actions (not shown), it is to be seen that the following steps are taken for each key mechanism 101 or for selected sample key mechanisms. The upweight and the downweight of a given key mechanism 101 are determined while the key mechanism 101 is in place in an action (not shown). The balance weight can then be described as the average of the values of downweight and upweight. The keystick 126 of the key mechanism 101 is then removed from the key mechanism and a determination is made of the front weight in the jig 90 as is described herein. The top action balance weight is then calculated for each key mechanism 101 or note by adding balance weight and front weight. Smoothed top action balance weight values for all of the notes are then derived by conventional statistical methodology which determines the average trend of the sampled top action balance weight values. It is to be noted here that each key mechanism 101 can be subjected to the steps of the present methods with a result which constitutes an extraordinary improvement over the prior art. However, for the sake of producing extraordinary results within the time constraints of manufacturing processes, only sample key mechanisms are selected for the various steps of the present methods with the result being an extraordinary improvement over prior art methodology.

The average trend of the sampled top action balance weight values are then subtracted from a specified hypothetical sum of top action balance weight and front weight. As a variation, a keyweight factor can be added to the specified sum. Each keystick 126 is then balanced to its front weight specification.

Methodology further includes the determination of front weight specifications for a wippen support spring type action (not shown) by specification of the smoothly continuous sum of top action balance weight and front weight. The top action balance weight of sample notes is determined as described herein and the average trend of top action balance weights are determined. The front weight specification is calculated by subtracting the hypothetically smoothed top action balance from the specified sum of top action balance weight and front weight. After the front weight is made to specification, the wippen spring tension is adjusted to cause the desired balance weight to occur in each key mechanism 101. An advantage of this particular method derives from the fact that it can be used to compensate for inconsistent levels of top action balance weight. As an example, if in a particular section of a piano the several hammers 106 are heavier than is desirable, this methodology can compensate by utilizing lower front weights in the area of heaviness, the result being a more even feel across the keys.

A variation of the methodology just described and as indicated hereinabove, a weight constant of each of the keysticks 126 can be added to the specified sum of top action balance weight and front weight. The weight of the keystick 126 is defined by the upward force at the measuring point 118 exerted by the weight of the keystick 126 on the distal side of the balance point 125. The key weight is determined by experiment through finding the average difference between the front weight of the keystick 126 and the front weight of the same keystick with the distal half of the keystick 126 severed at the balance point 125. The method therefore compensates for added inertia of extra long keys or keys which are longer in the face end by specifying lower front weight in sections with heavier key weight.

Figure 5A:
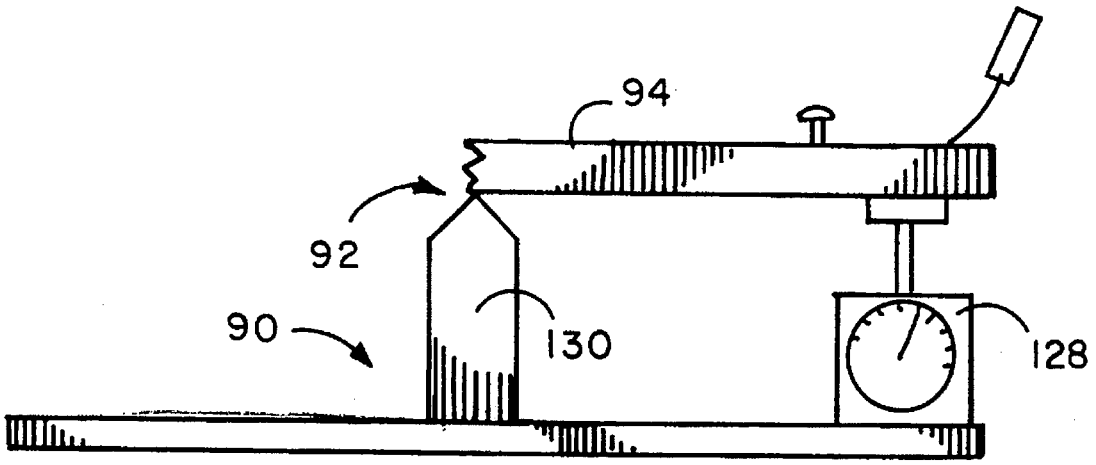
FIG. 5A is a side elevational view of a back half of a keystick disposed on a weighing jig.
Figure 5B:
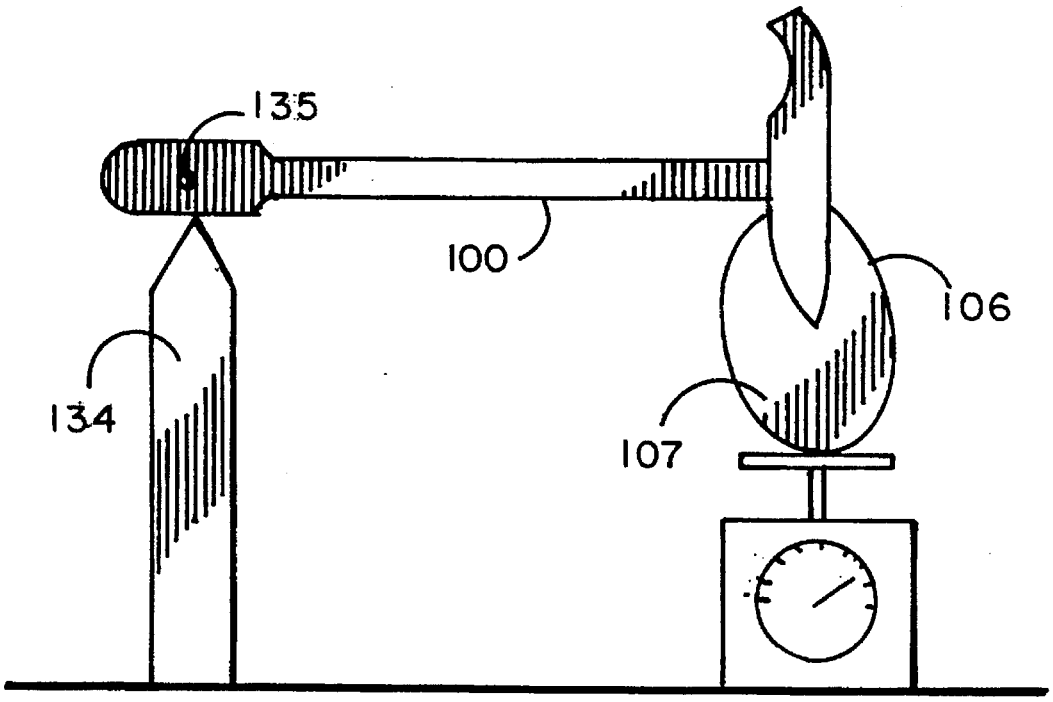
FIG. 5B is a side elevational view of a weighing jig having a hammer and hammer shank disposed thereon for determining weights useful in the methodology of the invention.

Referring now to FIG. 5B in a discussion of another embodiment of the invention, it is to be seen that key balancing can be achieved without measuring touchweight. Smoothly decremental strike weight values are first specified in this situation. Strike weight is defined as the weight of the hammer 106 taken at the strike point 107 (see FIG. 5B) of the hammer 106 with the attached hammer shank 100 being oriented in a horizontal attitude and resting on a low friction pivot 134 at a point in line with a vertical axis through the shank center pin 135. The mechanism of FIG. 5B allows direct measurement of strike weight. The strike weight is then conformed to specification by adding weight to or subtracting weight from the hammer 106.

Figure 4:
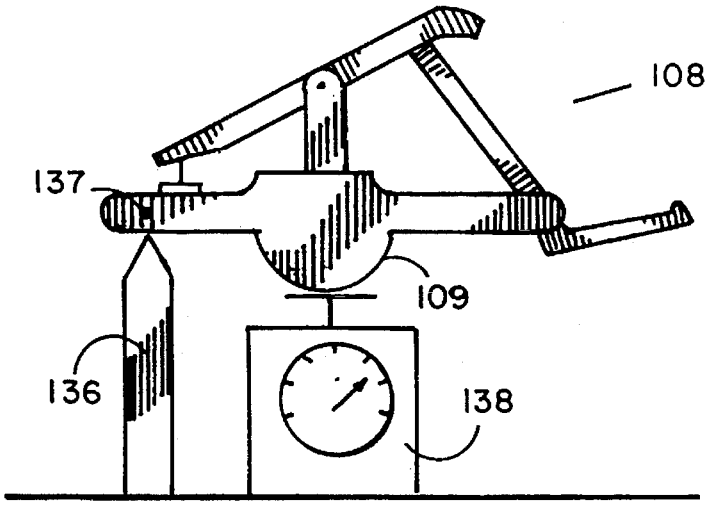
FIG. 4 is a side elevational view of a wippen shown in a jig intended to facilitate balancing of a key mechanism according to an embodiment of the invention.

Referring again to FIG. 4, smoothly incremental wippen weight values can be specified for each note using the mechanism so provided. The wippen weight is defined as the weight of the wippen taken at the point of contact between the wippen and the capstan 110 as is best seen in FIG. 1. In this determination of wippen weight, the wippen is oriented in a horizontal attitude similar to that when installed in the key mechanism 101 with the distal end of the wippen resting on a low friction pivot 136 in line with a vertical axis through wippen center pin 137. When determining wippen weight with the wippen 108 removed from the key mechanism 101 and placed on the low friction pivot 136 associated with scale 138, the contact point 109 is taken to be that location at which the wippen 108 would contact the capstan 110 in the arrangement of the key mechanism 101.

Still further, uniform strike ratio values can be specified for each note. The strike ratio is the ratio of the weight at the hammer 106 to its leveraged effect in an upward direction at the measuring point. The strike balance weight is defined as the static force exerted in an upward direction at the measuring point resulting from the leveraged strike weight. As an example, a note with a 10 gram strike weight and a 5 strike ratio will have a 50 gram strike balance weight. The strike ratio is defined also relative to the ratio of downward movement of the measuring point with the associated upward movement at the strike point and is governed by the design in construction of an individual action (not shown).

Still further, a uniform keystick ratio is specified for each note, the keystick ratio being defined as the ratio between the downward force at the capstan 110 and the resulting upward force at the measuring point. The keystick ratio is governed by the specified design and construction of an individual action (not shown).

Still further, smoothly decremental top action balance weight specifications are then determined for each note as the sum of the strike balance weight and the wippen balance weight. The strike balance weight is defined as the product of the strike weight and the ratio. The wippen balance weight is defined as the product of the wippen weight and the keystick ratio. The top action balance weight specification so derived may be substituted into the methodology of the various processes of the invention for the purpose of calculating front weight specifications as will be described hereinafter. The average trend of the balance weight in the finished key weights will equal the balance weight specification assuming that the leverage components of the key mechanisms are properly manufactured to specification.

The methodology can be varied by measurement of the strike weight of the hammers to produce a strike weight specification. Every tenth note can be surveyed and the average trend determined to provide the strike weight specification. Variation in sampling can occur as desired.

A method for balancing the key mechanisms 101 without measuring touch weight involves specification of a smooth strike weight for each note and then adding or subtracting weight from the hammer to make that strike weight. A smooth wippen weight for each key assembly 101 is then specified and weight is then added or subtracted from the center of the wippen 108 in order to produce the wippen weight. A smooth strike ratio and keystick ratio are then specified with derivation of the strike balance weight as the product of the strike weight and the strike ratio. The wippen balance weight is then derived as the product of the wippen weight and the keystick ratio. The smoothed top action balance weight is then derived as the sum of the strike balance weight and the wippen balance weight. Using the smoothed top action balance weight as aforesaid for deriving the front weight specification, each keystick 126 can be balanced to this front weight specification.

Figure 3:
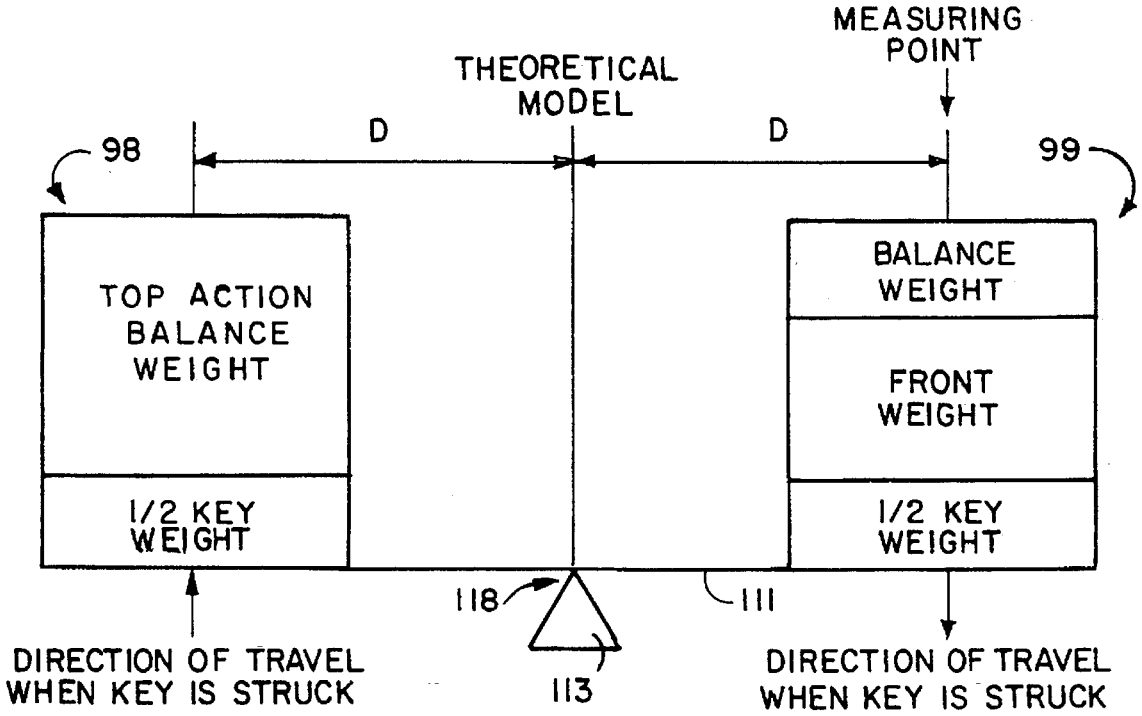
FIG. 3 is a schematic illustrating a theoretical model of a balanced keystick.

Referring now to FIG. 3, a theoretical model underlying the invention which is conceptually analogous to a seesaw can be seen. Conceptually, a weightless horizontal beam 111 rests on a fulcrum 113 with weights 98 and 99 resting on opposite ends of the beam 111 and equidistant from the fulcrum 113. The top action balance weight and one-half of the key weight of the weight 98 exert an upward force at point 118, the weight 99 exerting a downward force at point 118. With the balance weight made a part of the weight 99, the balance of static forces at point 118 is zero. When the key is struck, the top action balance weight, the key weight and the front weight are thron into motion on either side of the fulcrum 113, their sum being the inertial weight.

Referring again to FIG. 1, it is practically seen that the weight of the parts on the back of the key mechanism 101, resting on top of the capstan 110, translate to an upward force at the measuring point 118, referred to as the "top action balance weight." The value of the top action balance weight represents the amount of force which the top action, that is, the wippen 108, the hammer shank 100, and the hammer 106, along with associated leverages exerts on the front of the key mechanism 101 at the measuring point 118. The front weight refers to the extra weight on the front side of the key. In this analogy, the top action weight as measured at the measuring point 118 is seen to equal the sum of the front weight as measured at the measuring point 118 and the balance weight which is the net difference in weight between the front and the back of the key mechanism 101 as measured at the measuring point 118.

As a demonstrative example, a further method for determining top balance action weight uses only downweight and upweight measurements. The wippen 108 and the hammer shank 100 including attached hammer 106 are temporarily lifted so that the keystick is free to move upwarldy and downwardly. If weights are then placed temporarily on either the front top 127 or on the back top 129 of the keystick 126 so that the keystick 126 becomes neutrally balanced and the wippen 108 and the hammer shank 100 are unobstructed if let back down to the playing position. In surveying a finished piano action, there will normally be keyleads 116 mounted in the front end 119 of the keystick 126 in which case weight is temporarily added to the back of the keystick 126 so that the weight on either side of the keystick is equalized. The wippen 108 and the hammer shank 100 are then gently let back down onto the neutrally balanced keystick 126. The keystick 126, when depressed, will now feel heavy since the balancing effect of the keyleads 116 is neutralized. The upweight and the downweight for the keystick 126 are then measured and the balance weight is calculated. The value of the balance weight will be equal to the top action weight by virtue of the fact that the front weight of the keystick 126 has been temporarily brought to zero. The top action weight thus determined will be the same as the top action balance weight derived as the sum of the balance weight and the front weight.

With temporary weights removed from the keystick 126, the normal balance weight of the keystick is measured at the front of the keystick. The front weight can then be seen to equal the top weight minus the balance weight. The derivation of the front weight can be confirmed by removing the keystick 126 from the key mechanism 101 and placing the balance point 125 on the low friction pivot 130 as seen in FIG. 2. The front end 119 of the keystick 126 is rested on the scale 128 at the measuring point 118 as aforesaid. The front weight thus derived will match the theoretical value.

In a normal piano action, a key mechanism 101 has weight added to the front of the keystick 126 in the form of keyleads 116 to cause the top action to be brought to the final balance weight. If the top action balance weight and front action weight are known, the balance weight of the key can be predicted by subtraction of the front action weight from the top action balance weight. Determination of the top action balance weight and of the front weight accounts for two of the three weight components in the key mechanism 101. The third weight component is the weight of the keystick 126 itself. This keyweight can be determined based on surveys of keysticks according to the following procedure. An expendible keystick 126 is placed on the jig 90 as is seen in FIG. 2 to balance the keystick 126. The keystick is then removed from the jig 90 and cut in half vertically at its balance hole position 92 as seen in FIG. 5A. Without moving or disturbing the jig 90, the back half 94 of the keystick 126 is rotated horizontally 180° and set back on the jig 90 with the balance hole position 92 resting on the low friction pivot 130 and with the back half 94 of the keystick 126 therefor resting on the scale 128. The reading of the scale 128 indicates half of the total weight of the keystick 126, that is, the backside of the keystick 126, since an equal amount of weight would be on the front of the keystick 126 in a neutrally balanced keystick. The total weight of the keystick that is thrown into motion when the key mechanism 101 is played is found by doubling this value. The back half 94 of the keystick 126 is used to determine this value since it is more uniform in weight than the front half 96 of the keystick 126.

A value known as the inertial weight of the key mechanism 101 can be derived as the sum of the three weight factors previously referred to, this value being the sum of the top action weight, the front weight and the key weight. If any of the backlead 117 is present in the keystick 126, then the weight of the backlead 117 is added, the weight of the backlead being the weight effect, at the measuring point of leads disposed on the back side of the keystick 126. It is to be seen that actions having a higher than normal total inertial weight are observed to feel heavier than normal to pianists and actions which have a lower than normal total inertial weight feel lighter than normal to pianists. Further, piano actions with uniform inertial weight are seen to feel smoother and to be more uniform than piano actions with significantly inconsistent inertial weight.

Figure 6:
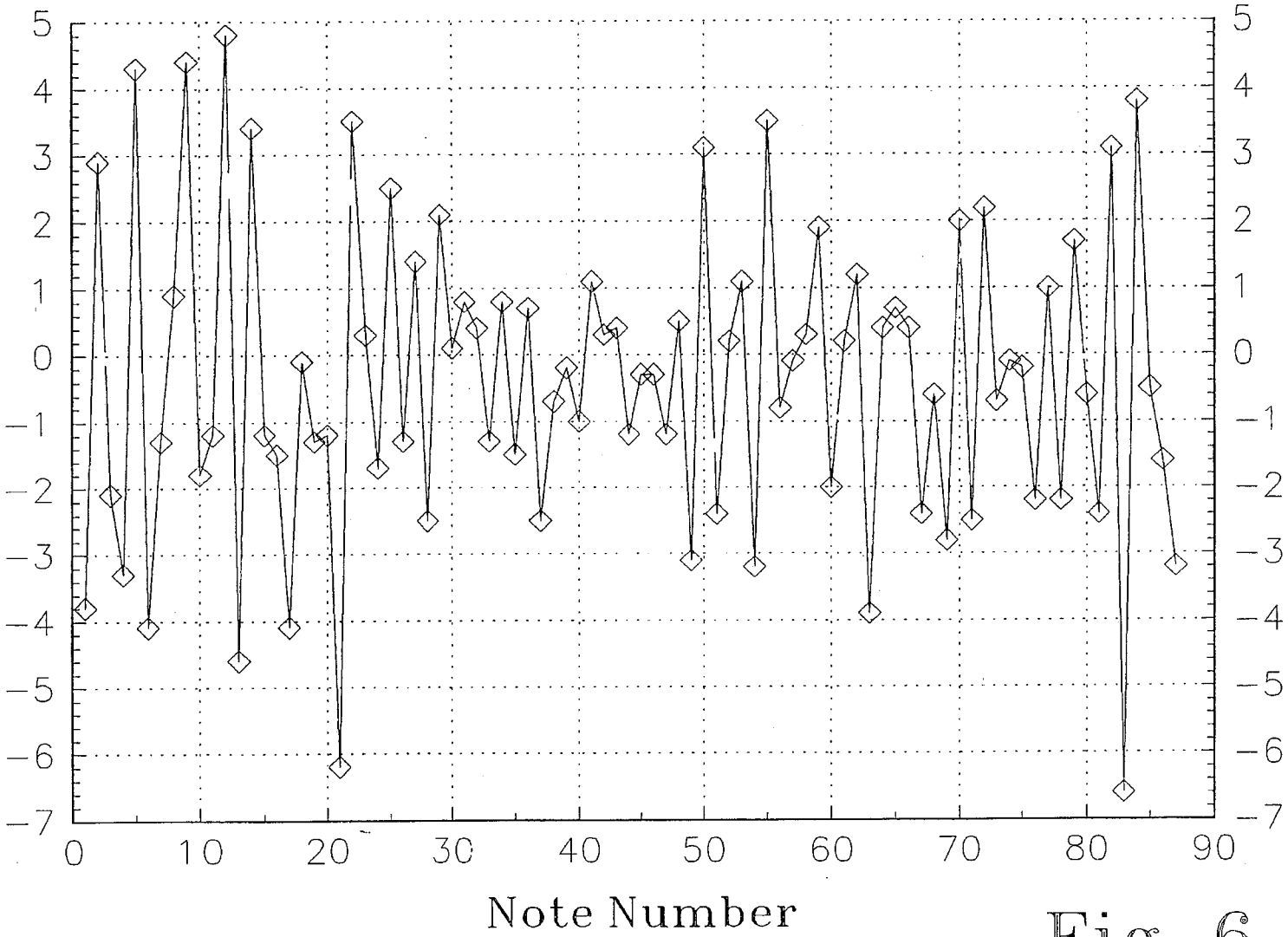
FIG. 6 is a graph of the front weights of each note minus the front weight of the preceding note found by a keybalancing methodology of the prior art.
Figure 7:
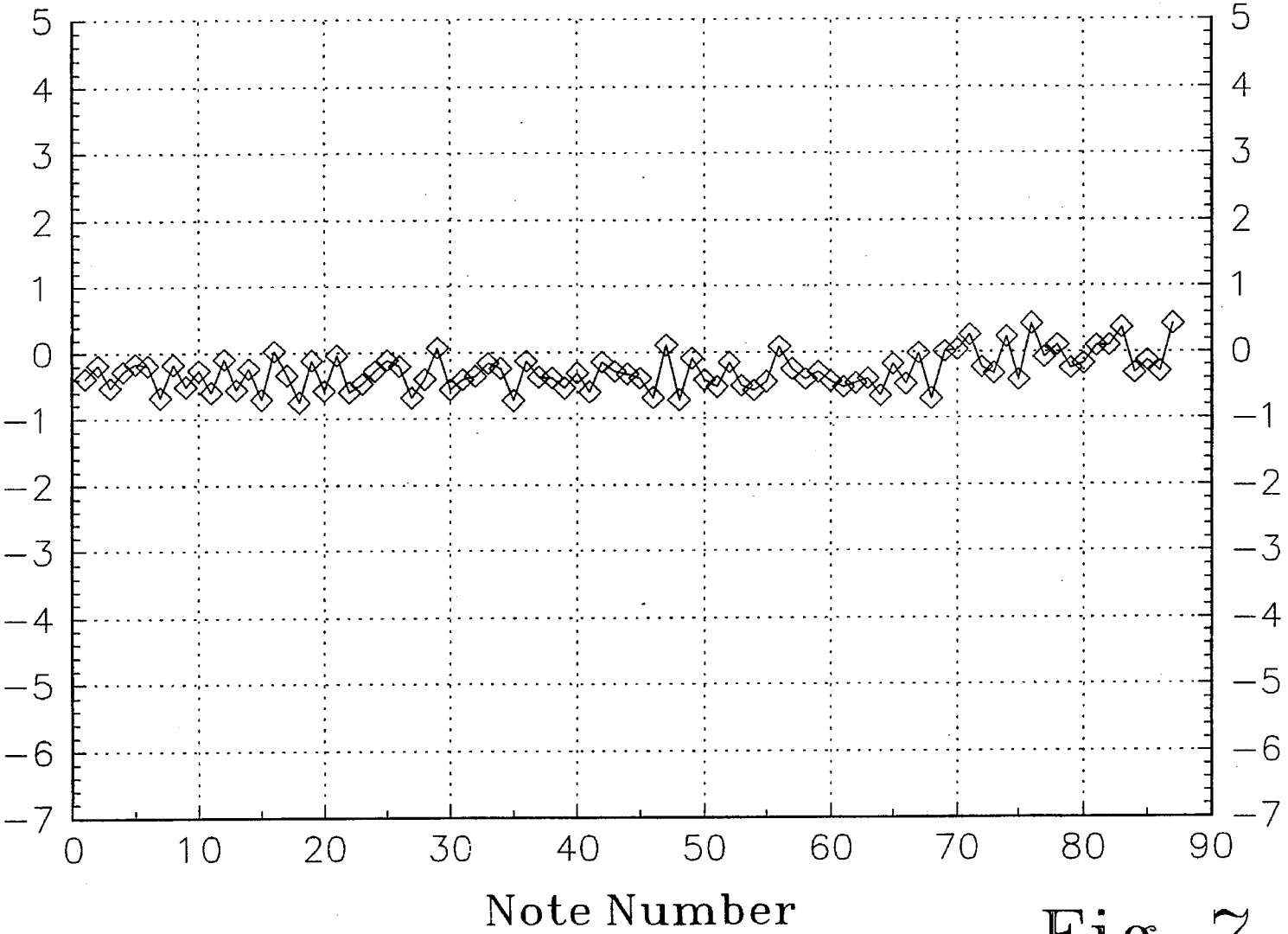
FIG. 7 is a graph illustrating the front weight minus the front weight of the preceding note for each note of a piano action balanced according to methodology of the invention.

Referring now to FIG. 6, the front weight of each note in a piano action is shown minus the front weight of the preceding note. FIG. 6 represents the results using prior art technology executed under highly controlled factory conditions and illustrates the tremendous variation in front weight between immediately adjacent notes and amoung groups of adjacent notes. FIG. 7, on the other hand, illustrates the front weight, minus the front weight of the preceding note, for the various notes of a piano action when the present methodology is utilized according to the invention under normal factory conditions. It is to be seen from FIG. 7 that the methodology of the invention produces extraordinarily more consistent results with a resulting improvement in the feel of a piano to a pianist. FIGS. 6 and 7 serve to dramatically illustrate that the utilization of the present methodology by manufacturers or pianos, as well as in the restoration of pianos and the like, will enable the production of instruments having a significantly higher degree of consistency in the feel and response of the keys across the keyboard of the instrument. The metrology of the invention renders possible the full definition of the factors which determine the characteristic feel of an action and introduces the possibility of characterising and standardizing the way pianos feel and play. The various methods of the invention render possible the manufacture of any desired feel of a piano action from that which is most physically demanding to that which is least physically demanding at a significantly higher level of quality than has been heretofore obtainable.

Referring now to Table I, the values are given for each note of a piano keyboard for the graphed values as seen in FIG. 6. The designated "Front" is a typical set of front weights yielded from the prior art under highly controlled conditions. The designation "DEV" is the front weight of a given note subtracted from the next note. As can be seen in Table I, the particular values graphed in FIG. 6 are provided.

TABLE I

| Note | Front | DEV | Note | Front | DEV |
|---|---|---|---|---|---|
| 1 | 41.7 | −3.8 | 54 | 22.7 | −3.2 |
| 2 | 37.9 | 2.9 | 55 | 19.5 | 3.5 |
| 3 | 40.8 | −2.1 | 56 | 23.0 | −0.8 |
| 4 | 38.7 | −3.3 | 57 | 22.2 | −0.1 |
| 5 | 35.4 | 4.3 | 58 | 22.1 | 0.3 |
| 6 | 39.7 | −4.1 | 59 | 22.4 | 1.9 |
| 7 | 35.6 | −1.3 | 60 | 24.3 | −2.0 |
| 8 | 34.3 | 0.9 | 61 | 22.3 | 0.2 |
| 9 | 35.2 | 4.4 | 62 | 22.5 | 1.2 |
| 10 | 39.6 | −1.8 | 63 | 23.7 | −3.9 |
| 11 | 37.8 | −1.2 | 64 | 19.8 | 0.4 |
| 12 | 36.6 | 4.8 | 65 | 20.2 | 0.7 |
| 13 | 41.4 | −4.6 | 66 | 20.9 | 0.4 |
| 14 | 36.8 | 3.4 | 67 | 21.3 | −2.4 |
| 15 | 40.2 | −1.2 | 68 | 18.9 | −0.6 |
| 16 | 39.0 | −1.5 | 69 | 18.3 | −2.8 |
| 17 | 37.5 | −4.1 | 70 | 15.5 | 2.0 |
| 18 | 33.4 | −0.1 | 71 | 17.5 | −2.5 |
| 19 | 33.3 | −1.3 | 72 | 15.0 | 2.2 |
| 20 | 32.0 | −1.2 | 73 | 17.2 | −0.7 |
| 21 | 30.8 | −6.2 | 74 | 16.5 | −0.1 |
| 22 | 24.6 | 3.5 | 75 | 16.4 | −0.2 |
| 23 | 28.1 | 0.3 | 76 | 16.2 | −2.2 |
| 24 | 28.4 | −1.7 | 77 | 14.0 | 1.0 |
| 25 | 26.7 | 2.5 | 78 | 15.0 | −2.2 |
| 26 | 29.2 | −1.3 | 79 | 12.8 | 1.7 |
| 27 | 27.9 | 1.4 | 80 | 14.5 | −0.6 |
| 28 | 29.3 | −2.5 | 81 | 13.9 | −2.4 |
| 29 | 26.8 | 2.1 | 82 | 11.5 | 3.1 |
| 30 | 28.9 | 0.1 | 83 | 14.6 | −6.6 |
| 31 | 29.0 | 0.8 | 84 | 8.0 | 3.8 |
| 32 | 29.8 | 0.4 | 85 | 11.8 | −0.5 |
| 33 | 30.2 | −1.3 | 86 | 11.3 | −1.6 |
| 34 | 28.9 | 0.8 | 87 | 9.7 | −3.2 |
| 35 | 29.7 | −1.5 | | | |
| 36 | 28.2 | 0.7 | | | |
| 37 | 28.9 | −2.5 | | | |
| 38 | 26.4 | −0.7 | | | |
| 39 | 25.7 | −0.2 | | | |
| 40 | 25.5 | −1.0 | | | |
| 41 | 24.5 | 1.1 | | | |
| 42 | 25.6 | 0.3 | | | |
| 43 | 25.9 | 0.4 | | | |
| 44 | 26.3 | −1.2 | | | |
| 45 | 25.1 | −0.3 | | | |
| 46 | 24.8 | −0.3 | | | |
| 47 | 24.5 | −1.2 | | | |
| 48 | 23.3 | 0.5 | | | |
| 49 | 23.8 | −3.1 | | | |
| 50 | 20.7 | 3.1 | | | |
| 51 | 23.8 | −2.4 | | | |
| 52 | 21.4 | 0.2 | | | |
| 53 | 21.6 | 1.1 | | | |

Table II relates to FIG. 7 in that each note is seen to have a particular front weight designated by "Front" with that front weight having been yielded from the notes of a typical action which have been processed according to the invention under normal high production factory conditions. The designation "Dev" in Table II represents the deviations graphed in FIG. 7.

TABLE II

| Note | Front | Dev | Note | Front | Dev |
|---|---|---|---|---|---|
| 1 | 29.2 | −0.4 | 45 | 13.4 | −0.4 |
| 2 | 28.8 | −0.2 | 46 | 13.0 | −0.7 |
| 3 | 28.6 | −0.5 | 47 | 12.3 | 0.1 |
| 4 | 28.0 | −0.3 | 48 | 12.4 | −0.7 |
| 5 | 27.8 | −0.2 | 49 | 11.7 | −0.1 |
| 6 | 27.6 | −0.2 | 50 | 11.6 | −0.4 |
| 7 | 27.4 | −0.7 | 51 | 11.2 | −0.5 |
| 8 | 26.7 | −0.2 | 52 | 10.6 | −0.2 |

TABLE II-continued

| Note | Front | Dev | Note | Front | Dev |
|---|---|---|---|---|---|
| 9 | 26.5 | −0.5 | 53 | 10.5 | −0.5 |
| 10 | 26.0 | −0.3 | 54 | 10.0 | −0.6 |
| 11 | 25.8 | −0.6 | 55 | 9.4 | −0.5 |
| 12 | 25.2 | −0.1 | 56 | 8.9 | 0.1 |
| 13 | 25.1 | −0.6 | 57 | 9.0 | −0.3 |
| 14 | 24.5 | −0.2 | 58 | 8.8 | −0.4 |
| 15 | 24.2 | −0.7 | 59 | 8.4 | −0.3 |
| 16 | 23.5 | 0.0 | 60 | 8.1 | −0.4 |
| 17 | 23.5 | −0.3 | 61 | 7.6 | −0.5 |
| 18 | 23.2 | −0.8 | 62 | 7.1 | −0.5 |
| 19 | 22.4 | −0.1 | 63 | 6.6 | −0.4 |
| 20 | 22.3 | −0.6 | 64 | 6.2 | −0.7 |
| 21 | 21.7 | −0.0 | 65 | 5.5 | −0.2 |
| 22 | 21.7 | −0.6 | 66 | 5.4 | −0.5 |
| 23 | 21.1 | −0.5 | 67 | 4.9 | −0.0 |
| 24 | 20.6 | −0.3 | 68 | 4.9 | −0.7 |
| 25 | 20.3 | −0.1 | 69 | 4.1 | 0.0 |
| 26 | 20.2 | −0.2 | 70 | 4.2 | 0.0 |
| 27 | 20.0 | −0.7 | 71 | 4.2 | 0.3 |
| 28 | 19.3 | −0.4 | 72 | 4.4 | −0.2 |
| 29 | 18.9 | 0.1 | 73 | 4.2 | −0.3 |
| 30 | 19.0 | −0.6 | 74 | 3.9 | 0.2 |
| 31 | 18.4 | −0.4 | 75 | 4.1 | −0.4 |
| 32 | 18.0 | −0.4 | 76 | 3.7 | 0.4 |
| 33 | 17.7 | −0.2 | 77 | 4.1 | −0.1 |
| 34 | 17.5 | −0.2 | 78 | 4.0 | 0.1 |
| 35 | 17.3 | −0.7 | 79 | 4.1 | −0.2 |
| 36 | 16.5 | −0.1 | 80 | 3.9 | −0.2 |
| 37 | 16.4 | −0.4 | 81 | 3.7 | 0.1 |
| 38 | 16.0 | −0.4 | 82 | 3.8 | 0.1 |
| 39 | 15.6 | −0.5 | 83 | 3.9 | 0.4 |
| 40 | 15.1 | −0.3 | 84 | 4.3 | −0.3 |
| 41 | 14.8 | −0.6 | 85 | 3.9 | −0.1 |

TABLE II-continued

| Note | Front | Dev | Note | Front | Dev |
|---|---|---|---|---|---|
| 42 | 14.2 | −0.1 | 86 | 3.8 | −0.3 |
| 43 | 14.0 | −0.3 | 87 | 3.5 | 0.4 |
| 44 | 13.7 | −0.3 | | | |

Figure 8:
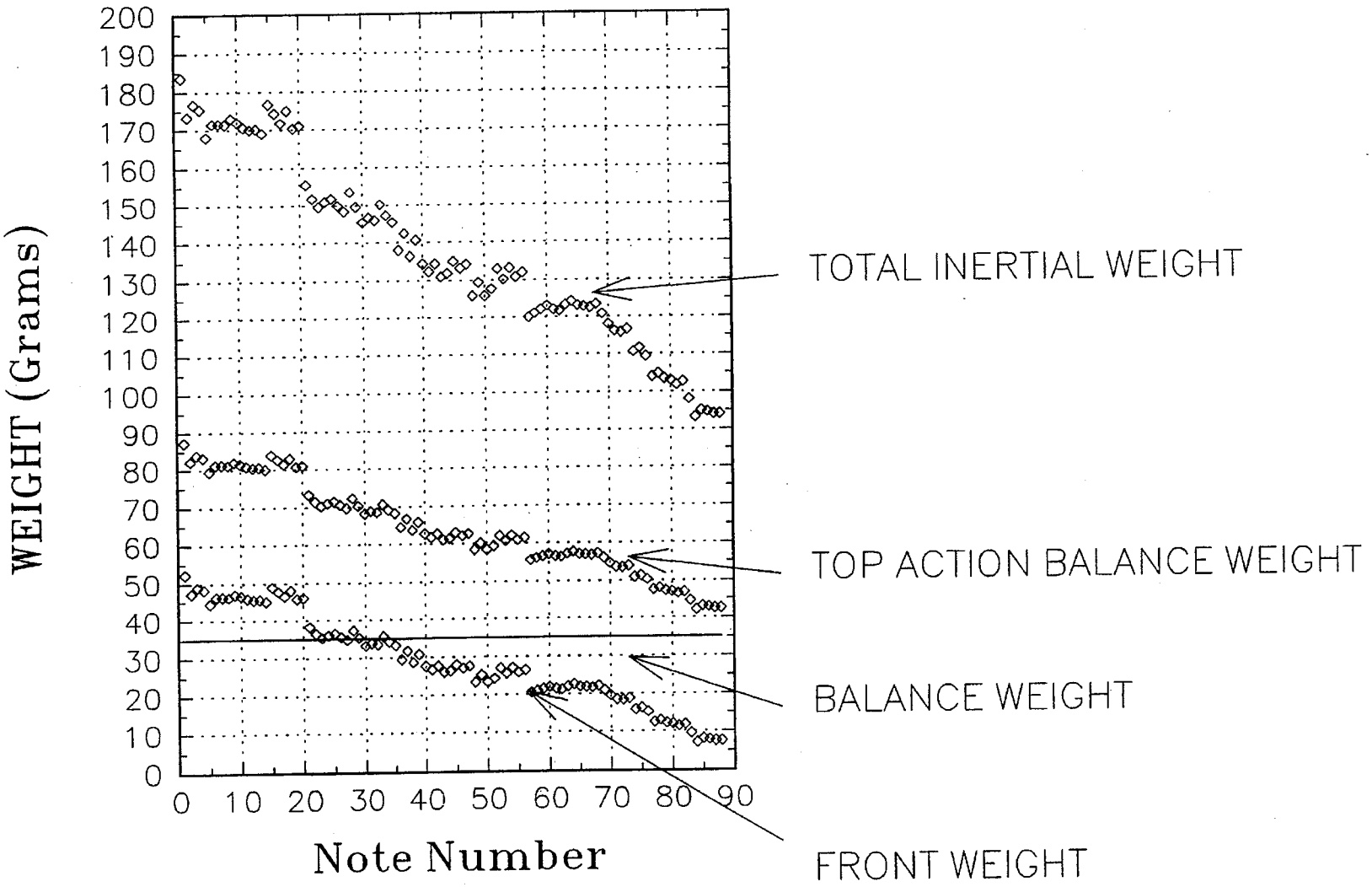
FIG. 8 is a graph illustrating typical prior art action weights determined by prior art methodology.

As a still further indication of the improvement provided by the present invention, reference is made to FIG. 8 which provides an example of a graph of a touchweight analysis of a piano balanced by key balancing methodology of the prior art. The example illustrated in FIG. 8 is taken from a typical piano and represents the highest possible ideal under prior art methodology. Note that the balance weight in FIG. 8 is perfectly uniform at a level of 35 grams. In most cases, such uniformity is rarely achieved even under the most ideal conditions due to the drawback of uncontrolled uniformity of friction present in the key mechanisms 101 during the prior art key balancing process. Table III illustrates the top action weight, key weight, balance weight, front weight and total inertial weight for each key as designated by its number for this prior art ideal touch weight analysis. The inconsistencies in the top action weight are expectedly found correlating with inconsistencies in the front weight. Where top action weight is higher than average, so is the front weight and vice versa. The sum of the inconsistencies cause the resulting total inertial weight to be doubly exaggerated. When the balance weight yielded is perfectly uniform, the uneven inertial weight causes an inconsistent piano "feel" to the pianist.

TABLE III

Top = Surveyed BW = Hypothetical
Key = Estimated Front = Top − BW
Total = Top + Key + Front

| Note | Top | Key | BW | Front | Total | Note | Top | Key | BW | Front | Total |
|---|---|---|---|---|---|---|---|---|---|---|---|
| 1 | 87.3 | 44.0 | 35.0 | 52.3 | 184 | 45 | 63.0 | 44.0 | 35.0 | 28.0 | 135 |
| 2 | 82.2 | 44.0 | 35.0 | 47.2 | 173 | 46 | 62.1 | 44.0 | 35.0 | 27.1 | 133 |
| 3 | 83.9 | 44.0 | 35.0 | 48.9 | 177 | 47 | 62.6 | 44.0 | 35.0 | 27.6 | 134 |
| 4 | 83.3 | 44.0 | 35.0 | 48.3 | 176 | 48 | 58.4 | 44.0 | 35.0 | 23.4 | 126 |
| 5 | 79.5 | 44.0 | 35.0 | 44.5 | 168 | 49 | 60.2 | 44.0 | 35.0 | 25.2 | 129 |
| 6 | 81.3 | 44.0 | 35.0 | 46.3 | 172 | 50 | 58.4 | 44.0 | 35.0 | 23.4 | 126 |
| 7 | 81.3 | 44.0 | 35.0 | 46.3 | 172 | 5i | 59.3 | 44.0 | 35.0 | 24.3 | 128 |
| 8 | 81.2 | 44.0 | 35.0 | 46.2 | 171 | 52 | 62.0 | 44.0 | 35.0 | 27.0 | 133 |
| 9 | 82.0 | 44.0 | 35.0 | 47.0 | 173 | 53 | 60.6 | 44.0 | 35.0 | 25.6 | 130 |
| 10 | 81.5 | 44.0 | 35.0 | 46.5 | 172 | 54 | 62.1 | 41,.0 | 35.0 | 27.1 | 133 |
| 11 | 80.8 | 44.0 | 35.0 | 45.8 | 171 | 55 | 60.9 | 44.0 | 35.0 | 25.9 | 131 |
| 12 | 80.5 | 44.0 | 35.0 | 45.5 | 170 | 56 | 61.5 | 44.0 | 35.0 | 26.5 | 132 |
| 13 | 80.6 | 44.0 | 35.0 | 45.6 | 170 | 57 | 55.5 | 44.0 | 35.0 | 20.5 | 120 |
| 14 | 80.0 | 44.0 | 35.0 | 45.0 | 169 | 58 | 56.0 | 44.0 | 35.0 | 21.0 | 121 |
| 15 | 83.9 | 44.0 | 35.0 | 48.9 | 177 | 59 | 56.5 | 44.0 | 35.0 | 21.5 | 122 |
| 16 | 82.7 | 44.0 | 35.0 | 47.7 | 174 | 60 | 57.0 | 44.0 | 35.0 | 22.0 | 123 |
| 17 | 81.4 | 44.0 | 35.0 | 46.4 | 172 | 61 | 56.5 | 44.0 | 35.0 | 21.5 | 122 |
| 18 | 83.0 | 44.0 | 35.0 | 48.0 | 175 | 62 | 56.3 | 44.0 | 35.0 | 21.3 | 122 |
| 19 | 80.7 | 44.0 | 35.0 | 45.7 | 170 | 63 | 57.1 | 44.0 | 35.0 | 22.1 | 123 |
| 20 | 81.0 | 44.0 | 35.0 | 46.0 | 171 | 64 | 57.6 | 44.0 | 35.0 | 22.6 | 124 |
| 21 | 73. 3 | 44.0 | 35.0 | 38.3 | 156 | 65 | 57.0 | 44.0 | 35.0 | 22.0 | 123 |
| 22 | 71.4 | 44.0 | 35.0 | 36.4 | 152 | 66 | 56.9 | 44.0 | 35.0 | 21.9 | 123 |
| 23 | 70.3 | 44.0 | 35.0 | 35.3 | 150 | 67 | 56.7 | 44.0 | 35.0 | 21.7 | 122 |
| 24 | 71.0 | 44.0 | 35.0 | 36.0 | 151 | 68 | 57.2 | 44.0 | 35.0 | 22.2 | 123 |
| 25 | 71.4 | 44.0 | 35.0 | 36.4 | 152 | 69 | 55.9 | 44.0 | 35.0 | 20.9 | 121 |
| 26 | 70.5 | 44.0 | 35.0 | 35.5 | 150 | 70 | 54.5 | 44.0 | 35.0 | 19.5 | 118 |
| 27 | 69.7 | 44.0 | 35.0 | 34.7 | 148 | 71 | 53.6 | 44.0 | 35.0 | 18.6 | 116 |
| 28 | 72.3 | 44.0 | 35.0 | 37.3 | 154 | 72 | 53.4 | 44.0 | 35.0 | 18.4 | 116 |
| 29 | 70.3 | 44.0 | 35.0 | 35.3 | 150 | 73 | 53.8 | 44.0 | 35.0 | 18.8 | 117 |
| 30 | 68.2 | 44.0 | 35.0 | 33.2 | 145 | 74 | 50.8 | 44.0 | 35.0 | 15.8 | 111 |
| 31 | 68.8 | 44.0 | 35.0 | 33.8 | 147 | 75 | 51.3 | 44.0 | 35.0 | 16.3 | 112 |
| 32 | 68.5 | 44.0 | 35.0 | 33.5 | 146 | 76 | 50.2 | 44.0 | 35.0 | 15.2 | 109 |
| 33 | 70.6 | 44.0 | 35.0 | 35.6 | 150 | 77 | 47.5 | 44.0 | 35.0 | 12.5 | 104 |
| 34 | 69.1 | 44.0 | 35.0 | 34.1 | 147 | 78 | 47.9 | 44.0 | 35.0 | 12.9 | 105 |

TABLE III-continued

Top = Surveyed BW = Hypothetical
Key = Estimated Front = Top − BW
Total = Top + Key + Front

| Note | Top | Key | BW | Front | Total | Note | Top | Key | BW | Front | Total |
|---|---|---|---|---|---|---|---|---|---|---|---|
| 35 | 68.2 | 44.0 | 35.0 | 33.2 | 145 | 79 | 47.2 | 44.0 | 35.0 | 12.2 | 103 |
| 36 | 64.5 | 44.0 | 35.0 | 29.5 | 138 | 80 | 47.0 | 44.0 | 35.0 | 12.0 | 103 |
| 37 | 66.7 | 44.0 | 35.0 | 31.7 | 142 | 81 | 46.4 | 44.0 | 35.0 | 11.4 | 102 |
| 38 | 63.7 | 44.0 | 35.0 | 28.7 | 136 | 82 | 46.8 | 44.0 | 35.0 | 11.8 | 103 |
| 39 | 65.8 | 44.0 | 35.0 | 30.8 | 141 | 83 | 44.5 | 44.0 | 35.0 | 9.5 | 98 |
| 40 | 62.7 | 44.0 | 35.0 | 27.7 | 134 | 84 | 42.1 | 44.0 | 35.0 | 7.1 | 93 |
| 41 | 61.7 | 44.0 | 35.0 | 26.7 | 132 | 85 | 43.0 | 44.0 | 35.0 | 8.0 | 95 |
| 42 | 62.7 | 44.0 | 35.0 | 27.7 | 134 | 86 | 42.8 | 44.0 | 35.0 | 7.8 | 95 |
| 43 | 61.0 | 44.0 | 35.0 | 26.0 | 131 | 87 | 42.5 | 44.0 | 35.0 | 7.5 | 94 |
| 44 | 61.4 | 44.0 | 35.0 | 26.4 | 132 | 88 | 42.5 | 44.0 | 35.0 | 7.5 | 94 |

Additional methodology according to the invention can be seen with reference to FIGS. 9 through 17, each of FIGS. 9 through 17 being respectively referenced to Tables IV through XII. The methodology represented by FIGS. 9 through 11 develop specifications for uniform front weight only or for uniform front weight with minimal amounts of a weight such as the backlead 117 for compensations of inconsistencies in top action weight. In the methods illustrated in FIGS. 9 through 11, the resulting total weight is a function of the top action weight and of the specified balance weight and cannot be specified.

Figure 9:
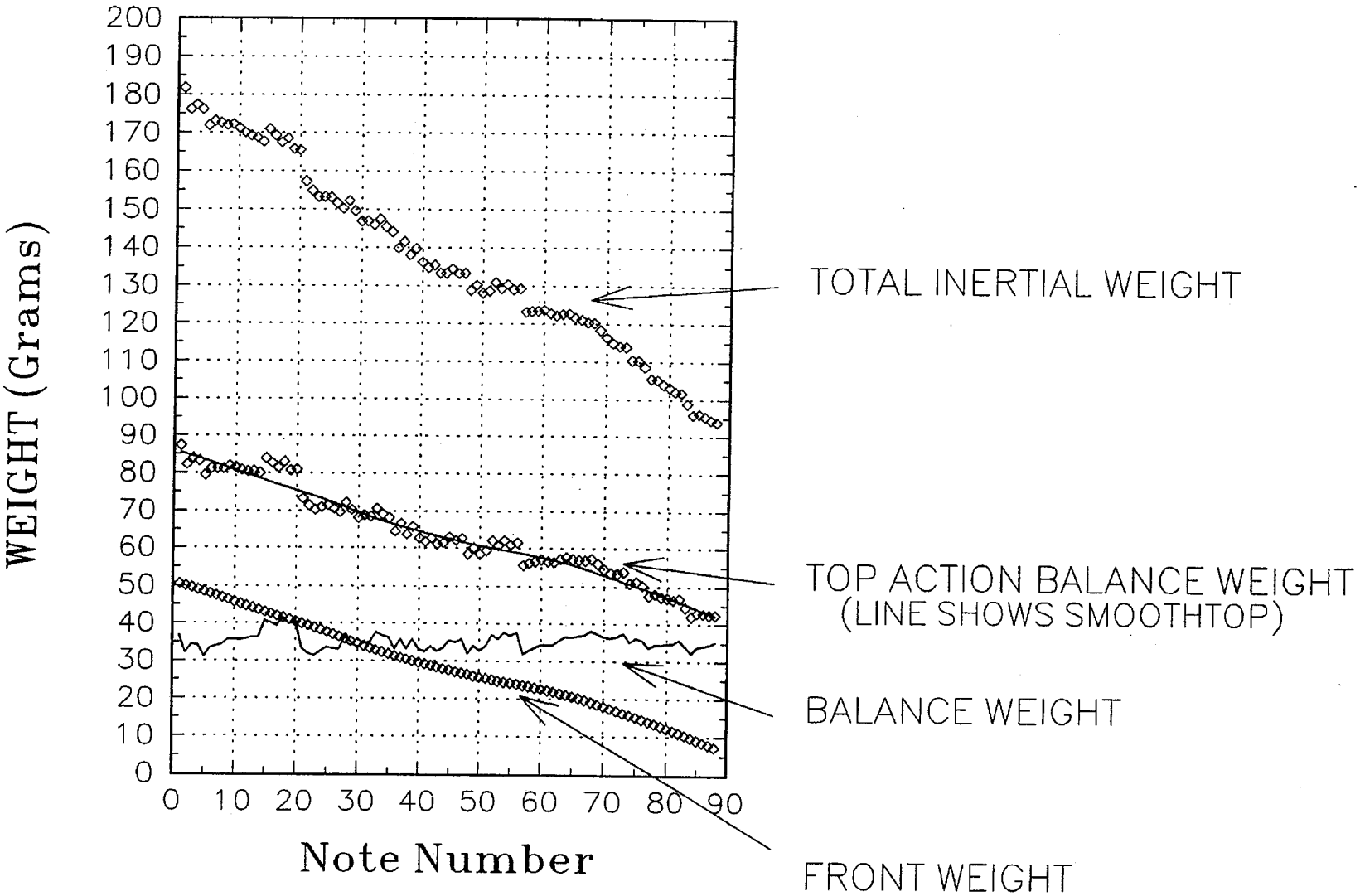
FIG. 9 is a graph illustrating the balance weights of keys which have been balanced according to an embodiment of the invention.
Figure 10:
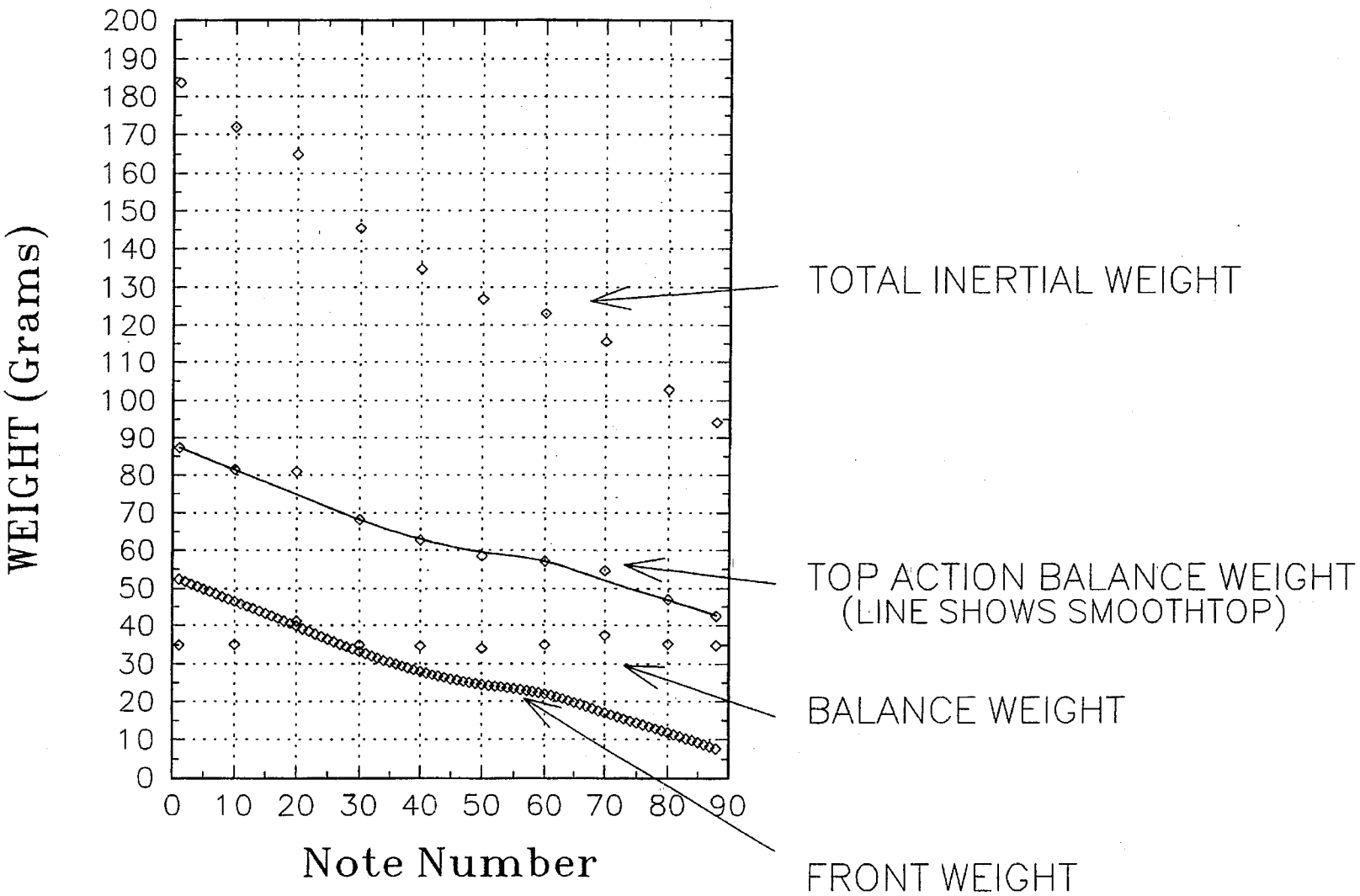
FIG. 10 is a graph illustrating the balance weights of keys which have been balanced according to an embodiment of the invention.
Figure 11:
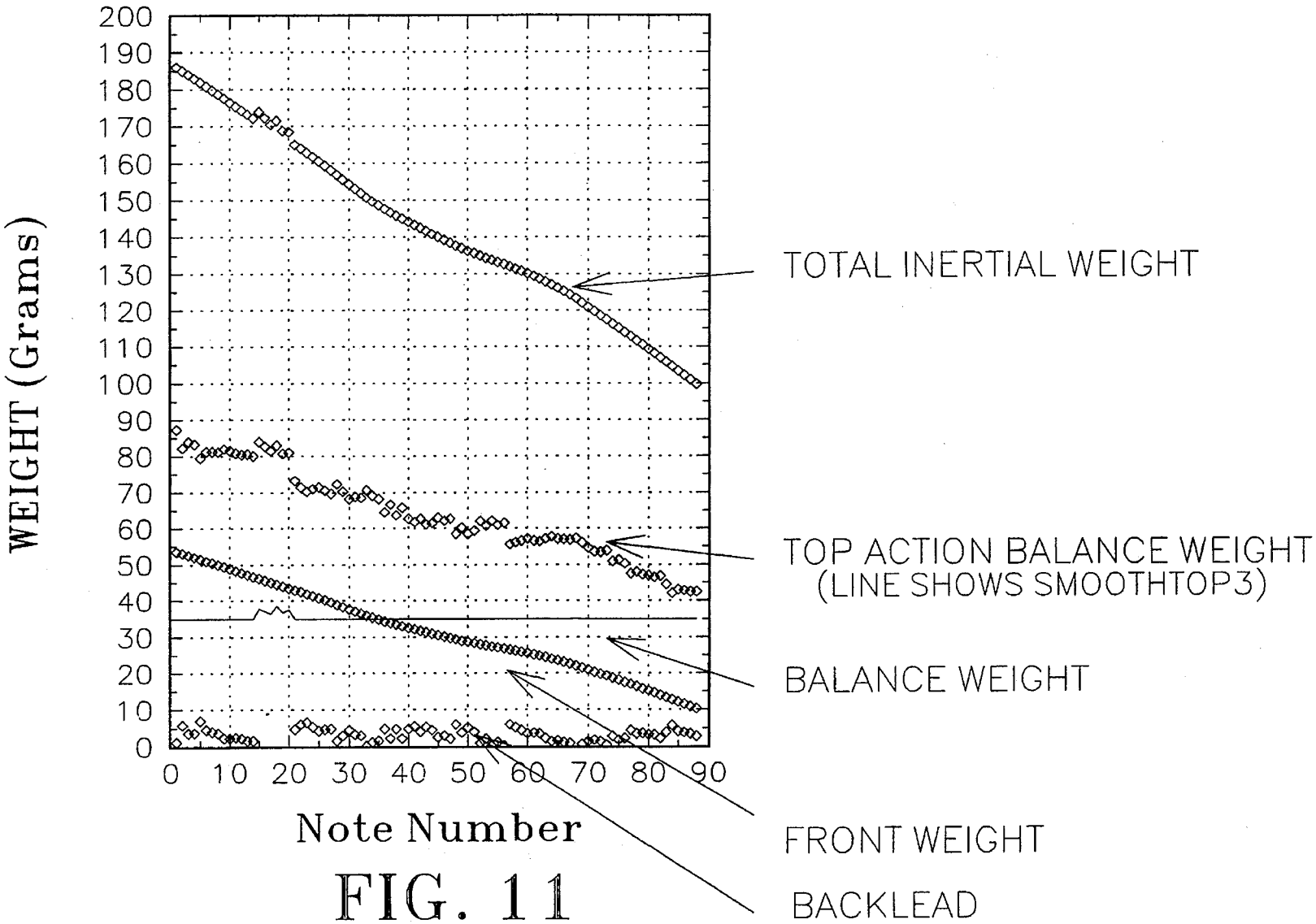
FIG. 11 is a graph illustrating the balance weights of keys Which have been balanced according to an embodiment of the invention.
Figure 12:
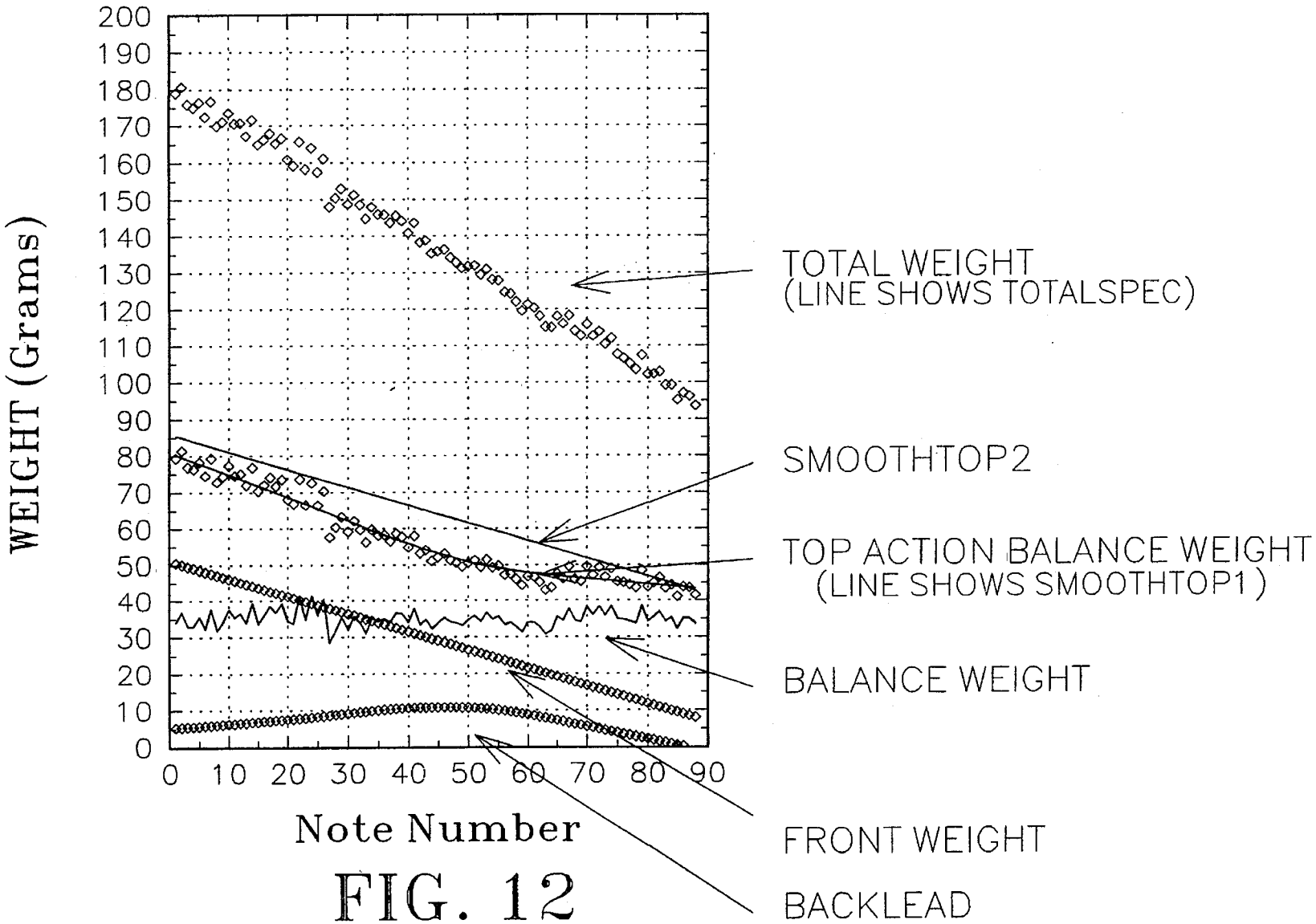
FIG. 12 is a graph illustrating the balance weights of keys which have been balanced according to an embodiment of the invention.
Figure 13:
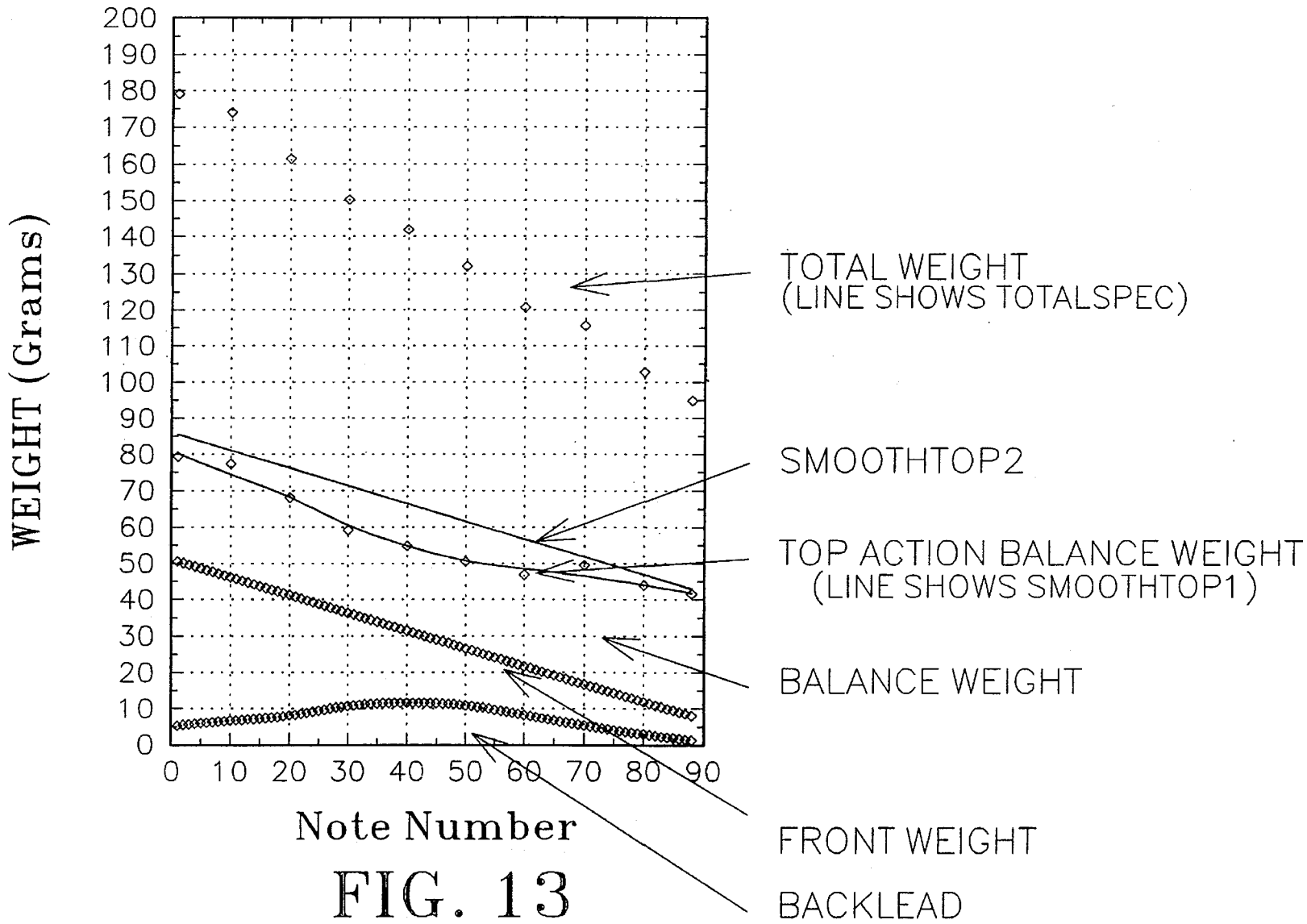
FIG. 13 is a graph illustrating the balance weights of keys which have been balanced according to an embodiment of the invention.
Figure 14:
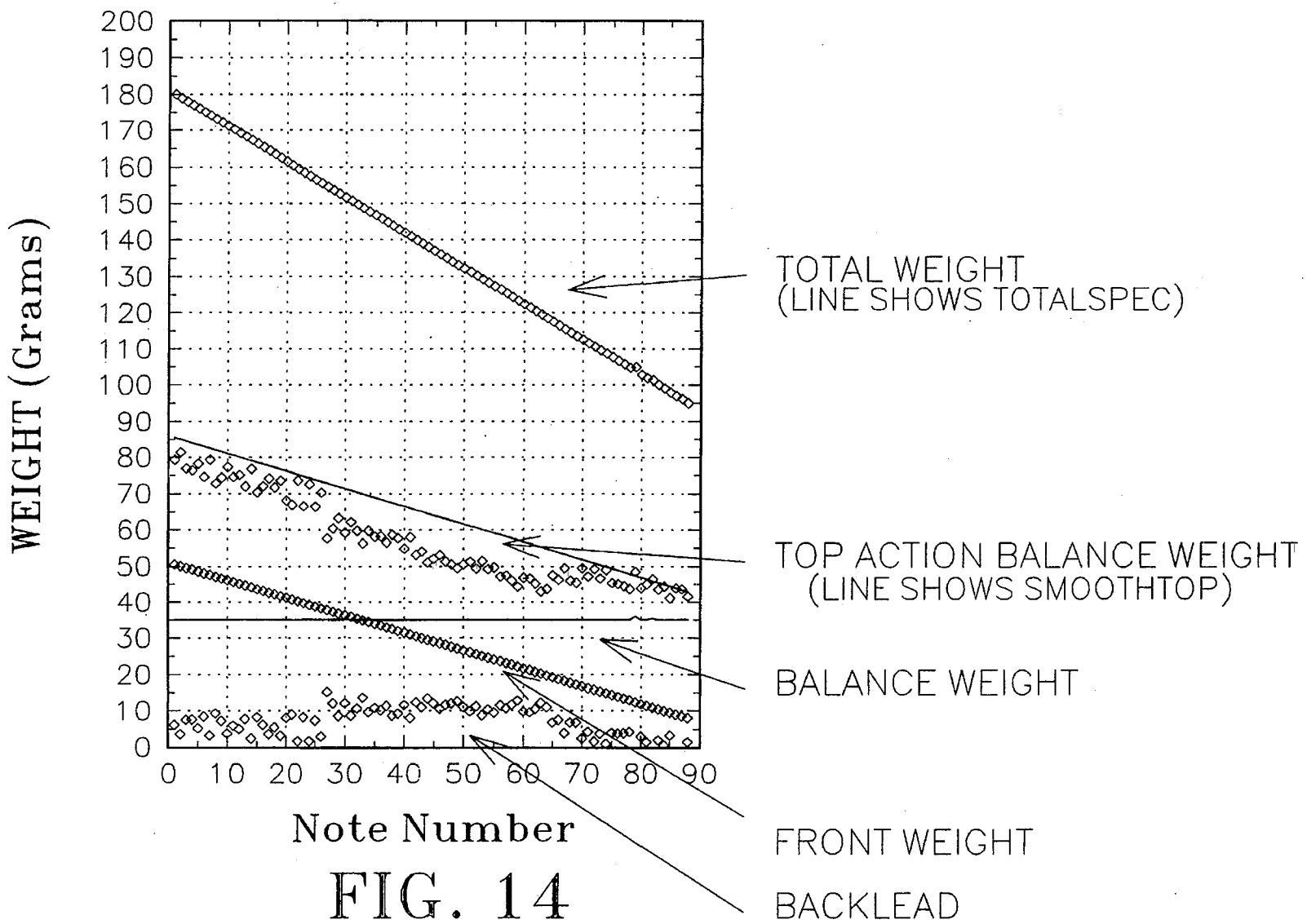
FIG. 14 is a graph illustrating the balance weights of keys which have been balanced according to an embodiment of the invention.

In the methodology represented by FIGS. 12 through 14, total weight is increased to specified levels in those cases where the total weight yielded from the respective methods of FIGS. 9 through 11 are too low. Increased total weight is achieved by adding appropriate amounts of weight such as the backlead 117 to each keystick 126 in combination with appropriate uniform keyleads 116, that is, front weights.

Figure 15:
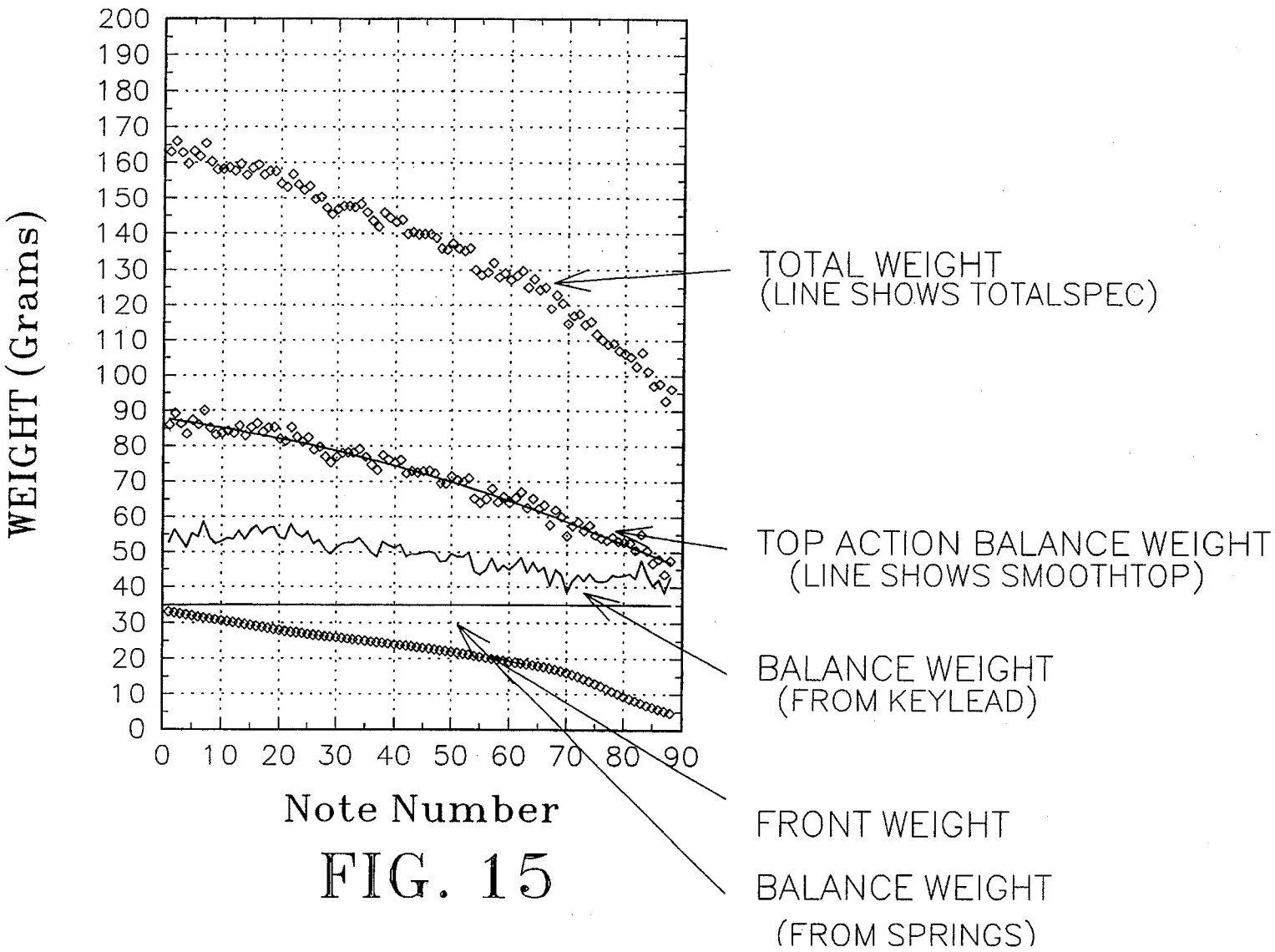
FIG. 15 is a graph illustrating the balance weights of keys which have been balanced according to an embodiment of the invention.
Figure 16:
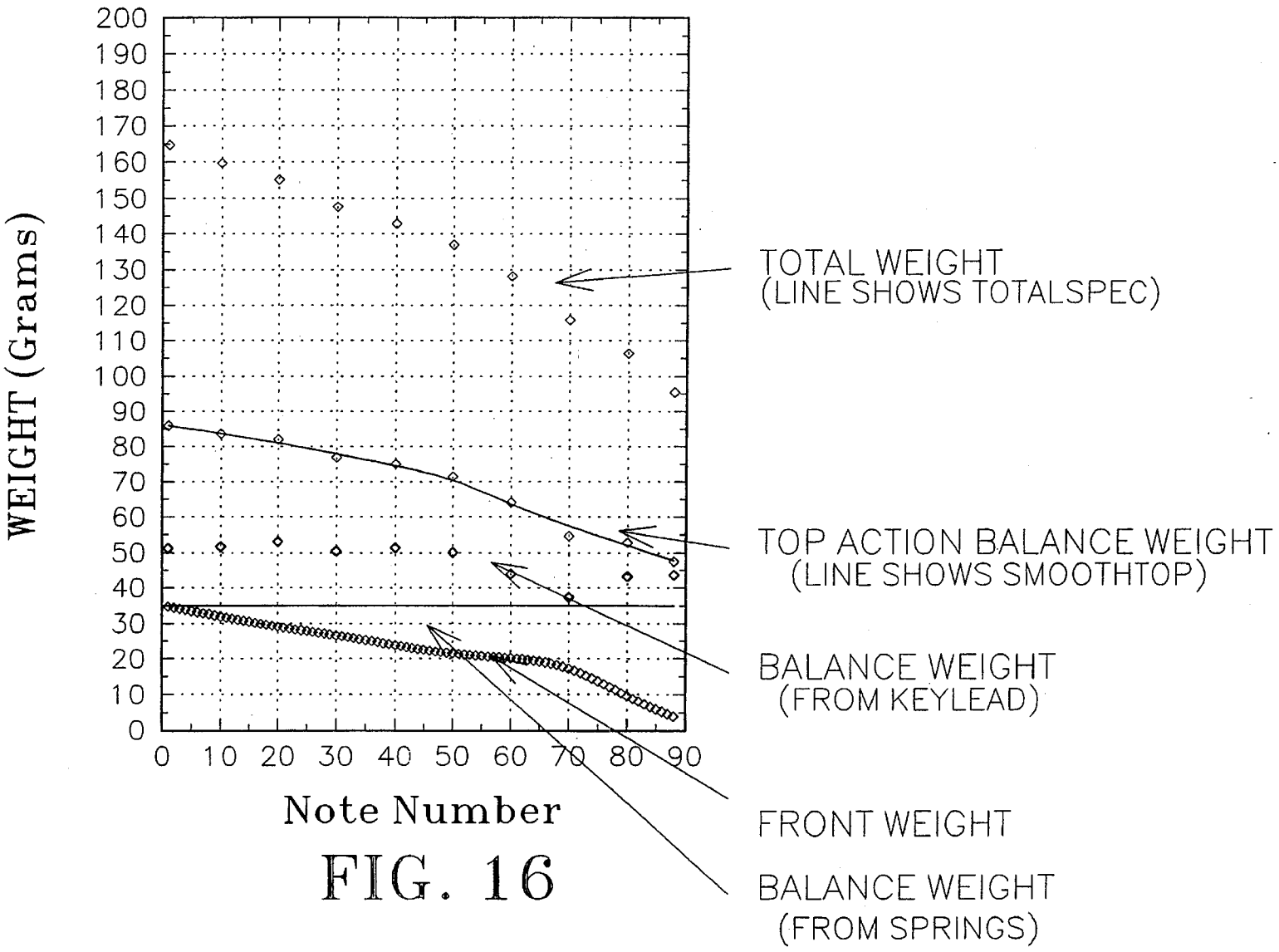
FIG. 16 is a graph illustrating the balance weights of keys which have been balanced according to an embodiment of the invention.

The methods represented by FIGS. 14 through 16 are used to reduce total weight to specified levels in those cases where the total weight yielded from the respective methods of FIGS. 9 through 11 are too high. Thus, a reduced total weight is achieved by reducing the front weight such that specified levels of total weight are achieved. The reduced front weight causes the yielded balance weight to be higher than specified. The final specified balance weight is achieved by fitting the repetitions with wippen support springs, that is, the spring 122 of FIG. 1, and adjusting the tension of each spring 122 to achieve a specified balance weight.

The methods represented by FIGS. 9, 10, 12, 13, 15 and 16 utilize only smooth front weight or smooth front weight combined with smooth backlead weight specifications. The resulting balance weight and total weights vary as a function of variations in the top action weight. The methods of FIGS. 10, 13 and 16 essentially respectively relate to the methods of FIGS. 9, 12 and 15 with the exception that a small number of keys are surveyed in order to determine the average level of top action weight. The methods of FIGS. 10, 13 and 16 find great utility in the manufacturing of piano actions and the like by virtue of time saved in surveying upweight, downweight and front weight prior to key balancing. In the methodology represented by FIGS. 10, 13 and 16, key balancing specifications are derived by surveying only a selected ten of 88 notes, the selected notes being approximately every 9th or 10th note.

Figure 17:
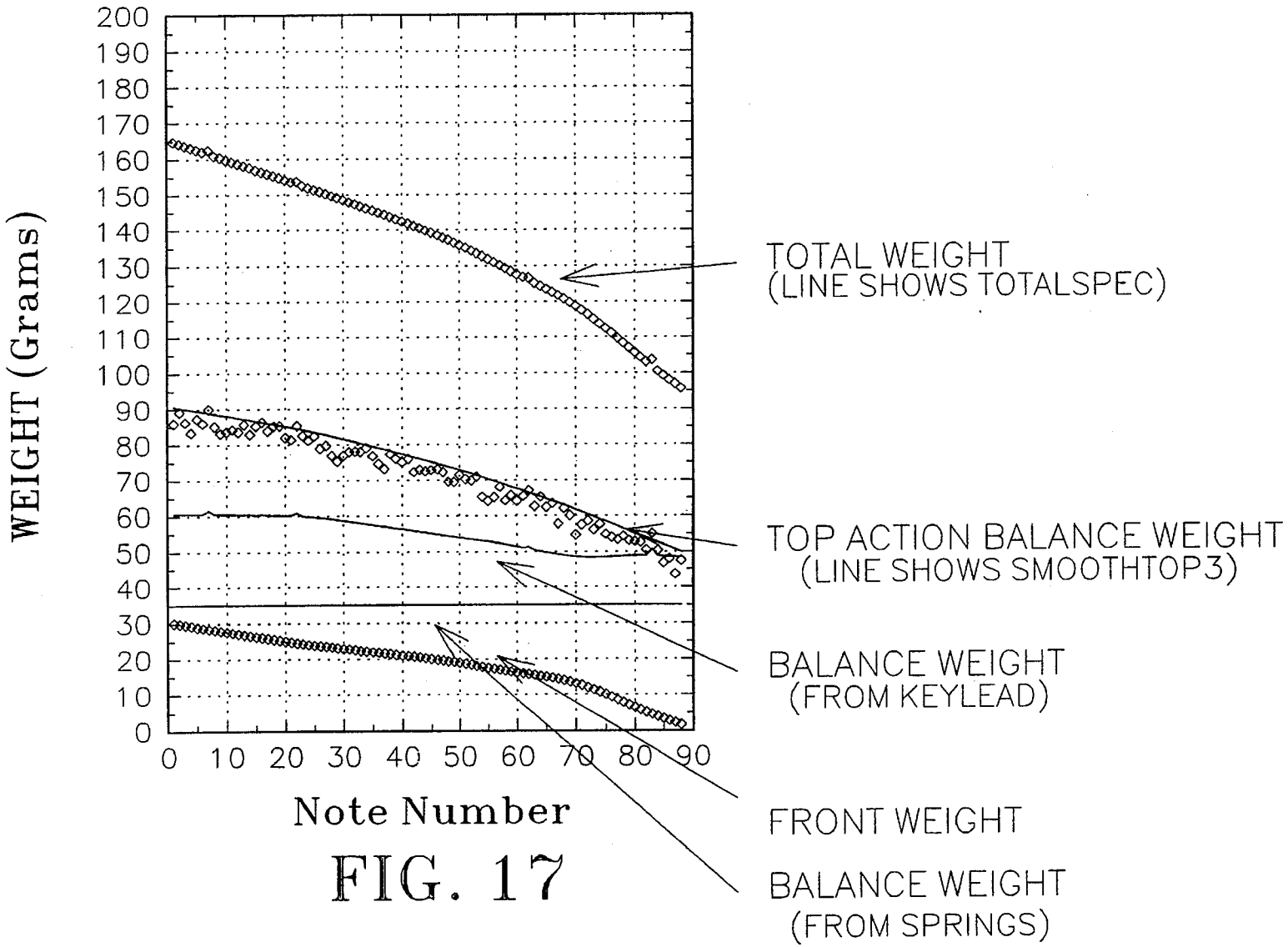
FIG. 17 is a graph illustrating the balance weights of keys which have been balanced according to an embodiment of the invention.

The methods represented by FIGS. 11, 14 and 17 derive specifications for uniform front weight as well as specifications for backlead which compensate for inconsistencies in the top action weight. The resulting total backlead and top action weight results in uniform weight on the back of the key. This uniform backweight combined with uniform front weight creates perfect linear uniformity of total inertial weight.

The method of FIG. 9 relates to Table IV and improves inertial weight uniformity and causes an average specified balance weight to be obtained. The column in Table IV designated as "Top" is surveyed and represents top action balance weight. The top action balance weights are derived from upweight, downweight and front weight values measured in the key mechanism 101 and in the keystick 126 prior to key balancing. Key weight as represented by "Key" in Table IV is estimated and the specified balance weight, seen as "BWspec" in Table IV, is specified. The smoothed top action balance weights are derived and are indicated in the column of Table IV designated as "SmoothTop" by statistical methods such as extrapolation which determines the average trend of the Top column of Table IV. The "Front" column of Table IV is derived by subtraction of the specified balance weight from the smoothed top action balance weight to yield the front weight which is the value noted in the Front column. Inertial weight is indicated as "Total" in the column of Table IV by adding the top weight, front weight and key weight to yield the values found in the Total column of Table IV. It is desirable to determine that those values which are derived fall within acceptable ranges of inertial weight. In the event that the values are not within acceptable ranges, the process of developing key balancing specifications may be aborted and appropriate corrective measures taken. The balance weight, noted in the column "BW" of Table IV, is then derived by subtracting the front weight from the top weight. It is then confirmed that the average trend of the yielded balance weight approximates the specified balance weight or BW.

The method represented in FIG. 9 uses the SmoothTop values based on the average trend of real top weight values to calculate smooth front weight values. The uniformity of the resulting total weight becomes a function of the uniformity of the real top action balance weight. This smoothing of front weight values reduces by half the "doubling" of error in total weight caused by prior art methodology. For example, in Table III in the column of total weight yielded with the prior art methodology, note that the difference in total weight between notes 56 and 57 is 12 grams. Note that in Table IV in the column of total weight yielded with the method represented by FIG. 9 that the difference in total weight between notes 56 and 57 is only 6 grams. In addition, the trend of the total weight yielded with the method represented by FIG. 9 follows the trend of the real top action weight. For example, if the trend of top action weight is curved, the trend of the total weight will be similarly curved.

The balance weight values yielded by the method represented by FIG. 9 are a direct expression of the inconsistencies in the total weight. The uniformity of the balance weight is therefore an indication of the uniformity of the manufacturing process. Measuring the balance weight in a finished action therefore provides a further quality control check in the consistency of the manufacturing process.

Although inconsistencies exist in the yielded balance weight of the methods of FIGS. 9 and 10, the inconsistencies are compable to those yielded with the prior art methodology but with the added benefit of improved inertial uniformity.

TABLE IV

Top = Surveyed
BWspec = Specified
Front = SmoothTop − BWspec
Total = Top + Key + Front
BW = Top − Front
Key = Estimated
SmoothTop = Hypothetical Top (smoothed)

| Note | Top | Key | BWspec | SmoothTop | Front | Total | BW |
|---|---|---|---|---|---|---|---|
| 1 | 87.3 | 44.0 | 35.0 | 85.5 | 50.5 | 182 | 36.8 |
| 2 | 82.2 | 44.0 | 35.0 | 85.0 | 50.0 | 176 | 32.2 |
| 3 | 83.9 | 44.0 | 35.0 | 84.5 | 49.5 | 177 | 34.4 |
| 4 | 83.3 | 44.0 | 35.0 | 84.0 | 49.0 | 176 | 34.3 |
| 5 | 79.5 | 44.0 | 35.0 | 83.4 | 48.4 | 172 | 31.1 |
| 6 | 81.3 | 44.0 | 35.0 | 82.9 | 47.9 | 173 | 33.4 |
| 7 | 81.3 | 44.0 | 35.0 | 82.4 | 47.4 | 173 | 33.9 |
| 8 | 81.2 | 44.0 | 35.0 | 81.8 | 46.8 | 172 | 34.4 |
| 9 | 82.0 | 44.0 | 35.0 | 81.3 | 46.3 | 172 | 35.7 |
| 10 | 81.5 | 44.0 | 35.0 | 80.8 | 45.8 | 171 | 35.7 |
| 11 | 80.8 | 44.0 | 35.0 | 80.2 | 45.2 | 170 | 35.6 |
| 12 | 80.5 | 44.0 | 35.0 | 79.7 | 44.7 | 169 | 35.8 |
| 13 | 80.6 | 44.0 | 35.0 | 79.2 | 44.2 | 169 | 36.4 |
| 14 | 80.0 | 44.0 | 35.0 | 78.6 | 43.6 | 168 | 36.4 |
| 15 | 83.9 | 44.0 | 35.0 | 78.1 | 43.1 | 171 | 40.8 |
| 16 | 82.7 | 44.0 | 35.0 | 77.6 | 42.6 | 169 | 40.1 |
| 17 | 81.4 | 44.0 | 35.0 | 77.0 | 42.0 | 167 | 39.4 |
| 18 | 83.0 | 44.0 | 35.0 | 76.5 | 41.5 | 168 | 41.5 |
| 19 | 80.7 | 44.0 | 35.0 | 76.0 | 41.0 | 166 | 39.7 |
| 20 | 81.0 | 44.0 | 35.0 | 75.5 | 40.5 | 165 | 40.5 |
| 21 | 73.3 | 44.0 | 35.0 | 75.0 | 40.0 | 157 | 33.3 |
| 22 | 71.4 | 44.0 | 35.0 | 74.5 | 39.5 | 155 | 31.9 |
| 23 | 70.3 | 44.0 | 35.0 | 73.9 | 38.9 | 153 | 31.4 |
| 24 | 71.0 | 44.0 | 35.0 | 73.3 | 38.3 | 153 | 32.7 |
| 25 | 71.4 | 44.0 | 35.0 | 72.7 | 37.7 | 153 | 33.7 |
| 26 | 70.5 | 44.0 | 35.0 | 72.2 | 37.2 | 152 | 33.3 |
| 27 | 69.7 | 44.0 | 35.0 | 71.5 | 36.5 | 150 | 33.2 |
| 28 | 72.3 | 44.0 | 35.0 | 70.9 | 35.9 | 152 | 36.4 |
| 29 | 70.3 | 44.0 | 35.0 | 70.3 | 35.3 | 150 | 35.0 |
| 30 | 68.2 | 44.0 | 35.0 | 69.7 | 34.7 | 147 | 33.5 |
| 31 | 68.8 | 44.0 | 35.0 | 69.1 | 34.1 | 147 | 34.7 |
| 32 | 68.5 | 44.0 | 35.0 | 68.5 | 33.5 | 146 | 35.0 |
| 33 | 70.6 | 44.0 | 35.0 | 67.9 | 32.9 | 147 | 37.7 |
| 34 | 69.1 | 44.0 | 35.0 | 67.3 | 32.3 | 145 | 36.8 |
| 35 | 68.2 | 44.0 | 35.0 | 66.8 | 31.8 | 144 | 36.4 |
| 36 | 64.5 | 44.0 | 35.0 | 66.3 | 31.3 | 140 | 33.2 |
| 37 | 66.7 | 44.0 | 35.0 | 65.9 | 30.9 | 142 | 35.8 |
| 38 | 63.7 | 44.0 | 35.0 | 65.4 | 30.4 | 138 | 33.3 |
| 39 | 65.8 | 44.0 | 35.0 | 65.0 | 30.0 | 140 | 35.8 |
| 40 | 62.7 | 44.0 | 35.0 | 64.6 | 29.6 | 136 | 33.1 |
| 41 | 61.7 | 44.0 | 35.0 | 64.2 | 29.2 | 135 | 32.5 |
| 42 | 62.7 | 44.0 | 35.0 | 63.7 | 28.7 | 135 | 34.0 |
| 43 | 61.0 | 44.0 | 35.0 | 63.3 | 28.3 | 133 | 32.7 |
| 44 | 61.4 | 44.0 | 35.0 | 62.9 | 27.9 | 133 | 33.5 |
| 45 | 63.0 | 44.0 | 35.0 | 62.5 | 27.5 | 135 | 35.5 |
| 46 | 62.1 | 44.0 | 35.0 | 62.1 | 27.1 | 133 | 35.0 |
| 47 | 62.6 | 44.0 | 35.0 | 61.7 | 26.7 | 133 | 35.9 |
| 48 | 58.4 | 44.0 | 35.0 | 61.3 | 26.3 | 129 | 32.1 |
| 49 | 60.2 | 44.0 | 35.0 | 61.0 | 26.0 | 130 | 34.2 |
| 50 | 58.4 | 44.0 | 35.0 | 60.6 | 25.6 | 128 | 32.8 |
| 51 | 59.3 | 44.0 | 35.0 | 60.3 | 25.3 | 129 | 34.0 |
| 52 | 52.0 | 44.0 | 35.0 | 60.0 | 25.0 | 131 | 37.0 |
| 53 | 60.6 | 44.0 | 35.0 | 59.7 | 24.7 | 129 | 35.9 |
| 54 | 62.1 | 44.0 | 35.0 | 59.4 | 24.4 | 130 | 37.7 |
| 55 | 60.9 | 44.0 | 35.0 | 59.1 | 24.1 | 129 | 36.8 |
| 56 | 61.5 | 44.0 | 35.0 | 58.8 | 23.8 | 129 | 37.7 |
| 57 | 55.5 | 44.0 | 35.0 | 58.5 | 23.5 | 123 | 32.0 |

TABLE IV-continued

Top = Surveyed
BWspec = Specified
Front = SmoothTop − BWspec
Total = Top + Key + Front
BW = Top − Front
Key = Estimated
SmoothTop = Hypothetical Top (smoothed)

| Note | Top | Key | BWspec | SmoothTop | Front | Total | BW |
|---|---|---|---|---|---|---|---|
| 58 | 56.0 | 44.0 | 35.0 | 58.2 | 23.2 | 123 | 32.8 |
| 59 | 56.5 | 44.0 | 35.0 | 57.9 | 22.9 | 123 | 33.6 |
| 60 | 57.0 | 44.0 | 35.0 | 57.5 | 22.5 | 124 | 34.5 |
| 61 | 56.5 | 44.0 | 35.0 | 57.2 | 22.2 | 123 | 34.3 |
| 62 | 56.3 | 44.0 | 35.0 | 56.8 | 21.8 | 122 | 34.5 |
| 63 | 57.1 | 44.0 | 35.0 | 56.4 | 21.4 | 123 | 35.7 |
| 64 | 57.6 | 44.0 | 35.0 | 56.0 | 21.0 | 123 | 36.6 |
| 65 | 57.0 | 44.0 | 35.0 | 55.6 | 20.6 | 122 | 36.4 |
| 66 | 56.9 | 44.0 | 35.0 | 55.1 | 20.1 | 121 | 36.8 |
| 67 | 56.7 | 44.0 | 35.0 | 54.6 | 19.6 | 120 | 37.1 |
| 68 | 57.2 | 44.0 | 35.0 | 54.1 | 19.1 | 120 | 38.1 |
| 69 | 55.9 | 44.0 | 35.0 | 53.5 | 18.5 | 118 | 37.4 |
| 70 | 54.5 | 44.0 | 35.0 | 52.9 | 17.9 | 116 | 36.6 |
| 71 | 53.6 | 44.0 | 35.0 | 52.4 | 17.4 | 115 | 36.2 |
| 72 | 53.4 | 44.0 | 35.0 | 51.8 | 16.8 | 114 | 36.6 |
| 73 | 53.8 | 44.0 | 35.0 | 51.2 | 16.2 | 114 | 37.6 |
| 74 | 50.8 | 44.0 | 35.0 | 50.7 | 15.7 | 110 | 35.1 |
| 75 | 51.3 | 44.0 | 35.0 | 50.1 | 15.1 | 110 | 36.2 |
| 76 | 50.2 | 44.0 | 35.0 | 49.5 | 14.5 | 109 | 35.7 |
| 77 | 47.5 | 44.0 | 35.0 | 48.9 | 13.9 | 105 | 33.6 |
| 78 | 47.9 | 44.0 | 35.0 | 48.4 | 13.4 | 105 | 34.5 |
| 79 | 47.2 | 44.0 | 35.0 | 47.8 | 12.8 | 104 | 34.4 |
| 80 | 47.0 | 44.0 | 35.0 | 47.2 | 12.2 | 103 | 34.8 |
| 81 | 46.4 | 44.0 | 35.0 | 46.6 | 11.6 | 102 | 34.8 |
| 82 | 46.8 | 44.0 | 35.0 | 46.0 | 11.0 | 102 | 35.8 |
| 83 | 44.5 | 44.0 | 35.0 | 45.4 | 10.4 | 99 | 34.1 |
| 84 | 42.1 | 44.0 | 35.0 | 44.8 | 9.8 | 96 | 32.3 |
| 85 | 43.0 | 44.0 | 35.0 | 44.2 | 9.2 | 96 | 33.8 |
| 86 | 42.8 | 44.0 | 35.0 | 43.6 | 8.6 | 95 | 34.2 |
| 87 | 42.5 | 44.0 | 35.0 | 42.9 | 7.9 | 94 | 34.6 |
| 88 | 42.5 | 44.0 | 35.0 | 42.3 | 7.3 | 94 | 35.2 |

The method of the invention represented by FIG. 10, which relates to Table V, is a preferred embodiment of the invention and constitutes a simplified version of the method represented by FIG. 9. In FIG. 10 and in Table V, the SmoothTop values are calculated from only a small sampling of top action balance weight values. In so doing, SmoothTop values which closely match those derived from the method of FIG. 9 are yielded but with only a fraction of the time and labor required in surveying the real top action balance weight values. In the example given, a close approximation of the true average trend of top action balance weights is found by extrapolating surveyed top action balance weight values from every 10th note, as an example. Thus, 88 keys can be balanced by measuring only ten notes. Seventy-eight keys are balanced without having measured the touch weight. This time saving causes the method represented by FIG. 10 to be of great value in the manufacture of pianos and similarly constructed instruments while maintaining high production output.

The methodology of the method represented by FIG. 10 is effectively the same as the methodology of the method represented by FIG. 9 except that the calculations in the method of FIG. 10 are based on only a small number of surveyed keys. This method is effectively used for the key balancing in the production of grand piano actions as is represented in FIG. 10 and Table V. In a first step, the top action balance weight as seen in the Top column is surveyed with M representing missing values. These values are derived from upweight, downweight and front weight values measured in the keys just prior to key balancing. The key weights of the Key column are estimated and the specified balance weights taken from the BWspec column are from specifications. The smoothed top action balance weight is derived by any statistical method which finds the average trend of the Top column and these values are placed in the SmoothTop column. This SmoothTop value is derived from the minimum number of top values which will yield an acceptable approximation of the true average trend of the top action balance weight. In this case, every tenth note has been surveyed. Note that the SmoothTop column derived in this manner is nearly identical to the SmoothTop column derived from the 88 data points actually measured in the method of FIG. 9. Front weights are derived and placed in the Front column by a calculation involving subtraction of the BWspec value from the SmoothTop value to yield the front weight. Each key is balanced to front weight specifications derived in this step. Note that the progression of yielded front weight values from key to key is smooth as represented in FIG. 10 and Table V. Inertial weight is indicated by the Total colum of Table V and is derived by adding top weight, front weight and key weight. Once more, the total weight values derived may be checked to determine if the values fall within acceptable ranges of inertial weight and if not, the process of developing key balancing specifications may be aborted and appropriate corrective measures taken. Finally, the values in the balance weight column designated BW are derived with M being equal to the missing values. The average trend of the yielded balance weight should approximate the specified balance weight. These quality control checks improve the utility of the invention in manufacturing situations.

TABLE V

Top = Surveyed
M = Missing
SmoothTop = Hypothetical Top (smoothed)
Front = SmoothTop − BWspec
Total = Top + Key + Front
BW = Top − Front
Key = Estimated
BWspec = Specified

| Note | Top | Key | BWspec | SmoothTop | Front | Total | BW |
|---|---|---|---|---|---|---|---|
| 1 | 87.3 | 44.0 | 35.0 | 87.3 | 52.3 | 184 | 35.0 |
| 2 | M | 44.0 | 35.0 | 86.7 | 51.7 | M | M |
| 3 | M | 44.0 | 35.0 | 86.0 | 51.0 | M | M |
| 4 | M | 44.0 | 35.0 | 85.4 | 50.4 | M | M |
| 5 | M | 44.0 | 35.0 | 84.7 | 49.7 | M | M |
| 6 | M | 44.0 | 35.0 | 84.0 | 49.0 | M | M |
| 7 | M | 44.0 | 35.0 | 83.4 | 48.4 | M | M |
| 8 | M | 44.0 | 35.0 | 82.7 | 47.7 | M | M |
| 9 | M | 44.0 | 35.0 | 82.1 | 47.1 | M | M |
| 10 | 81.5 | 44.0 | 35.0 | 81.4 | 46.4 | 172 | 35.1 |
| 11 | M | 44.0 | 35.0 | 80.8 | 45.8 | M | M |
| 12 | M | 44.0 | 35.0 | 80.1 | 45.1 | M | M |
| 13 | M | 44.0 | 35.0 | 79.5 | 44.5 | M | M |
| 14 | M | 44.0 | 35.0 | 78.8 | 43.8 | M | M |
| 15 | M | 44.0 | 35.0 | 78.2 | 43.2 | M | M |
| 16 | M | 44.0 | 35.0 | 77.5 | 42.5 | M | M |
| 17 | M | 44.0 | 35.0 | 76.9 | 41.9 | M | M |
| 18 | M | 44.0 | 35.0 | 76.2 | 41.2 | M | M |
| 19 | M | 44.0 | 35.0 | 75.5 | 40.5 | M | M |
| 20 | 81.0 | 44.0 | 35.0 | 74.8 | 39.8 | 165 | 41.2 |
| 21 | M | 44.0 | 35.0 | 74.2 | 39.2 | M | M |
| 22 | M | 44.0 | 35.0 | 73.5 | 38.5 | M | M |
| 23 | M | 44.0 | 35.0 | 72.8 | 37.8 | M | M |
| 24 | M | 44.0 | 35.0 | 72.1 | 37.1 | M | M |
| 25 | M | 44.0 | 35.0 | 71.4 | 36.4 | M | M |
| 26 | M | 44.0 | 35.0 | 70.8 | 35.8 | M | M |
| 27 | M | 44.0 | 35.0 | 70.1 | 35.1 | M | M |
| 28 | M | 44.0 | 35.0 | 69.5 | 34.5 | M | M |
| 29 | M | 44.0 | 35.0 | 68.8 | 33.8 | M | M |
| 30 | 68.2 | 44.0 | 35.0 | 68.2 | 33.2 | 145 | 35.0 |
| 31 | M | 44.0 | 35.0 | 67.6 | 32.6 | M | M |
| 32 | M | 44.0 | 35.0 | 67.0 | 32.0 | M | M |
| 33 | M | 44.0 | 35.0 | 66.5 | 31.5 | M | M |
| 34 | M | 44.0 | 35.0 | 65.9 | 30.9 | M | M |
| 35 | M | 44.0 | 35.0 | 65.4 | 30.4 | M | M |
| 36 | M | 44.0 | 35.0 | 64.9 | 29.9 | M | M |

TABLE V-continued

Top = Surveyed
M = Missing
SmoothTop = Hypothetical Top (smoothed)
Front = SmoothTop − BWspec
Total = Top + Key + Front
BW = Top − Front
Key = Estimated
BWspec = Specified

| Note | Top | Key | BWspec | SmoothTop | Front | Total | BW |
|---|---|---|---|---|---|---|---|
| 37 | M | 44.0 | 35.0 | 64.4 | 29.4 | M | M |
| 38 | M | 44.0 | 35.0 | 63.9 | 28.9 | M | M |
| 39 | M | 44.0 | 35.0 | 63.4 | 28.4 | M | M |
| 40 | 62.7 | 44.0 | 35.0 | 63.0 | 28.0 | 135 | 34.7 |
| 41 | M | 44.0 | 35.0 | 62.5 | 27.5 | M | M |
| 42 | M | 44.0 | 35.0 | 62.1 | 27.1 | M | M |
| 43 | M | 44.0 | 35.0 | 61.7 | 26.7 | M | M |
| 44 | M | 44.0 | 35.0 | 61.3 | 26.3 | M | M |
| 45 | M | 44.0 | 35.0 | 61.0 | 26.0 | M | M |
| 46 | M | 44.0 | 35.0 | 60.6 | 25.6 | M | M |
| 47 | M | 44.0 | 35.1 | 60.3 | 25.3 | M | M |
| 48 | M | 44.0 | 35.0 | 60.0 | 25.0 | M | M |
| 49 | M | 44.0 | 35.0 | 59.7 | 24.7 | M | M |
| 50 | 58.4 | 44.0 | 35.0 | 59.5 | 24.5 | 127 | 33.9 |
| 51 | M | 44.0 | 35.0 | 59.2 | 24.2 | M | M |
| 52 | M | 44.0 | 35.0 | 59.0 | 24.0 | M | M |
| 53 | M | 44.0 | 35.0 | 58.8 | 23.8 | M | M |
| 54 | M | 44.0 | 35.0 | 58.6 | 23.6 | M | M |
| 55 | M | 44.0 | 35.0 | 58.4 | 23.4 | M | M |
| 56 | M | 44.0 | 35.0 | 58.2 | 23.2 | M | M |
| 57 | M | 44.0 | 35.0 | 57.9 | 22.9 | M | M |
| 58 | M | 44.0 | 35.0 | 57.6 | 22.6 | M | M |
| 59 | M | 44.0 | 35.0 | 57.3 | 22.3 | M | M |
| 60 | 57.0 | 44.0 | 35.0 | 57.0 | 22.0 | 123 | 35.0 |
| 61 | M | 44.0 | 35.0 | 56.6 | 21.6 | M | M |
| 62 | M | 44.0 | 35.0 | 56.2 | 21.2 | M | M |
| 63 | M | 44.0 | 35.0 | 55.7 | 20.7 | M | M |
| 64 | M | 44.0 | 35.0 | 55.2 | 20.2 | M | M |
| 65 | M | 44.0 | 35.0 | 54.7 | 19.7 | M | M |
| 66 | M | 44.0 | 35.0 | 54.2 | 19.2 | M | M |
| 67 | M | 44.0 | 35.0 | 53.6 | 18.6 | M | M |
| 68 | M | 44.0 | 35.0 | 53.1 | 18.1 | M | M |
| 69 | M | 44.0 | 35.0 | 52.5 | 17.5 | M | M |
| 70 | 54.5 | 44.0 | 35.0 | 52.0 | 17.0 | 115 | 37.5 |
| 71 | M | 44.0 | 35.0 | 51.5 | 16.5 | M | M |
| 72 | M | 44.0 | 35.0 | 50.9 | 15.9 | M | M |
| 73 | M | 44.0 | 35.0 | 50.4 | 15.4 | M | M |
| 74 | M | 44.0 | 35.0 | 49.9 | 14.9 | M | M |
| 75 | M | 44.0 | 35.0 | 49.4 | 14.4 | M | M |
| 76 | M | 44.0 | 35.0 | 48.8 | 13.8 | M | M |
| 77 | M | 44.0 | 35.0 | 48.3 | 13.3 | M | M |
| 78 | M | 44.0 | 35.0 | 47.8 | 12.8 | M | M |
| 79 | M | 44.0 | 35.0 | 47.3 | 12.3 | M | M |
| 80 | 47.0 | 44.0 | 35.0 | 46.8 | 11.8 | 103 | 35.2 |
| 81 | M | 44.0 | 35.0 | 46.3 | 11.3 | M | M |
| 82 | M | 44.0 | 35.0 | 45.8 | 10.8 | M | M |
| 83 | M | 44.0 | 35.0 | 45.2 | 10.2 | M | M |
| 84 | M | 44.0 | 35.0 | 44.7 | 9.7 | M | M |
| 85 | M | 44.0 | 35.0 | 44.2 | 9.2 | M | M |
| 86 | M | 44.0 | 35.0 | 43.7 | 8.7 | M | M |
| 87 | M | 44.0 | 35.0 | 43.2 | 8.2 | M | M |
| 88 | 42.5 | 44.0 | 35.0 | 42.6 | 7.6 | 94 | 34.9 |

For making specified balance weight and uniform inertial weight as seen in the method of FIG. 11 and in associated Table VI, a first step is to survey top action weights in the Top column. These values are derived from upweight, downweight and front weight values measured in the keys just prior to key balancing. The keyweights represented by the Key column are estimated and the specified balance weights in the BWspec column are specified. The smoothed top action balance weights are derived and are found in the column of Table VI designated SmoothTop3. SmoothTop3 equals the SmoothTop designation plus a backlead factor where SmoothTop equals the smoothed values of Top as derived by ony of any statistical methods which find the average trend of the column designated Top and the backlead factor equals the minimum whole number which causes SmoothTop3 minus Top to yield little or no negative numbers. In this case, backlead factor equals 3. Front weight is then derived by subtracting BWspec from SmoothTop3 to yield the front weight values designated in the Front column of Table VI. Each key is balanced to front weight specifications derived in this step. The backlead weight is derived by subtracting top action weight (in the Top column) for SmoothTop3 values. Any negative backlead values are changed to zero. The inertial weight or Total weight is taken to be the sum of Top, Front, Backlead, and Key values. The values derived must fall within acceptable ranges of inertial weight. If not, the process of developing key balancing specifications is aborted and appropriate corrective measures are taken. The balance weight or BW is the sum of Top plus Backlead minus Front. The yielded balance weight should then match the specified balance weight.

TABLE VI

Top = Surveyed
BWspec = Specified
Front = SmoothTop3 − BWspec
Backlead = SmoothTop3 − Top
Backlead = SmoothTop3
Total = Top + Backlead + Key + Front
BW = Top + Backlead − Front Key = Estimated
SmoothTop3 = Hypothetical Top (smoothed)
M = Missing

| Note | Top | Key | BWspec | SmoothTop3 | Front | Backlead | Total | BW |
|---|---|---|---|---|---|---|---|---|
| 1 | 87.3 | 44.0 | 35.0 | 88.5 | 53.5 | 1.2 | 186 | 35.0 |
| 2 | 82.2 | 44.0 | 35.0 | 88.0 | 53.0 | 5.8 | 185 | 35.0 |
| 3 | 83.9 | 44.0 | 35.0 | 87.5 | 52.5 | 3.6 | 184 | 35.0 |
| 4 | 83.3 | 44.0 | 35.0 | 87.0 | 52.0 | 3.7 | 183 | 35.0 |
| 5 | 79.5 | 44.0 | 35.0 | 86.4 | 51.4 | 6.9 | 182 | 35.0 |
| 6 | 81.3 | 44.0 | 35.0 | 85.9 | 50.9 | 4.6 | 181 | 35.0 |
| 7 | 81.3 | 44.0 | 35.0 | 85.4 | 50.4 | 4.1 | 180 | 35.0 |
| 8 | 81.2 | 44.0 | 35.0 | 84.8 | 49.8 | 3.6 | 179 | 35.0 |
| 9 | 82.0 | 44.0 | 35.0 | 84.3 | 49.3 | 2.3 | 178 | 35.0 |
| 10 | 81.5 | 44.0 | 35.0 | 83.8 | 48.8 | 2.3 | 177 | 35.0 |
| 11 | 80.8 | 44.0 | 35.0 | 83.2 | 48.2 | 2.4 | 175 | 35.0 |
| 12 | 80.5 | 44.0 | 35.0 | 82.7 | 47.7 | 2.2 | 174 | 35.0 |
| 13 | 80.6 | 44.0 | 35.0 | 82.2 | 47.2 | 1.6 | 173 | 35.0 |
| 14 | 80.0 | 44.0 | 35.0 | 81.6 | 46.6 | 1.6 | 172 | 35.0 |
| 15 | 83.9 | 44.0 | 35.0 | 81.1 | 46.1 | M | 174 | 37.8 |
| 16 | 82.7 | 44.0 | 35.0 | 80.6 | 45.6 | M | 172 | 37.1 |
| 17 | 81.4 | 44.0 | 35.0 | 80.0 | 45.0 | M | 170 | 36.4 |
| 18 | 83.0 | 44.0 | 35.0 | 79.5 | 44.5 | M | 171 | 38.5 |
| 19 | 80.7 | 44.0 | 35.0 | 79.0 | 44.0 | M | 169 | 36.7 |
| 20 | 81.0 | 44.0 | 35.0 | 78.5 | 43.5 | M | 168 | 37.5 |
| 21 | 73.3 | 44.0 | 35.0 | 78.0 | 43.0 | 4.7 | 165 | 35.0 |
| 22 | 71.4 | 44.0 | 35.0 | 77.5 | 42.5 | 6.1 | 164 | 35.0 |
| 23 | 70.3 | 44.0 | 35.0 | 76.9 | 41.9 | 6.6 | 163 | 35.0 |
| 24 | 71.0 | 44.0 | 35.0 | 76.3 | 41.3 | 5.3 | 162 | 35.0 |
| 25 | 71.4 | 44.0 | 35.0 | 75.7 | 40.7 | 4.3 | 160 | 35.0 |
| 26 | 70.5 | 44.0 | 35.0 | 75.2 | 40.2 | 4.7 | 159 | 35.0 |
| 27 | 69.7 | 44.0 | 35.0 | 74.5 | 39.5 | 4.8 | 158 | 35.0 |
| 28 | 72.3 | 44.0 | 35.0 | 73.9 | 38.9 | 1.6 | 157 | 35.0 |
| 29 | 70.3 | 44.0 | 35.0 | 73.3 | 38.3 | 3.0 | 156 | 35.0 |
| 30 | 68.2 | 44.0 | 35.0 | 72.7 | 37.7 | 4.5 | 154 | 35.0 |
| 31 | 68.8 | 44.0 | 35.0 | 72.1 | 37.1 | 3.3 | 153 | 35.0 |
| 32 | 68.5 | 44.0 | 35.0 | 71.5 | 36.5 | 3.0 | 152 | 35.0 |
| 33 | 70.6 | 44.0 | 35.0 | 70.9 | 35.9 | 0.3 | 151 | 35.0 |
| 34 | 69.1 | 44.0 | 35.0 | 70.3 | 35.3 | 1.2 | 150 | 35.0 |
| 35 | 68.2 | 44.0 | 35.0 | 69.8 | 34.8 | 1.6 | 149 | 35.0 |
| 36 | 64.5 | 44.0 | 35.0 | 69.3 | 34.3 | 4.8 | 148 | 35.0 |
| 37 | 66.7 | 44.0 | 35.0 | 68.9 | 33.9 | 2.2 | 147 | 35.0 |
| 38 | 63.7 | 44.0 | 35.0 | 68.4 | 33.4 | 4.7 | 146 | 35.0 |
| 39 | 65.8 | 44.0 | 35.0 | 68.0 | 33.0 | 2.2 | 145 | 35.0 |
| 40 | 62.7 | 44.0 | 35.0 | 67.6 | 32.6 | 4.9 | 144 | 35.0 |
| 41 | 61.7 | 44.0 | 35.0 | 67.2 | 32.2 | 5.5 | 143 | 35.0 |
| 42 | 62.7 | 44.0 | 35.0 | 66.7 | 31.7 | 4.0 | 142 | 35.0 |
| 43 | 61.0 | 44.0 | 35.0 | 66.3 | 31.3 | 5.3 | 142 | 35.0 |
| 44 | 61.4 | 44.0 | 35.0 | 65.9 | 30.9 | 4.5 | 141 | 35.0 |
| 45 | 63.0 | 44.0 | 35.0 | 65.5 | 30.5 | 2.5 | 140 | 35.0 |
| 46 | 62.1 | 44.0 | 35.0 | 65.1 | 30.1 | 3.0 | 139 | 35.0 |
| 47 | 62.6 | 44.0 | 35.0 | 64.7 | 29.7 | 2.1 | 138 | 35.0 |
| 48 | 58.4 | 44.0 | 35.0 | 64.3 | 29.3 | 5.9 | 138 | 35.0 |
| 49 | 60.2 | 44.0 | 35.0 | 64.0 | 29.0 | 3.8 | 137 | 35.0 |
| 50 | 58.4 | 44.0 | 35.0 | 63.6 | 28.6 | 5.2 | 136 | 35.0 |
| 51 | 59.3 | 44.0 | 35.0 | 63.3 | 28.3 | 4.0 | 136 | 35.0 |
| 52 | 62.0 | 44.0 | 35.0 | 63.0 | 28.0 | 1.0 | 135 | 35.0 |
| 53 | 60.6 | 44.0 | 35.0 | 62.7 | 27.7 | 2.1 | 134 | 35.0 |
| 54 | 62.1 | 44.0 | 35.0 | 62.4 | 27.4 | 0.3 | 134 | 35.0 |
| 55 | 60.9 | 44.0 | 35.0 | 62.1 | 27.1 | 1.2 | 133 | 35.0 |
| 56 | 61.5 | 44.0 | 35.0 | 61.8 | 26.8 | 0.3 | 133 | 35.0 |
| 57 | 55.5 | 44.0 | 35.0 | 61.5 | 26.5 | 6.0 | 132 | 35.0 |
| 58 | 56.0 | 44.0 | 35.0 | 61.2 | 26.2 | 5.2 | 131 | 35.0 |
| 59 | 56.5 | 44.0 | 35.0 | 60.9 | 25.9 | 4.4 | 131 | 35.0 |

TABLE VI-continued

Top = Surveyed
BWspec = Specified
Front = SmoothTop3 − BWspec
Backlead = SmoothTop3 − Top
Backlead = SmoothTop3
Total = Top + Backlead + Key + Front
BW = Top + Backlead − Front Key = Estimated
SmoothTop3 = Hypothetical Top (smoothed)
M = Missing

| Note | Top | Key | BWspec | SmoothTop3 | Front | Backlead | Total | BW |
|---|---|---|---|---|---|---|---|---|
| 60 | 57.0 | 44.0 | 35.0 | 60.5 | 25.5 | 3.5 | 130 | 35.0 |
| 61 | 56.5 | 44.0 | 35.0 | 60.2 | 25.2 | 3.7 | 129 | 35.0 |
| 62 | 56.3 | 44.0 | 35.0 | 59.8 | 24.8 | 3.5 | 129 | 35.0 |
| 63 | 57.1 | 44.0 | 35.0 | 59.4 | 24.4 | 2.3 | 128 | 35.0 |
| 64 | 57.6 | 44.0 | 35.0 | 59.0 | 24.0 | 1.4 | 127 | 35.0 |
| 65 | 57.0 | 44.0 | 35.0 | 58.6 | 23.6 | 1.6 | 126 | 35.0 |
| 66 | 56.9 | 44.0 | 35.0 | 58.1 | 23.1 | 1.2 | 125 | 35.0 |
| 67 | 56.7 | 44.0 | 35.0 | 57.6 | 22.6 | 0.9 | 124 | 35.0 |
| 68 | 57.2 | 44.0 | 35.0 | 57.1 | 22.1 | M | 123 | 35.1 |
| 69 | 55.9 | 44.0 | 35.0 | 56.5 | 21.5 | 0.6 | 122 | 35.0 |
| 70 | 54.5 | 44.0 | 35.0 | 55.9 | 20.9 | 1.4 | 121 | 35.0 |
| 71 | 53.6 | 44.0 | 35.0 | 55.4 | 20.4 | 1.8 | 120 | 35.0 |
| 72 | 53.4 | 44.0 | 35.0 | 54.8 | 19.8 | 1.4 | 119 | 35.0 |
| 73 | 53.8 | 44.0 | 35.0 | 54.2 | 19.2 | 0.4 | 117 | 35.0 |
| 74 | 50.8 | 44.0 | 35.0 | 53.7 | 18.7 | 2.9 | 116 | 35.0 |
| 75 | 51.3 | 44.0 | 35.0 | 53.1 | 18.1 | 1.8 | 115 | 35.0 |
| 76 | 50.2 | 44.0 | 35.0 | 52.5 | 17.5 | 2.3 | 114 | 35.0 |
| 77 | 47.5 | 44.0 | 35.0 | 51.9 | 16.9 | 4.4 | 113 | 35.0 |
| 78 | 47.9 | 44.0 | 35.0 | 51.4 | 16.4 | 3.5 | 112 | 35.0 |
| 79 | 47.2 | 44.0 | 35.0 | 50.8 | 15.8 | 3.6 | 111 | 35.0 |
| 80 | 47.0 | 44.0 | 35.0 | 50.2 | 15.2 | 3.2 | 109 | 35.0 |
| 81 | 46.4 | 44.0 | 35.0 | 49.6 | 14.6 | 3.2 | 108 | 35.0 |
| 82 | 46.8 | 44.0 | 35.0 | 49.0 | 14.0 | 2.2 | 107 | 35.0 |
| 83 | 44.5 | 44.0 | 35.0 | 48.4 | 13.4 | 3.9 | 106 | 35.0 |
| 84 | 42.1 | 44.0 | 35.0 | 47.8 | 12.8 | 5.7 | 105 | 35.0 |
| 85 | 43.0 | 44.0 | 35.0 | 47.2 | 12.2 | 4.2 | 103 | 35.0 |
| 86 | 42.8 | 44.0 | 35.0 | 46.6 | 11.6 | 3.8 | 102 | 35.0 |
| 87 | 42.5 | 44.0 | 35.0 | 45.9 | 10.9 | 3.4 | 101 | 35.0 |
| 88 | 42.5 | 44.0 | 35.0 | 45.3 | 10.3 | 2.8 | 100 | 35.0 |

Referring now to the method of FIG. 12 which is a method for making specified inertial weight at an average specified balance weight. This method is used when inertial weight yielded with the methods of FIGS. 8, 9 and 10 are below specified levels as seen in FIG. 12 when related to the values of Table VII. The top action weights listed in the column Top of Table VII are surveyed, these values being derived from upweight, downweight and front weight values measured in the keys just prior to key balancing. The key weights of the Key column are estimated and the inertial weight specification noted in the column designated Totalspec from specifications. Specified inertial weight ranges from 180 grams to 95 grams in a straight taper in the case shown in FIG. 12. The Total specification can be either straight or curved depending on the quality of touch desired in a completed action. The specified balance weights from specifications are seen in the column BWspec. The values in the column designated SmoothTop1 with the SmoothTop1 values being equal to Totalspec plus BWspec minus key weight with the resulting value being divided by two. Front weight, noted in the column Front is derived by subtracting the BWspec value from the SmoothTop1 value. The smoothed top action balance weight or SmoothTop2 column is derived from any statistical method which finds the average trend of the Top values in the column so designated in Table VII. Backlead weight is derived by subtracting SmoothTop2 from SmoothTop1, these values being shown in the column designated Backlead in Table VII. The inertial weights found in the column designated Total are the sum of the respective values of Top, Front, Backlead and Key. It is then confirmed that the yielded Total matches Totalspec. The balance weight or value thus found in the column BW is then equal to the sum of the Top and Backlead values minus the Front value. It is then confirmed that the average trend of the yielded balance weight approximates the specified balance weight.

TABLE VII

Top = Surveyed
Totalspec = Specified
SmoothTop1 = (Totalspec + BWspec − Key)/2
Front = SmoothTop1 − BWspec
SMoothTop2 = Hypothetical Top (Smoothed)
Backlead = SmoothTop1 − SmoothTop2
Total = Top + Backlead + Front + Key
BW = Top + Backlead − Front Key = Estimated
BWspec = Specified

| Note | Top | Key | Totalspec | BWspec | SmoothTop1 | Front | SmoothTop2 | Backlead | Total | BW |
|---|---|---|---|---|---|---|---|---|---|---|
| 1 | 79.3 | 44.0 | 180 | 35.0 | 85.5 | 50.5 | 80.3 | 5.2 | 179 | 34.0 |
| 2 | 81.4 | 44.0 | 179 | 35.0 | 85.0 | 50.0 | 79.7 | 5.3 | 181 | 36.7 |

TABLE VII-continued

Top = Surveyed
Totalspec = Specified
SmoothTop1 = (Totalspec + BWspec − Key)/2
Front = SmoothTop1 − BWspec
SMoothTop2 = Hypothetical Top (Smoothed)
Backlead = SmoothTop1 − SmoothTop2
Total = Top + Backlead + Front + Key
BW = Top + Backlead − Front Key = Estimated
BWspec = Specified

| Note | Top | Key | Totalspec | BWspec | SmoothTop1 | Front | SmoothTop2 | Backlead | Total | BW |
|---|---|---|---|---|---|---|---|---|---|---|
| 3 | 77.0 | 44.0 | 178 | 35.0 | 84.5 | 49.5 | 79.1 | 5.5 | 176 | 32.9 |
| 4 | 76.4 | 44.0 | 177 | 35.0 | 84.0 | 49.0 | 78.5 | 5.6 | 175 | 32.9 |
| 5 | 78.3 | 44.0 | 176 | 35.0 | 83.5 | 48.5 | 77.9 | 5.7 | 177 | 35.4 |
| 6 | 74.6 | 44.0 | 175 | 35.0 | 83.1 | 48., | 77.3 | 5.8 | 172 | 32.3 |
| 7 | 79.3 | 44.0 | 174 | 35.0 | 82.6 | 47.6 | 76.7 | 5.9 | 177 | 37.6 |
| 8 | 72.8 | 44.0 | 173 | 35.0 | 82.1 | 47.1 | 76.1 | 6.0 | 170 | 31.7 |
| 9 | 74.4 | 44.0 | 172 | 35.0 | 81.6 | 46.6 | 75.5 | 6.1 | 171 | 33.9 |
| 10 | 77.3 | 44.0 | 171 | 35.0 | 81.1 | 46.1 | 74.9 | 6.3 | 174 | 37.4 |
| 11 | 74.6 | 44.0 | 170 | 35.0 | 80.6 | 45.6 | 74.2 | 6.4 | 171 | 35.4 |
| 12 | 75.1 | 44.0 | 169 | 35.0 | 80.1 | 45.1 | 73.6 | 6.5 | 171 | 36.5 |
| 13 | 71.9 | 44.0 | 168 | 35.0 | 79.6 | 44.6 | 73.0 | 6.6 | 167 | 33.9 |
| 14 | 76.8 | 44.0 | 167 | 35.0 | 79.1 | 44.1 | 72.4 | 6.8 | 172 | 39.4 |
| 15 | 70.4 | 44.0 | 166 | 35.0 | 78.7 | 43.7 | 71.8 | 6.9 | 165 | 33.6 |
| 16 | 72.0 | 44.0 | 165 | 35.0 | 78.2 | 43.2 | 71.2 | 7.0 | 166 | 35.8 |
| 17 | 74.1 | 44.0 | 164 | 35.0 | 77.7 | 42.7 | 70.5 | 7.1 | 168 | 38.6 |
| 18 | 71.7 | 44.0 | 163 | 35.0 | 77.2 | 42.2 | 69.9 | 7.3 | 165 | 36.8 |
| 19 | 73.5 | 44.0 | 162 | 35.0 | 76.7 | 41.7 | 69.3 | 7.4 | 167 | 39.2 |
| 20 | 68.1 | 44.0 | 161 | 35.0 | 76.2 | 41.2 | 68.7 | 7.5 | 161 | 34.4 |
| 21 | 66.8 | 44.0 | 160 | 35.0 | 75.7 | 40.7 | 68.1 | 7.7 | 159 | 33.7 |
| 22 | 73.6 | 44.0 | 159 | 35.0 | 75.2 | 40.2 | 67.5 | 7.8 | 166 | 41.1 |
| 23 | 66.5 | 44.0 | 159 | 35.0 | 74.8 | 39.8 | 66.8 | 7.9 | 158 | 34.7 |
| 24 | 72.6 | 44.0 | 158 | 35.0 | 74.3 | 39.3 | 66.2 | 8.1 | 164 | 41.4 |
| 25 | 66.4 | 44.0 | 157 | 35.0 | 73.8 | 38.8 | 65.5 | 8.3 | 157 | 35.9 |
| 26 | 70.3 | 44.0 | 156 | 35.0 | 73.3 | 38.3 | 64.9 | 8.4 | 161 | 40.4 |
| 27 | 57.6 | 44.0 | 155 | 35.0 | 72.8 | 37.8 | 64.2 | 8.6 | 148 | 28.4 |
| 28 | 60.3 | 44.0 | 154 | 35.0 | 72.3 | 37.3 | 63.5 | 8.8 | 150 | 31.8 |
| 29 | 63.2 | 44.0 | 153 | 35.0 | 71.8 | 36.8 | 62.9 | 9.0 | 153 | 35.3 |
| 30 | 59.2 | 44.0 | 152 | 35.0 | 71.3 | 36.3 | 62.2 | 9.2 | 149 | 32.0 |
| 31 | 62.1 | 44.0 | 151 | 35.0 | 70.8 | 35.8 | 61.5 | 9.3 | 151 | 35.6 |
| 32 | 59.7 | 44.0 | 150 | 35.0 | 70.4 | 35.4 | 60.8 | 9.5 | 149 | 33.9 |
| 33 | 56.2 | 44.0 | 149 | 35.0 | 69.9 | 34.9 | 60.2 | 9.7 | 145 | 31.0 |
| 34 | 59.7 | 44.0 | 148 | 35.0 | 69.4 | 34.4 | 59.5 | 9.9 | 148 | 35.2 |
| 35 | 58.1 | 44.0 | 147 | 35.0 | 68.9 | 33.9 | 58.8 | 10.0 | 146 | 34.3 |
| 36 | 58.2 | 44.0 | 146 | 35.0 | 68.4 | 33.4 | 58.2 | 10.2 | 146 | 35.0 |
| 37 | 56.5 | 44.0 | 145 | 35.0 | 67.9 | 32.9 | 57.6 | 10.3 | 144 | 33.9 |
| 38 | 58.7 | 44.0 | 144 | 35.0 | 67.4 | 32.4 | 57.0 | 10.4 | 146 | 36.7 |
| 39 | 57.7 | 44.0 | 143 | 35.0 | 66.9 | 31.9 | 56.4 | 10.5 | 144 | 36.3 |
| 40 | 54.8 | 44.0 | 142 | 35.0 | 66.4 | 31.4 | 55.8 | 10.6 | 141 | 34.0 |
| 41 | 58.0 | 44.0 | 141 | 35.0 | 66.0 | 31.0 | 55.3 | 10.7 | 144 | 37.7 |
| 42 | 53.1 | 44.0 | 140 | 35.0 | 65.5 | 30.5 | 54.7 | 10.7 | 138 | 33.4 |
| 43 | 54.0 | 44.0 | 139 | 35.0 | 65.0 | 30.0 | 54.2 | 10.8 | 139 | 34.8 |
| 44 | 53.0 | 44.0 | 138 | 35.0 | 64.5 | 29.5 | 53.7 | 10.8 | 135 | 32.3 |
| 45 | 522.0 | 44.0 | 137 | 35.0 | 64.0 | 29.0 | 53.2 | 10.8 | 136 | 33.8 |
| 46 | 53.0 | 44.0 | 136 | 35.0 | 63.5 | 28.5 | 52.7 | 10.8 | 136 | 35.3 |
| 47 | 51.3 | 44.0 | 135 | 35.0 | 63.0 | 28.0 | 52.2 | 10.8 | 134 | 34.1 |
| 48 | 50.5 | 44.0 | 131 | 35.0 | 62.5 | 27.5 | 51.7 | 10.8 | 133 | 33.8 |
| 49 | 49.4 | 44.0 | 133 | 35.0 | 62.1 | 27.1 | 51.3 | 10.8 | 131 | 33.1 |
| 50 | 50.5 | 44.0 | 132 | 35.0 | 61.6 | 26.6 | 50.9 | 10.7 | 132 | 34.6 |
| 51 | 51.2 | 44.0 | 131 | 35.0 | 61.1 | 26.1 | 50.4 | 10.6 | 132 | 35.8 |
| 52 | 49.3 | 44.0 | 130 | 35.0 | 60.6 | 25.6 | 50.1 | 10.5 | 129 | 34.2 |
| 53 | 51.4 | 44.0 | 129 | 35.0 | 60.1 | 25.1 | 49.7 | 10.4 | 131 | 36.7 |
| 54 | 49.2 | 44.0 | 128 | 35.0 | 59.6 | 24.6 | 49.4 | 10.3 | 128 | 34.8 |
| 55 | 49.6 | 44.0 | 127 | 35.0 | 59.1 | 24.1 | 49.1 | 10.1 | 128 | 35.5 |
| 56 | 47.1 | 44.0 | 126 | 35.0 | 58.6 | 23.6 | 48.8 | 9.9 | 125 | 33.3 |
| 57 | 47.4 | 44.0 | 125 | 35.0 | 58.1 | 23.1 | 48.5 | 9.6 | 124 | 33.9 |
| 58 | 46.0 | 44.0 | 124 | 35.0 | 57.7 | 22.7 | 48.3 | 9.4 | 122 | 32.7 |
| 59 | 44.3 | 44.0 | 123 | 35.0 | 57.2 | 22.2 | 48.1 | 9.1 | 120 | 31.2 |
| 60 | 46.8 | 44.0 | 122 | 35.0 | 56.7 | 21.7 | 47.9 | 8.8 | 121 | 33.9 |
| 61 | 46.6 | 44.0 | 121 | 35.0 | 56.2 | 21.2 | 47.7 | 8.5 | 120 | 33.9 |
| 62 | 45.2 | 44.0 | 120 | 35.0 | 55.7 | 20.7 | 47.5 | 8.2 | 118 | 32.7 |
| 63 | 43.0 | 44.0 | 119 | 35.0 | 55.2 | 20.2 | 47.3 | 7.9 | 115 | 30.7 |
| 64 | 43.7 | 44.0 | 118 | 35.0 | 54.7 | 19.7 | 47.1 | 7.6 | 115 | 31.6 |
| 65 | 47.5 | 44.0 | 117 | 35.0 | 54.2 | 19.2 | 47.0 | 7.3 | 118 | 35.5 |
| 66 | 46.3 | 44.0 | 116 | 35.0 | 53.7 | 18.7 | 46.8 | 7.0 | 116 | 34.5 |
| 67 | 49.4 | 44.0 | 116 | 35.0 | 53.3 | 18.3 | 46.6 | 6.6 | 118 | 37.8 |
| 68 | 46.0 | 44.0 | 115 | 35.0 | 52.8 | 17.8 | 46.5 | 6.3 | 114 | 34.5 |
| 69 | 45.5 | 44.0 | 114 | 35.0 | 52.3 | 17.3 | 46.3 | 5.9 | 113 | 34.2 |
| 70 | 49.4 | 44.0 | 113 | 35.0 | 51.8 | 16.8 | 46.2 | 5.6 | 116 | 38.2 |
| 71 | 47.1 | 44.0 | 112 | 35.0 | 51.3 | 16.3 | 46.0 | 5.3 | 113 | 36.1 |

TABLE VII-continued

Top = Surveyed
Totalspec = Specified
SmoothTop1 = (Totalspec + BWspec − Key)/2
Front = SmoothTop1 − BWspec
SMoothTop2 = Hypothetical Top (Smoothed)
Backlead = SmoothTop1 − SmoothTop2
Total = Top + Backlead + Front + Key
BW = Top + Backlead − Front
Key = Estimated
BWspec = Specified

| Note | Top | Key | Totalspec | BWspec | SmoothTop1 | Front | SmoothTop2 | Backlead | Total | BW |
|---|---|---|---|---|---|---|---|---|---|---|
| 72 | 49.2 | 44.0 | 111 | 35.0 | 50.8 | 15.8 | 45.9 | 4.9 | 114 | 38.3 |
| 73 | 46.6 | 44.0 | 110 | 35.0 | 50.3 | 15.3 | 45.8 | 4.6 | 111 | 35.8 |
| 74 | 49.0 | 44.0 | 109 | 35.0 | 49.8 | 14.8 | 45.6 | 4.2 | 112 | 38.4 |
| 75 | 45.4 | 44.0 | 108 | 35.0 | 49.4 | 14.4 | 45.5 | 3.9 | 108 | 34.9 |
| 76 | 45.1 | 44.0 | 107 | 35.0 | 48.9 | 13.9 | 45.3 | 3.5 | 107 | 34.8 |
| 77 | 44.5 | 44.0 | 106 | 35.0 | 48.4 | 13.4 | 45.2 | 3.2 | 105 | 34.3 |
| 78 | 43.7 | 44.0 | 105 | 35.0 | 47.9 | 12.9 | 45.0 | 2.9 | 103 | 33.7 |
| 79 | 48.5 | 44.0 | 104 | 35.0 | 47.4 | 12.4 | 44.9 | 2.5 | 107 | 38.6 |
| 80 | 44.0 | 44.0 | 103 | 35.0 | 46.9 | 11.9 | 44.7 | 2.2 | 102 | 34.3 |
| 81 | 45.0 | 44.0 | 102 | 35.0 | 46.4 | 11.4 | 44.6 | 1.8 | 102 | 35.4 |
| 82 | 46.4 | 44.0 | 101 | 35.0 | 45.9 | 10.9 | 44.4 | 1.5 | 103 | 37.0 |
| 83 | 43.5 | 44.0 | 100 | 35.0 | 45.4 | 10.4 | 44.3 | 1.1 | 99 | 34.2 |
| 84 | 44.4 | 44.0 | 99 | 35.0 | 45.0 | 10.0 | 44.1 | 0.8 | 99 | 35.3 |
| 85 | 41.2 | 44.0 | 98 | 35.0 | 44.5 | 9.5 | 44.0 | 0.5 | 95 | 32.2 |
| 86 | 43.9 | 44.0 | 97 | 35.0 | 44.0 | 9.0 | 43.8 | 0.1 | 97 | 35.1 |
| 87 | 43.6 | 44.0 | 96 | 35.0 | 43.5 | 8.5 | 43.7 | M | 96 | 35.1 |
| 88 | 41.6 | 44.0 | 95 | 35.0 | 43.0 | 8.0 | 43.5 | M | 94 | 33.6 |

The method related to FIG. 13 and to Table VIII is essentially the same as the method related to FIG. 12 and Table VII except that the calculations are based on a small number of sampled keys. This methodology is preferred for production key balancing of upright piano actions. The top action balance weights are surveyed and noted in the column designated Top, these values being derived from upweight, downweight and front weight values measured prior to key balancing. The key weights designated in the Key column are estimated and the inertial weight specifications noted in the column designated Totalspec are taken from specifications. In this situation, specified inertial weight ranges from 180 grams to 95 grams in a straight taper. The Total specification can be either straight or curved depending on the quality of touch desired in the completed action. The specified balance weight is taken from specifications and noted in the column designated BWspec in Table VIII. Values for SmoothTop1 are derived as one-half the values of Totalspec plus BWspec minus Key. The front weight shown in the column designated Front are derived from subtracting BWspec values from SmoothTop1 values. The column of Table VIII designated SmoothTop2 are equivalent to smoothed top action balance weights and are derived by any statistical method which finds the average trend of the column designated Top. This smoothtop value is derived from the minimum number of Top values which yield and acceptable approximation of the true average trend of the top action balance weight. In this case, every tenth note is surveyed. Note that the SmoothTop column derived in this fashion is essentially identical to the SmoothTop column derived from 88 data points as is shown in the method of FIG. 12 as related to Table VII. Backlead weight, designated in the column Backlead, is taken to be the SmoothTop1 value minus the SmoothTop2 value. Inertial weight shown in the column designated Total of Table VIII is taken to be the sum of Top, Backlead, Front and Key. It is confirmed that the yielded Total matches Totalspec. Balance weight is then derived by the sum of Top plus Backlead minus Front and is provided in the column designated BW in Table VIII. It is confirmed that the average trend of the yielded balance weight approximates the specified balance weight.

In creating heavier inertial weight, the method of FIG. 13 has a particularly useful application in upright piano actions which normally have extremely low inertial weight as compared to the inertial weight of grand piano actions. Using the method of FIG. 13, the inertial weight can be made substantially higher by adding weight to both sides of a key in order to simulate the inertial feeling of a grand piano. The calculation of key balancing parameters can be accomplished with a small number of samples, thereby causing this method to be of great practicality for manufacturing applications.

TABLE VIII

Top = Surveyed
Key = Estimated
Totalspec = Specified
BWspec = Specified
SmoothTop1 = (Totalspec + BWspec − Key)/2
M = Missing
Front = SmoothTop1 − BWspec
SmoothTop2 = Hypothetical Top (Smoothed)
Backlead = SmoothTop1 − SmoothTop2
Total = Top + Backlead + Front + Key
BW = Top + Backlead − Front

| Note | Top | Key | Totalspec | BWspec | SmoothTop1 | Front | SmoothTop2 | Backlead | Total | BW |
|---|---|---|---|---|---|---|---|---|---|---|
| 1 | 79.3 | 44.0 | 180 | 35.0 | 85.5 | 50.5 | 80.2 | 5.3 | 179 | 34.1 |
| 2 | M | 44.0 | 179 | 35.0 | 85.0 | 50.0 | 79.6 | 5.4 | M | 9 |
| 3 | M | 44.0 | 178 | 35.0 | 84.5 | 49.5 | 78.9 | 5.6 | M | M |
| 4 | M | 44.0 | 177 | 35.0 | 84.0 | 49.0 | 78.3 | 5.8 | M | M |
| 5 | M | 44.0 | 176 | 35.0 | 83.5 | 48.5 | 77.6 | 5.9 | M | M |
| 6 | M | 44.0 | 175 | 35.0 | 83.1 | 48.1 | 77.0 | 6.1 | M | M |

TABLE VIII-continued

Top = Surveyed M = Missing Front = SmoothTop1 − BWspec
Key = Estimated SmoothTop2 = Hypothetical Top (Smoothed)
Totalspec = Specified Backlead = SmoothTop1 − SmoothTop2
BWspec = Specified Total = Top + Backlead + Front + Key
SmoothTop1 = (Totalspec + BWspec − Key)/2 BW = Top + Backlead − Front

| Note | Top | Key | Totalspec | BWspec | SmoothTop1 | Front | SmoothTop2 | Backlead | Total | BW |
|---|---|---|---|---|---|---|---|---|---|---|
| 7 | M | 44.0 | 174 | 35.0 | 82.6 | 47.6 | 76.3 | 6.2 | M | M |
| 8 | M | 44.0 | 173 | 35.0 | 82.1 | 47.1 | 75.7 | 6.4 | M | M |
| 9 | M | 44.0 | 172 | 35.0 | 81.6 | 46.6 | 75.1 | 6.5 | M | M |
| 10 | 77.3 | 44.0 | 171 | 35.0 | 81.1 | 46.1 | 74.4 | 6.7 | 174 | 37.9 |
| 11 | M | 44.0 | 170 | 35.0 | 80.6 | 45.6 | 73.8 | 6.8 | M | M |
| 12 | M | 44.0 | 169 | 35.0 | 80.1 | 45.1 | 73.2 | 6.9 | M | M |
| 13 | M | 44.0 | 168 | 35.0 | 79.6 | 44.6 | 72.6 | 7.0 | M | M |
| 14 | M | 44.0 | 167 | 35.0 | 79.1 | 44.1 | 72.0 | 7.1 | M | M |
| 15 | M | 44.0 | 166 | 35.0 | 78.7 | 43.7 | 71.4 | 7.2 | M | M |
| 16 | M | 44.0 | 165 | 35.0 | 78.2 | 43.2 | 70.8 | 7.4 | M | M |
| 17 | M | 44.0 | 164 | 35.0 | 77.7 | 42.7 | 70.2 | 7.5 | M | M |
| 18 | M | 44.0 | 163 | 35.0 | 77.2 | 42.2 | 69.5 | 7.7 | M | M |
| 19 | M | 44.0 | 162 | 35.0 | 76.7 | 41.7 | 68.8 | 7.9 | M | M |
| 20 | 68.1 | 44.0 | 161 | 35.0 | 76.2 | 41.2 | 68.1 | 8.1 | 161 | 35.0 |
| 21 | M | 44.0 | 160 | 35.0 | 75.7 | 40.7 | 67.4 | 8.3 | M | M |
| 22 | M | 44.0 | 159 | 35.0 | 75.2 | 40.2 | 66.7 | 8.6 | M | M |
| 23 | M | 44.0 | 159 | 35.0 | 74.8 | 39.8 | 65.9 | 8.8 | M | M |
| 24 | M | 44.0 | 158 | 35.0 | 74.3 | 39.3 | 65.1 | 9.1 | M | M |
| 25 | M | 44.0 | 157 | 35.0 | 73.8 | 38.8 | 64.4 | 9.4 | M | M |
| 26 | M | 44.0 | 156 | 35.0 | 73.3 | 38.3 | 63.6 | 9.7 | M | M |
| 27 | M | 44.0 | 155 | 35.0 | 72.8 | 37.8 | 62.8 | 10.0 | M | M |
| 28 | M | 44.0 | 154 | 35.0 | 72.3 | 37.3 | 62.1 | 10.3 | M | M |
| 29 | M | 44.0 | 153 | 35.0 | 71.8 | 36.8 | 61.3 | 10.5 | M | M |
| 30 | 59.2 | 44.0 | 152 | 35.0 | 71.3 | 36.3 | 60.6 | 10.7 | 150 | 33.6 |
| 31 | M | 44.0 | 151 | 35.0 | 70.8 | 35.8 | 59.9 | 10.9 | M | M |
| 32 | M | 44.0 | 150 | 35.0 | 70.4 | 35.4 | 59.3 | 11.1 | M | M |
| 33 | M | 44.0 | 149 | 35.0 | 69.9 | 34.9 | 58.6 | 11.2 | M | M |
| 34 | M | 44.0 | 148 | 35.0 | 69.4 | 34.4 | 58.0 | 11.3 | M | M |
| 35 | M | 44.0 | 147 | 35.0 | 68.9 | 33.9 | 57.5 | 11.4 | M | M |
| 36 | M | 44.0 | 146 | 35.0 | 68.4 | 33.4 | 56.9 | 11.5 | M | M |
| 37 | M | 44.0 | 145 | 35.0 | 67.9 | 32.9 | 56.4 | 11.6 | M | M |
| 38 | M | 44.0 | 144 | 35.0 | 67.4 | 32.4 | 55.8 | 11.6 | M | M |
| 39 | M | 44.0 | 143 | 35.0 | 66.9 | 31.9 | 55.3 | 11.6 | M | M |
| 40 | 54.8 | 44.0 | 142 | 35.0 | 66.4 | 31.4 | 54.8 | 11.6 | 142 | 35.0 |
| 41 | M | 44.0 | 141 | 35.0 | 66.0 | 31.0 | 54.3 | 11.6 | M | M |
| 42 | M | 44.0 | 140 | 35.0 | 65.5 | 30.5 | 53.9 | 11.6 | M | M |
| 43 | M | 44.0 | 139 | 35.0 | 65.0 | 30.0 | 53.4 | 11.6 | M | M |
| 44 | M | 44.0 | 138 | 35.0 | 64.5 | 29.5 | 52.9 | 11.6 | M | M |
| 45 | M | 44.0 | 137 | 35.0 | 64.0 | 29.0 | 52.5 | 11.5 | M | M |
| 46 | M | 44.0 | 136 | 35.0 | 63.5 | 28.5 | 52.1 | 11.4 | M | M |
| 47 | M | 44.0 | 135 | 35.0 | 63.0 | 28.0 | 51.7 | 11.3 | M | M |
| 48 | M | 44.0 | 134 | 35.0 | 62.5 | 27.5 | 51.3 | 11.2 | M | M |
| 49 | M | 44.0 | 133 | 35.0 | 62.1 | 27.1 | 51.0 | 11.1 | M | M |
| 50 | 50.5 | 44.0 | 132 | 35.0 | 61.6 | 26.6 | 50.7 | 10.9 | 132 | 34.8 |
| 51 | M | 44.0 | 131 | 35.0 | 61.1 | 26.1 | 50.4 | 10.7 | M | M |
| 52 | M | 44.0 | 130 | 35.0 | 60.6 | 25.6 | 50.1 | 10.5 | M | M |
| 53 | M | 44.0 | 129 | 35.0 | 60.1 | 25.1 | 49.8 | 10.3 | M | M |
| 54 | M | 44.0 | 128 | 35.0 | 59.6 | 24.6 | 49.6 | 10.0 | M | M |
| 55 | M | 44.0 | 127 | 35.0 | 59.1 | 24.1 | 49.4 | 9.7 | M | 4 |
| 56 | M | 44.0 | 126 | 35.0 | 58.6 | 23.6 | 49.2 | 9.4 | M | M |
| 57 | M | 44.0 | 125 | 35.0 | 58.1 | 23.1 | 49.0 | 9.1 | M | M |
| 58 | M | 44.0 | 124 | 35.0 | 57.7 | 22.7 | 48.8 | 8.8 | M | M |
| 59 | M | 44.0 | 123 | 35.0 | 57.2 | 22.2 | 48.6 | 8.5 | M | M |
| 60 | 46.8 | 44.0 | 122 | 35.0 | 56.7 | 21.7 | 48.5 | 8.2 | 121 | 33.3 |
| 61 | M | 44.0 | 121 | 35.0 | 56.2 | 21.2 | 48.3 | 7.9 | M | M |
| 62 | M | 44.0 | 120 | 35.0 | 55.7 | 20.7 | 48.1 | 7.6 | M | M |
| 63 | M | 44.0 | 119 | 35.0 | 55.2 | 20.2 | 47.9 | 7.3 | M | M |
| 64 | M | 44.0 | 118 | 35.0 | 54.7 | 19.7 | 47.7 | 7.0 | M | M |
| 65 | M | 44.0 | 117 | 35.0 | 54.2 | 19.2 | 47.5 | 6.7 | M | M |
| 66 | M | 44.0 | 116 | 35.0 | 53.7 | 18.7 | 47.3 | 6.5 | M | M |
| 67 | M | 44.0 | 116 | 35.0 | 53.3 | 18.3 | 47.1 | 6.2 | M | M |
| 68 | M | 44.0 | 115 | 35.0 | 52.8 | 17.8 | 46.9 | 5.9 | M | M |
| 69 | M | 44.0 | 114 | 35.0 | 52.3 | 17.3 | 46.7 | 5.6 | M | M |
| 70 | 49.4 | 44.0 | 113 | 35.0 | 51.8 | 16.8 | 46.4 | 5.3 | 116 | 38.0 |
| 71 | M | 44.0 | 112 | 35.0 | 51.3 | 16.3 | 46.2 | 5.1 | M | M |
| 72 | M | 44.0 | 111 | 35.0 | 50.8 | 15.8 | 46.0 | 4.8 | M | M |
| 73 | M | 44.0 | 110 | 35.0 | 50.3 | 15.3 | 45.8 | 4.6 | M | M |
| 74 | M | 44.0 | 109 | 35.0 | 49.8 | 14.8 | 45.5 | 4.3 | M | M |
| 75 | M | 44.0 | 108 | 35.0 | 49.4 | 14.4 | 45.3 | 4.0 | M | M |
| 76 | M | 44.0 | 107 | 35.0 | 48.9 | 13.9 | 45.1 | 3.8 | M | M |
| 77 | M | 44.0 | 106 | 35.0 | 48.4 | 13.4 | 44.8 | 3.6 | M | M |
| 78 | M | 44.0 | 105 | 35.0 | 47.9 | 12.9 | 44.6 | 3.3 | M | M |

TABLE VIII-continued

Top = Surveyed M = Missing Front = SmoothTop1 − BWspec
Key = Estimated SmoothTop2 = Hypothetical Top (Smoothed)
Totalspec = Specified Backlead = SmoothTop1 − SmoothTop2
BWspec = Specified Total = Top + Backlead + Front + Key
SmoothTop1 = (Totalspec + BWspec − Key)/2 BW = Top + Backlead − Front

| Note | Top | Key | Totalspec | BWspec | SmoothTop1 | Front | SmoothTop2 | Backlead | Total | BW |
|---|---|---|---|---|---|---|---|---|---|---|
| 79 | M | 44.0 | 104 | 35.0 | 47.4 | 12.4 | 44.3 | 3.1 | M | M |
| 80 | 44.0 | 44.0 | 103 | 35.0 | 46.9 | 11.9 | 44.0 | 2.9 | 103 | 35.0 |
| 81 | M | 44.0 | 102 | 35.0 | 46.4 | 11.4 | 43.8 | 2.6 | M | M |
| 82 | M | 44.0 | 101 | 35.0 | 45.9 | 10.9 | 43.5 | 2.4 | M | M |
| 83 | M | 44.0 | 100 | 3S.0 | 45.4 | 10.4 | 43.2 | 2.2 | M | M |
| 84 | M | 44.0 | 99 | 35.0 | 45.0 | 10.0 | 42.9 | 2.0 | M | M |
| 85 | M | 44.0 | 98 | 35.0 | 44.5 | 9.5 | 42.7 | 1.8 | M | M |
| 86 | M | 44.0 | 97 | 35.0 | 44.0 | 9.0 | 42.4 | 1.6 | M | M |
| 87 | M | 44.0 | 96 | 35.0 | 43.5 | 8.5 | 42.1 | 1.4 | M | M |
| 88 | 41.6 | 44.0 | 95 | 35.0 | 43.0 | 8.0 | 41.8 | 1.2 | 95 | 34.8 |

The method of FIG. 14 relates to Table IX and involves specified inertial weight and balance weight, the method being used when inertial weights fall below specified levels as seen in FIG. 14 and Table IX. Top action balance weights are surveyed and are seen in the column designated Top. These values are derived from upweight, downweight and front weight values measured in the keys just prior to key balancing. The key weights of the column designated Key are estimated and the inertial weight specifications derived from specifications are seen in the column designated Totalspec. The specified inertial weight ranges from 180 grams to 95 grams in the situation shown in FIG. 14 and in Table IX. The Total specification can be either straight or curved depending on the quality of touch desired in a completed action. Specified balance weights are taken from specifications and are seen in the column designated BWspec of Table IX. Smoothed top action balance weights are derived from one-half the value of Totalspec plus BWspec minus Key and are seen in the column designated SMoothTop. The front weights seen as the Front values in the appropriate column of Table IX are derived from subtracting BWspec from SmoothTop. Each key is balanced to front weight specifications derived in this step. Note that the progression of yielded front weight values from key to key is uniform. Backlead weights are derived from the subtraction of Top values from SmoothTop values and are seen in the column designated Backlead of Table IX. Any negative backlead values are changed to zero. Inertial weights are given in the column designated Total in Table IX and are the summation of the values for Top, Backlead, Front and Key. The yielded total is confirmed when these values match Totalspec. Balance weights given in the column designated BW of Table IX are taken to be the sum of Top plus Backlead minus Front. The yielded balance weights will match BWspec values.

TABLE IX

Top = Surveyed
Key = Estimated
Totalspec = Specified
Bwspec = Specified
SmoothTop = (Totalspec + BWspec − Key)/2
Front = SmoothTop − BWspec
Backlead = SmoothTop − Top
Front2 = Front − Backlead
Total = Top + Backlead + Front + Key
BW = Top + Baclead − Front

| Note | Top | Key | Totalspec | BWspec | SmoothTop | Front | Backlead | Total | BW |
|---|---|---|---|---|---|---|---|---|---|
| 1 | 79.3 | 44.0 | 180 | 35.0 | 85.5 | 50.5 | 6.2 | 180 | 35.0 |
| 2 | 81.4 | 44.0 | 179 | 35.0 | 85.0 | 50.0 | 3.6 | 179 | 35.0 |
| 3 | 77.0 | 44.0 | 178 | 35.0 | 84.5 | 49.5 | 7.5 | 178 | 35.0 |
| 4 | 76.4 | 44.0 | 177 | 35.0 | 84.0 | 49.0 | 7.6 | 177 | 35.0 |
| 5 | 78.3 | 44.0 | 176 | 35.0 | 83.5 | 48.5 | 5.2 | 176 | 35.0 |
| 6 | 74.6 | 44.0 | 175 | 35.0 | 83.1 | 48.1 | 8.5 | 175 | 35.0 |
| 7 | 79.3 | 44.0 | 174 | 35.0 | 82.6 | 47.6 | 3.3 | 174 | 35.0 |
| 8 | 72.8 | 44.0 | IT3 | 35.0 | 82.1 | 47.1 | 9.3 | 173 | 35.0 |
| 9 | 74.4 | 44.0 | 172 | 35.0 | 81.6 | 46.6 | 7.2 | 172 | 35.0 |
| 10 | 77.3 | 44.0 | 171 | 35.0 | 81.1 | 46.1 | 3.8 | 171 | 35.0 |
| 11 | 74.6 | 44.0 | 170 | 35.0 | 80.6 | 45.6 | 6.0 | 170 | 35.0 |
| 12 | 75.1 | 44.0 | 169 | 35.0 | 80.1 | 45.1 | 5.0 | 169 | 35.0 |
| 13 | 71.9 | 44.0 | 168 | 35.0 | 79.6 | 44.6 | 7.7 | 168 | 35.0 |
| 14 | 76.8 | 44.0 | 167 | 35.0 | 79.1 | 44.1 | 2.3 | 167 | 35.0 |
| 15 | 70.4 | 44.0 | 166 | 35.0 | 78.7 | 43.7 | 8.3 | 166 | 35.0 |
| 16 | 72.0 | 44.0 | 165 | 35.0 | 78.2 | 43.2 | 6.2 | 165 | 35.0 |
| 17 | 74.1 | 44.0 | 164 | 35.0 | 77.7 | 42.7 | 3.6 | 164 | 35.0 |
| 18 | 71.7 | 44.0 | 163 | 35.0 | 77.2 | 42.2 | 5.5 | 163 | 35.0 |
| 19 | 73.5 | 44.0 | 162 | 35.0 | 76.7 | 41.7 | 3.2 | 162 | 35.0 |
| 20 | 68.1 | 44.0 | 161 | 35.0 | 76.2 | 41.2 | 8.1 | 161 | 35.0 |
| 21 | 66.8 | 44.0 | 160 | 35.0 | 75.7 | 40.7 | 8.9 | 160 | 35.0 |

TABLE IX-continued

Top = Surveyed
Key = Estimated
Totalspec = Specified
Bwspec = Specified
SmoothTop = (Totalspec + BWspec − Key)/2
Front = SmoothTop − BWspec
Backlead = SmoothTop − Top
Front2 = Front − Backlead
Total = Top + Backlead + Front + Key
BW = Top + Baclead − Front

| Note | Top | Key | Totalspec | BWspec | SmoothTop | Front | Backlead | Total | BW |
|---|---|---|---|---|---|---|---|---|---|
| 22 | 73.6 | 44.0 | 159 | 35.0 | 75.2 | 40.2 | 1.6 | 159 | 35.0 |
| 23 | 66.5 | 44.0 | 159 | 35.0 | 74.8 | 39.8 | 8.3 | 159 | 35.0 |
| 24 | 72.6 | 44.0 | 158 | 35.0 | 74.3 | 39.3 | 1.7 | 158 | 35.0 |
| 25 | 66.4 | 44.0 | 157 | 35.0 | 73.8 | 38.8 | 7.4 | 157 | 35.0 |
| 26 | 70.3 | 44.0 | 156 | 35.0 | 73.3 | 38.3 | 3.0 | 156 | 35.0 |
| 27 | 57.6 | 44.0 | 155 | 35.0 | 72.8 | 37.8 | 15.2 | 155 | 35.0 |
| 28 | 60.3 | 44.0 | 154 | 35.0 | 72.3 | 37.3 | 12.0 | 154 | 35.0 |
| 29 | 63.2 | 44.0 | 153 | 35.0 | 71.8 | 36.8 | 8.6 | 153 | 35.0 |
| 30 | 59.2 | 44.0 | 152 | 35.0 | 71.3 | 36.3 | 12.1 | 152 | 35.0 |
| 31 | 62.1 | 44.0 | 151 | 35.0 | 70.8 | 35.a | 8.7 | 151 | 35.0 |
| 32 | 59.7 | 44.0 | 150 | 35.0 | 70.4 | 35.4 | 10.7 | 150 | 35.3 |
| 33 | 56.2 | 44.0 | 149 | 35.0 | 69.9 | 34.9 | 13.7 | 149 | 35.0 |
| 34 | 59.7 | 44.0 | 148 | 35.0 | 69.4 | 34.4 | 9.7 | 148 | 35.0 |
| 35 | 58.1 | 44.0 | 147 | 35.0 | 68.9 | 33.9 | 10.8 | 147 | 35.0 |
| 36 | 58.2 | 44.0 | 146 | 35.0 | 68.4 | 33.4 | 10.2 | 146 | 35.0 |
| 37 | 56.5 | 44.0 | 145 | 35.0 | 67.9 | 32.9 | 11.4 | 145 | 35.0 |
| 38 | 58.7 | 44.0 | 144 | 35.0 | 67.4 | 32.4 | 8.7 | 144 | 35.0 |
| 39 | 57.7 | 44.0 | 143 | 35.0 | 66.9 | 31.9 | 9.2 | 143 | 35-0 |
| 40 | 54.8 | 44.0 | 142 | 35.0 | 66.4 | 31.4 | 11.6 | 142 | 35.0 |
| 41 | 58.0 | 44.0 | 141 | 35.0 | 66.0 | 31.0 | 8.0 | 141 | 35.0 |
| 42 | 53.1 | 44.0 | 140 | 35.0 | 65.5 | 30.5 | 12.4 | 140 | 35.0 |
| 43 | 50.0 | 44.0 | 139 | 35.0 | 65.0 | 30.0 | 11.0 | 139 | 35.0 |
| 44 | 51.0 | 44.0 | 138 | 35.0 | 64.5 | 29.5 | 13.5 | 138 | 35.0 |
| 45 | 52.0 | 44.0 | 137 | 35.0 | 64.0 | 29.0 | 12.0 | 137 | 35.0 |
| 46 | 53.0 | 44.0 | 136 | 35.0 | 63.5 | 28.5 | 10.5 | 136 | 35.0 |
| 47 | 51.3 | 44.0 | 135 | 35.0 | 63.0 | 28.0 | 11.7 | 135 | 35.0 |
| 48 | 50.5 | 44.0 | 134 | 35.0 | 62.5 | 27.5 | 12.0 | 134 | 35.0 |
| 49 | 49.4 | 44.0 | 133 | 35.0 | 62.1 | 27.1 | 12.7 | 133 | 35.0 |
| 50 | 50.5 | 44.0 | 132 | 35.0 | 61.6 | 26.6 | 11.1 | 132 | 35.0 |
| 51 | 51.2 | 44.0 | 131 | 35.0 | 61.1 | 26.1 | 9.9 | 131 | 35.0 |
| 52 | 49.3 | 44.0 | 130 | 35:0 | 60.6 | 25.6 | 11.3 | 130 | 35.0 |
| 53 | 51.4 | 44.0 | 129 | 35.0 | 60.1 | 25.1 | 8.7 | 129 | 35.0 |
| 54 | 49.2 | 44.0 | 128 | 35.0 | 59.6 | 24.6 | 10.4 | 128 | 35.0 |
| 55 | 49.6 | 44.0 | 127 | 35.0 | 59.1 | 24.1 | 9.5 | 127 | 35.0 |
| 56 | 47.1 | 44.0 | 126 | 35.0 | 58.6 | 23.6 | 11.5 | 126 | 35.0 |
| 57 | 47.4 | 44.0 | 125 | 35.0 | 58.1 | 23.1 | 10.7 | 125 | 35.0 |
| 58 | 46.0 | 44.0 | 124 | 35.0 | 57.7 | 22.7 | 11.7 | 124 | 35.0 |
| 59 | 44.3 | 44.0 | 123 | 35.0 | 57.2 | 22.2 | 12.9 | 123 | 35.0 |
| 60 | 46.8 | 44.0 | 122 | 35.0 | 56.7 | 21.7 | 9.9 | 122 | 35.0 |
| 61 | 46.6 | 44.0 | 121 | 35.0 | 56.2 | 21.2 | 9.6 | 121 | 35.0 |
| 62 | 45.2 | 44.0 | 120 | 35.0 | 55.7 | 20.7 | 10.5 | 120 | 35.0 |
| 63 | 43.0 | 44.0 | 119 | 35.0 | 55.2 | 20.2 | 12.2 | 119 | 35.0 |
| 64 | 43.7 | 44.0 | 118 | 35.0 | 54.7 | 19.7 | 11.0 | 118 | 35.0 |
| 65 | 47.5 | 44.0 | 117 | 35.0 | 54.2 | 19.2 | 6.7 | 117 | 35.0 |
| 66 | 46.3 | 44.0 | 116 | 35.0 | 53.7 | 18.7 | 7.4 | 116 | 35.0 |
| 67 | 49.4 | 44.0 | 116 | 35.0 | 53.3 | 18.3 | 3.9 | 116 | 35.0 |
| 68 | 46.0 | 44.0 | 115 | 35.0 | 52.8 | 17.8 | 6.8 | 115 | 35.0 |
| 69 | 45.5 | 44.0 | 114 | 35.0 | 52.3 | 17.3 | 6.8 | 114 | 35.0 |
| 70 | 49.4 | 44.0 | 113 | 35.0 | 51.8 | 16.8 | 2.4 | 113 | 35.0 |
| 71 | 47.1 | 44.0 | 112 | 35.0 | 51.3 | 16.3 | 4.2 | 112 | 35.0 |
| 72 | 49.2 | 44.0 | 111 | 35.0 | 50.8 | 15.8 | 1.6 | 111 | 35.0 |
| 73 | 46.6 | 44.0 | 110 | 35.0 | 50.3 | 15.3 | 3.7 | 110 | 35.0 |
| 74 | 49.0 | 44.0 | 109 | 35.0 | 49.8 | 14.8 | 0.8 | 109 | 35.0 |
| 75 | 45.4 | 44.0 | 108 | 35.0 | 49.4 | 14.4 | 4.0 | 108 | 35.0 |
| 76 | 45.1 | 44.0 | 107 | 35.0 | 48.9 | 13.9 | 3.8 | 107 | 35.0 |
| 77 | 44.5 | 44.0 | 106 | 35.0 | 48.4 | 13.4 | 3.9 | 106 | 35.0 |
| 78 | 43.7 | 44.0 | 105 | 35.0 | 47.9 | 12.9 | 4.2 | 105 | 35.0 |
| 79 | 48.5 | 44.0 | 104 | 35.0 | 47.4 | 12.4 | M | 105 | 36.1 |
| 80 | 44.0 | 44.0 | 103 | 35.0 | 46.9 | 11.9 | 2.9 | 103 | 35.0 |
| 81 | 45.0 | 44.0 | 102 | 35.0 | 46.4 | 11.4 | 1.4 | 102 | 35.0 |
| 82 | 46.4 | 44.0 | 101 | 35.0 | 45.9 | 10.9 | M | 101 | 35.5 |
| 83 | 43.5 | 44.0 | 100 | 35.0 | 45.4 | 10.4 | 1.9 | 100 | 35.0 |
| 84 | 44.4 | 44.0 | 99 | 35.0 | 45.0 | 10.0 | 0.6 | 99 | 35.0 |
| 85 | 41.2 | 44.0 | 98 | 35.0 | 44.5 | 9.5 | 3.3 | 98 | 35.0 |
| 86 | 43.9 | 44.0 | 97 | 35.0 | 44.0 | 9.0 | M | 97 | 35.0 |

TABLE IX-continued

Top = Surveyed
Key = Estimated
Totalspec = Specified
Bwspec = Specified
SmoothTop = (Totalspec + BWspec − Key)/2
Front = SmoothTop − BWspec
Backlead = SmoothTop − Top
Front2 = Front − Backlead
Total = Top + Backlead + Front + Key
BW = Top + Baclead − Front

| Note | Top | Key | Totalspec | BWspec | SmoothTop | Front | Backlead | Total | BW |
|---|---|---|---|---|---|---|---|---|---|
| 87 | 43.6 | 44.0 | 96 | 35.0 | 43.5 | 8.5 | M | 96 | 35.1 |
| 88 | 41.6 | 44.0 | 95 | 35.0 | 43.0 | 8.0 | 1.4 | 95 | 35.0 |

The method relating to FIG. 15 and to Table X is seen to involve improved inertial weight uniformity at an average specified level with specified balance weight. The method related to FIG. 15 is used when inertial weight is above specified levels. This method utilizes keyleads 116 in conjunction with wippen support springs such as the springs 122 of FIG. 1 as is seen in FIG. 15 and Table X. Top action weights are surveyed with the resulting values being placed in the column designated Top of Table X. These values are derived from upweight, downweight and front weight values measured in the keys just prior to key balancing. The key weights seen in the column designated Key are estimated and the specified inertial weights seen in the column designated Totalspec are taken from specifications. In the situation shown, specified inertial weight ranges from 165 grams to 96 grams in a curved taper. The Total specification can be either straight or curved depending on the quality of touch desired in the completed action. Smoothed top action balance weight values are derived by any statistical method which finds the average trend of the column designated Top with the derived values being seen in the column designated SmoothTop of Table X. Front weights are derived by the relationship resulting from the subtraction of SmoothTop and Key from Totalspec with these values being seen in the column designated Front. Each key is balanced to front weight specifications derived in this step. Note that the progression of yielded Front values from key to keys is smooth. Inertial weight is then derived as the sum of the values of Top, Front and Key and are seen in the column designated Total. It is confirmed that the average trend of the yielded Total approximates Totalspec. Balance weight, seen in the column designated BW is the value obtained from subtracting Front from Top.

Balance weight depression is taken to be the value BW minus BWspec where BWspec equals 35, these derived values being seen in the column designated BWD. The BWD values show the amount of "work" which the wippen support springs, such as the spring 122 in FIG. 1, must handle in order to achieve a final balance weight. The BWD value is useful in deciding the size of the wippen support spring which is to be used. Once the proper sized springs are installed, the tension of said springs is adjusted to achieve the balance weight specification.

TABLE X

Top = Surveyed
Key = Estimated
Totalspec = Estimated
SmoothTop = Hypothetical Top (smoothed)
Front = Totalspec − SmoothTop − Key
Total = Top + Key + Front
BW = Top Front
BWspec = Specified (Spring Adjusted Balance Weight)
BWD = BW − BWspec

| Note | Top | Key | Totalspec | SmoothTop | Front | Total | BW | BWspec | BWD |
|---|---|---|---|---|---|---|---|---|---|
| 1 | 85.9 | 44.0 | 165 | 87.6 | 33.1 | 163 | 52.8 | 35.0 | 18 |
| 2 | 89.2 | 44.0 | 164 | 87.4 | 32.8 | 166 | 56.4 | 35.0 | 21 |
| 3 | 86.3 | 44.0 | 164 | 87.1 | 32.5 | 163 | 53.8 | 35.0 | 19 |
| 4 | 83.5 | 44.0 | 163 | 86.8 | 32.3 | 160 | 51.2 | 35.0 | 16 |
| 5 | 87.3 | 44.0 | 163 | 86.5 | 32.0 | 163 | 55.3 | 35.0 | 20 |
| 6 | 86.0 | 44.0 | 162 | 86.3 | 31.7 | 162 | 54.3 | 35.0 | 19 |
| 7 | 90.0 | 44.0 | 161 | 86.0 | 31.4 | 165 | 58.6 | 35.0 | 24 |
| 8 | 85.1 | 44.0 | 161 | 85.7 | 31.2 | 160 | 53.9 | 35.0 | 19 |
| 9 | 83.2 | 44.0 | 160 | 85.4 | 30.9 | 158 | 52.3 | 35.0 | 17 |
| 10 | 83.6 | 44.0 | 160 | 85.1 | 30.6 | 158 | 53.0 | 35.0 | 18 |
| 11 | 84.3 | 44.0 | 159 | 84.8 | 30.3 | 159 | 54.0 | 35.0 | 19 |
| 12 | 83.6 | 44.0 | 159 | 84.5 | 30.1 | 158 | 53.5 | 35.0 | 19 |
| 13 | 85.7 | 44.0 | 158 | 84.2 | 29.8 | 160 | 55.9 | 35.0 | 21 |
| 14 | 83.0 | 44.0 | 157 | 83.9 | 29.5 | 157 | 53.5 | 35.0 | 18 |
| 15 | 85.2 | 44.0 | 157 | 83.6 | 29.3 | 158 | 55.9 | 35.0 | 21 |
| 16 | 86.4 | 44.0 | 156 | 83.3 | 29.0 | 159 | 57.4 | 35.0 | 22 |
| 17 | 83.9 | 44.0 | 156 | 83.0 | 28.7 | 157 | 55.2 | 35.0 | 20 |
| 18 | 85.2 | 44.0 | 155 | 82.7 | 28.5 | 158 | 56.7 | 35.0 | 22 |
| 19 | 85.3 | 44.0 | 155 | 82.4 | 28.2 | 158 | 57.1 | 35.0 | 22 |
| 20 | 82.1 | 44.0 | 154 | 82.1 | 28.0 | 154 | 54.1 | 35.0 | 19 |
| 21 | 81.4 | 44.0 | 154 | 81.9 | 27.7 | 153 | 53.7 | 35.0 | 19 |

TABLE X-continued

Top = Surveyed
Key = Estimated
Totalspec = Estimated
SmoothTop = Hypothetical Top (smoothed)
Front = Totalspec − SmoothTop − Key
Total = Top + Key + Front
BW = Top Front
BWspec = Specified (Spring Adjusted Balance Weight)
BWD = BW − BWspec

| Note | Top | Key | Totalspec | SmoothTop | Front | Total | BW | BWspec | BWD |
|---|---|---|---|---|---|---|---|---|---|
| 22 | 85.3 | 44.0 | 153 | 81.6 | 27.5 | 157 | 57.8 | 35.0 | 23 |
| 23 | 82.6 | 44.0 | 152 | 81.2 | 27.3 | 154 | 55.3 | 35.0 | 20 |
| 24 | 81.2 | 44.0 | 152 | 80.9 | 27.0 | 152 | 54.2 | 35.0 | 19 |
| 25 | 82.5 | 44.0 | 151 | 80.5 | 26.8 | 153 | 55.7 | 35.0 | 21 |
| 26 | 79.0 | 44.0 | 151 | 80.2 | 26.6 | 150 | 52.4 | 35.0 | 17 |
| 27 | 79.8 | 44.0 | 150 | 79.8 | 26.5 | 150 | 53.3 | 35.0 | 18 |
| 28 | 77.0 | 44.0 | 150 | 79.4 | 26.3 | 147 | 50.7 | 35.0 | 16 |
| 29 | 75.3 | 44.0 | 149 | 79.1 | 26.1 | 145 | 49.2 | 35.0 | 14 |
| 31 | 78.0 | 44.0 | 148 | 78.2 | 25.7 | 148 | 52.3 | 35.0 | 17 |
| 32 | 78.2 | 44.0 | 147 | 77.8 | 25.6 | 148 | 52.6 | 35.0 | 18 |
| 33 | 78.0 | 44.0 | 147 | 77.4 | 15.4 | 147 | 52.6 | 35.0 | 18 |
| 34 | 79.1 | 44.0 | 146 | 77.0 | 25.2 | 148 | 53.9 | 35.0 | 19 |
| 35 | 76.9 | 44.0 | 146 | 76.5 | 25.0 | 146 | 51.9 | 35.0 | 17 |
| 36 | 74.7 | 44.0 | 145 | 76.1 | 24.8 | 144 | 49.9 | 35.0 | 15 |
| 37 | 73.2 | 44.0 | 144 | 75.7 | 24.6 | 142 | 48.6 | 35.0 | 14 |
| 38 | 77.4 | 44.0 | 144 | 75.3 | 24.4 | 146 | 53.0 | 35.0 | 18 |
| 39 | 76.1 | 44.0 | 143 | 74.8 | 24.2 | 144 | 51.9 | 35.0 | 17 |
| 40 | 75.1 | 44.0 | 142 | 74.4 | 24.0 | 143 | 51.1 | 35.0 | 16 |
| 41 | 76.0 | 44.0 | 142 | 73.9 | 23.8 | 144 | 52.2 | 35.0 | 17 |
| 42 | 72.3 | 44.0 | 141 | 73.5 | 23.6 | 140 | 48.7 | 35.0 | 14 |
| 43 | 72.9 | 44.0 | 141 | 73.1 | 23.5 | 140 | 49.4 | 35.0 | 14 |
| 44 | 72.5 | 44.0 | 140 | 72.6 | 23.2 | 140 | 49.3 | 35.0 | 14 |
| 45 | 72.8 | 44.0 | 139 | 72.2 | 23.0 | 140 | 49.8 | 35.0 | 15 |
| 46 | 73.0 | 44.0 | 139 | 71.7 | 22.8 | 140 | 50.2 | 35.0 | 15 |
| 47 | 72.2 | 44.0 | 138 | 71.3 | 22.6 | 139 | 49.6 | 35.0 | 15 |
| 48 | 69.5 | 44.0 | 137 | 70.8 | 22.4 | 136 | 47.1 | 35.0 | 12 |
| 49 | 69.4 | 44.0 | 136 | 70.3 | 22.1 | 136 | 47.3 | 35.0 | 12 |
| 50 | 71.4 | 44.0 | 136 | 69.8 | 21.9 | 137 | 49.5 | 35.0 | 15 |
| 51 | 70.2 | 44.0 | 135 | 69.3 | 21.6 | 136 | 48.6 | 35.0 | 14 |
| 52 | 69.8 | 44.0 | 134 | 68.8 | 21.3 | 135 | 48.5 | 35.0 | 13 |
| 53 | 70.9 | 44.0 | 133 | 68.3 | 21.1 | 136 | 49.8 | 35.0 | 15 |
| 54 | 65.2 | 44.0 | 133 | 67.8 | 20.8 | 130 | 44.4 | 35.0 | 9 |
| 55 | 64.0 | 44.0 | 132 | 67.3 | 20.5 | 128 | 43.5 | 35.0 | 9 |
| 56 | 65.1 | 44.0 | 131 | 66.8 | 20.2 | 129 | 44.9 | 35.0 | 10 |
| 57 | 68.0 | 44.0 | 130 | 66.2 | 19.9 | 132 | 48.1 | 35.0 | 13 |
| 58 | 64.2 | 44.0 | 129 | 65.7 | 19.7 | 128 | 44.5 | 35.0 | 10 |
| 59 | 65.6 | 44.0 | 129 | 65.1 | 19.4 | 129 | 46.2 | 35.0 | 11 |
| 60 | 64.0 | 44.0 | 128 | 64.5 | 19.2 | 127 | 44.8 | 35.0 | 10 |
| 61 | 65.4 | 44.0 | 127 | 64.0 | 18.9 | 128 | 46.5 | 35.0 | 11 |
| 62 | 67.0 | 44.0 | 126 | 63.4 | 18.7 | 130 | 48.3 | 35.0 | 13 |
| 63 | 62.5 | 44.0 | 125 | 62.8 | 18.5 | 125 | 44.0 | 35.0 | 9 |
| 64 | 65.2 | 44.0 | 124 | 62.2 | 18.2 | 127 | 47.0 | 35.0 | 12 |
| 65 | 62.3 | 44.0 | 124 | 61.7 | 17.9 | 124 | 44.4 | 35.0 | 9 |
| 66 | 63.3 | 44.0 | 123 | 61.1 | 17.6 | 125 | 45.7 | 35.0 | 11 |
| 67 | 57.7 | 44.0 | 122 | 60.5 | 17.3 | 119 | 40.4 | 35.0 | 5 |
| 68 | 61.9 | 44.0 | 121 | 59.9 | 17.0 | 123 | 44.9 | 35.0 | 10 |
| 69 | 60.0 | 44.0 | 120 | 59.2 | 16.6 | 121 | 43.4 | 35.0 | 8 |
| 70 | 54.6 | 44.0 | 119 | 58.6 | 16.1 | 115 | 38.5 | 35.0 | 3 |
| 71 | 57.4 | 44.0 | 118 | 58.0 | 15.6 | 117 | 41.8 | 35.0 | 7 |
| 72 | 58.5 | 44.0 | 116 | 57.3 | 15.0 | 118 | 43.5 | 35.0 | 8 |
| 73 | 56.1 | 44.0 | 115 | 56.7 | 14.4 | 114 | 41.7 | 35.0 | 7 |
| 74 | 57.6 | 44.0 | 114 | 56.0 | 13.7 | 115 | 43.9 | 35.0 | 9 |
| 75 | 54.8 | 44.0 | 112 | 55.4 | 13.0 | 112 | 41.8 | 35.0 | 7 |
| 76 | 53.9 | 44.0 | 111 | 54.8 | 12.3 | 110 | 41.6 | 35.0 | 7 |
| 77 | 53.3 | 44.0 | 110 | 54.1 | 11.6 | 109 | 41.7 | 35.0 | 7 |
| 78 | 54.3 | 44.0 | 108 | 53.5 | 10.8 | 109 | 43.5 | 35.0 | 8 |
| 79 | 53.0 | 44.0 | 107 | 52.8 | 10.1 | 107 | 42.9 | 35.0 | 8 |
| 80 | 52.8 | 44.0 | 106 | 52.2 | 9.4 | 106 | 43.4 | 35.0 | 8 |
| 81 | 52.6 | 44.0 | 104 | 51.5 | 8.7 | 105 | 43.8 | 35.0 | 9 |
| 82 | 50.5 | 44.0 | 103 | 50.9 | 8.1 | 103 | 42.4 | 35.0 | 7 |
| 83 | 55.1 | 44.0 | 102 | 50.2 | 7.5 | 107 | 47.6 | 35.0 | 13 |
| 84 | 50.3 | 44.0 | 100 | 49.6 | 6.9 | 101 | 43.4 | 35.0 | 8 |
| 85 | 46.8 | 44.0 | 99 | 48.9 | 6.3 | 97 | 40.5 | 35.0 | 5 |
| 86 | 47.9 | 44.0 | 98 | 48.3 | 5.7 | 98 | 42.2 | 35.0 | 7 |
| 87 | 43.6 | 44.0 | 97 | 47.6 | 5.2 | 93 | 38.4 | 35.0 | 3 |
| 88 | 47.5 | 44.0 | 96 | 47.0 | 4.6 | 96 | 42.9 | 35.0 | 8 |

Referring now to the method shown in FIG. 16, it is to be noted that the method is substantially similar to the method of FIG. 15 except that the calculations are based on only a small number of surveyed keys as seen in FIG. 16 and in related Table XI. Top action balance weight values are surveyed for selected keys and are seen in the column designated Top in Table XI, the missing values being designated by the letter M. These values are derived from upweight, downweight and front weight values measured in the keys just prior to key balancing. The values for key weight seen in the column designated Key are estimated and the values for specified inertial weight seen in the column designated Totalspec are specified. In this situation specified Total inertial weight ranges from 165 grams to 96 grams in a curved taper. Total specification can be either straight or curved depending on the quality of touch desired in a completed action. The smoothed top action balance weights are derived from any statistical method which allows determination of the average trend of the column designated Top in Table XI, the smoothed top action weight values being seen in the column designated SmoothTop. This SmoothTop value is derived from the minimum number of Top values which yield an acceptable approximation of the true average trend of the top action weight. In this case, every tenth note is surveyed. Note that the SmoothTop column derived in this manner is nearly identical to the SmoothTop column derived from 88 data points as in the method of FIG. 15. Front weights are taken to be the values determined from subtraction of the values of SmoothTop and Key from Totalspec, these values being seen in the column designated Front. Each key is balanced to front weight specifications derived in this step. Note that the progression of yielded front weight values from key to key is uniform. Inertial weight values seen in the column designated Total are derived from the summation of the values of Top, Front and Key. It is then confirmed that the average trend of the yielded Total approximates Totalspec. Balance weights are seen in the column designated BW and are derived from the subtraction of the values in the Front column from the values in the Top column.

Balance weight depression values are seen in the column designated BWD of Table XI and are derived from the subtraction of the BWspec values from BW values with the BWspec being equal to 35. The BWD values show the difficulty encountered in achieving final balance weights due to the strain upon wippen support strings The BWD value is useful in deciding the size of the wippen support spring which is to be used. Once proper springs are installed, the tension of the springs is adjusted to achieve the balance weight specification.

TABLE XI

Top = Surveyed
Key = Estimated
Totalspec = Estimated
SmoothTop = Hypothetical Top (smoothed)
Front = Totalspec − SmoothTop − Key
M = Missing
Total = Top + Key + Front
BW = Top − Front
BWspec = Specified (Spring Adjusted Balance Weight)
BWD = BW − BWspec

| Note | Top | Key | Totalspec | SmoothTop | Front | Total | BW | Bwspec | BWD |
|---|---|---|---|---|---|---|---|---|---|
| 1 | 85.9 | 44.0 | 165 | 86.0 | 34.7 | 165 | 51.2 | 35.0 | 16 |
| 2 | M | 44.0 | 164 | 85.7 | 34.4 | M | M | 35.0 | M |
| 3 | M | 44.0 | 164 | 85.5 | 34.1 | M | M | 35.0 | M |
| 4 | M | 44.0 | 163 | 85.2 | 33.8 | M | M | 35.0 | M |
| 5 | M | 44.0 | 163 | 85.0 | 33.5 | M | M | 35.0 | M |
| 6 | M | 44.0 | 162 | 84.7 | 33.2 | M | M | 35.0 | M |
| 7 | M | 44.0 | 161 | 84.5 | 32.9 | M | M | 35.0 | M |
| 8 | M | 44.0 | 161 | 84.2 | 32.6 | M | M | 35.0 | M |
| 9 | M | 44.0 | 160 | 84.0 | 32.3 | M | M | 35.0 | M |
| 10 | 83.6 | 44.0 | 160 | 83.7 | 32.0 | 160 | 51.6 | 35.0 | 17 |
| 11 | M | 44.0 | 159 | 83.5 | 31.7 | M | M | 35.0 | M |
| 12 | M | 44.0 | 159 | 83.2 | 31.4 | M | M | 35.0 | M |
| 13 | M | 44.0 | 158 | 83.0 | 31.1 | M | M | 35.0 | M |
| 14 | M | 44.0 | 157 | 82.7 | 30.8 | H | M | 35.0 | M |
| 15 | M | 44.0 | 157 | 82.4 | 30.5 | M | M | 35.0 | M |
| 16 | M | 44.0 | 156 | 82.2 | 30.2 | M | M | 35.0 | H |
| 17 | M | 44.0 | 156 | 81.9 | 29.9 | M | H | 35.0 | M |
| 18 | M | 44.0 | 155 | 81.6 | 29.6 | M | M | 35.0 | M |
| 19 | M | 44.0 | 155 | 81.3 | 29.4 | M | M | 35.0 | M |
| 20 | 82.1 | 44.0 | 154 | 81.0 | 29.1 | 155 | 53.0 | 35.0 | 18 |
| 21 | M | 44.0 | 154 | 80.7 | 28.8 | M | M | 35.0 | M |
| 22 | M | 44.0 | 153 | 80.4 | 28.6 | M | M | 35.0 | M |
| 23 | M | 44.0 | 152 | 80.1 | 28.3 | M | M | 35.0 | M |
| 24 | M | 44.0 | 152 | 79.8 | 28.1 | M | M | 35.0 | M |
| 25 | M | 44.0 | 151 | 79.5 | 27.9 | M | M | 35.0 | M |
| 26 | M | 44.0 | 151 | 79.2 | 27.6 | M | M | 35.0 | M |
| 27 | M | 44.0 | 150 | 78.9 | 27.4 | M | M | 35.0 | M |
| 28 | M | 44.0 | 150 | 78.6 | 27.1 | M | M | 35.0 | M |
| 29 | M | 44.0 | 149 | 78.2 | 26.9 | M | M | 35.0 | M |
| 30 | 77.0 | 44.0 | 149 | 77.9 | 26.6 | 148 | 50.4 | 35.0 | 15 |
| 31 | M | 44.0 | 148 | 77.6 | 26.4 | M | M | 35.0 | M |
| 32 | M | 44.0 | 147 | 77.3 | 26.1 | M | M | 35.0 | M |
| 33 | M | 44.0 | 147 | 77.0 | 25.8 | M | M | 35.0 | M |
| 34 | M | 44.0 | 146 | 76.6 | 25.5 | M | M | 35.0 | M |
| 35 | M | 44.0 | 146 | 76.3 | 25.3 | M | M | 35.0 | M |
| 36 | M | 44.0 | 145 | 76.0 | 25.0 | M | M | 35.0 | M |
| 37 | M | 44.0 | 144 | 75.6 | 24.7 | M | M | 35.0 | M |
| 38 | M | 44.0 | 144 | 75.3 | 24.4 | M | M | 35.0 | M |
| 39 | M | 44.0 | 143 | 75.0 | 24.1 | M | M | 35.0 | M |

TABLE XI-continued

Top = Surveyed
Key = Estimated
Totalspec = Estimated
SmoothTop = Hypothetical Top (smoothed)
Front = Totalspec − SmoothTop − Key
M = Missing
Total = Top + Key + Front
BW = Top − Front
BWspec = Specified (Spring Adjusted Balance Weight)
BWD = BW − BWspec

| Note | Top | Key | Totalspec | SmoothTop | Front | Total | BW | Bwspec | BWD |
|---|---|---|---|---|---|---|---|---|---|
| 40 | 75.1 | 44.0 | 142 | 74.6 | 23.8 | 143 | 51.3 | 35.0 | 16 |
| 41 | M | 44.0 | 142 | 74.3 | 23.5 | M | M | 35.0 | M |
| 42 | M | 44.0 | 141 | 73.9 | 23.3 | M | M | 35.0 | M |
| 43 | M | 44.0 | 141 | 73.5 | 23.0 | M | M | 35.0 | M |
| 44 | M | 44.0 | 140 | 73.1 | 22.7 | M | M | 35.0 | M |
| 45 | M | 44.0 | 139 | 72.7 | 22.5 | M | M | 35.0 | M |
| 46 | M | 44.0 | 139 | 72.3 | 22.2 | M | M | 35.0 | M |
| 47 | M | 44.0 | 138 | 71.8 | 22.0 | M | M | 35.0 | M |
| 48 | M | 44.0 | 137 | 71.4 | 21.8 | M | M | 35.0 | M |
| 49 | M | 44.0 | 136 | 70.8 | 21.6 | M | M | 35.0 | M |
| 50 | 71.4 | 44.0 | 136 | 70.3 | 21.4 | 137 | 50.0 | 35.0 | 15 |
| 51 | M | 44.0 | 135 | 69.7 | 21.3 | M | M | 35.0 | M |
| 52 | M | 44.0 | 134 | 69.1 | 21.1 | M | M | 35.0 | M |
| 53 | M | 44.0 | 133 | 68.4 | 21.0 | M | M | 35.0 | M |
| 54 | M | 44.0 | 133 | 67.8 | 20.9 | M | M | 3S.0 | M |
| 55 | M | 44.0 | 132 | 67.1 | 20.7 | M | M | 35.0 | M |
| 56 | M | 44.0 | 131 | 66.4 | 20.6 | M | M | 35.0 | M |
| 57 | M | 44.0 | 130 | 65.7 | 20.5 | M | M | 35.0 | M |
| 58 | M | 44.0 | 129 | 65.0 | 20.4 | M | M | 35.0 | M |
| 59 | M | 44.0 | 129 | 64.3 | 20.3 | M | M | 35.0 | M |
| 60 | 64.0 | 44.0 | 128 | 63.6 | 20.1 | 128 | 43.9 | 35.0 | M |
| 61 | M | 44.0 | 127 | 62.9 | 20.0 | M | M | 35.0 | M |
| 62 | M | 44.0 | 126 | 62.3 | 19.8 | M | M | 35.0 | M |
| 63 | M | 44.0 | 125 | 61.6 | 19.7 | M | M | 35.0 | M |
| 64 | M | 44.0 | 124 | 61.0 | 19.5 | M | M | 35.0 | M |
| 65 | M | 44.0 | 124 | 60.4 | 19.2 | M | M | 35.0 | M |
| 66 | M | 44.0 | 123 | 59.8 | 18.9 | M | M | 35.0 | M |
| 67 | M | 44.0 | 122 | 59.2 | 18.6 | M | M | 35.0 | M |
| 68 | M | 44.0 | 121 | 58.6 | 18.2 | M | M | 35.0 | M |
| 69 | M | 44.0 | 120 | 58.1 | 17.7 | M | M | 35.0 | M |
| 70 | 54.6 | 44.0 | 119 | 57.5 | 17.2 | 116 | 37.4 | 35.0 | 2 |
| 71 | M | 44.0 | 118 | 56.9 | 16.6 | M | M | 35.0 | M |
| 72 | M | 44.0 | 116 | 56.4 | 16.0 | M | M | 35.0 | M |
| 73 | M | 44.0 | 115 | 55.8 | 15.3 | M | M | 35.0 | M |
| 74 | M | 44.0 | 114 | 55.3 | 14.5 | M | M | 35.0 | M |
| 75 | M | 44.0 | 112 | 54.7 | 13.7 | M | M | 35.0 | M |
| 76 | M | 44.0 | 111 | 54.2 | 12.9 | M | M | 35.0 | M |
| 77 | M | 44.0 | 110 | 53.6 | 12.1 | M | M | 35.0 | M |
| 78 | M | 44.0 | 108 | 53.1 | 11.2 | M | M | 35.0 | M |
| 79 | M | 44.0 | 107 | 52.5 | 10.4 | M | M | 35.0 | M |
| 80 | 52.8 | 44.0 | 106 | 52.0 | 9.6 | 106 | 43.2 | 35.0 | 8 |
| 81 | M | 44.0 | 104 | 51.5 | 8.8 | M | M | 35.0 | M |
| 82 | M | 44.0 | 103 | 50.9 | 8.1 | M | M | 35.0 | M |
| 83 | M | 44.0 | 102 | 50.4 | 7.3 | M | M | 35.0 | M |
| 84 | M | 44.0 | 100 | 49.9 | 6.6 | M | M | 35.0 | M |
| 85 | M | 44.0 | 99 | 49.3 | 5.9 | M | M | 35.0 | M |
| 86 | M | 44.0 | 98 | 48.8 | 5.2 | M | M | 35.0 | M |
| 87 | M | 44.0 | 97 | 48.3 | 4.5 | M | M | 35.0 | M |
| 88 | 47.5 | 44.0 | 96 | 47.7 | 3.8 | 95 | 43.7 | 35.0 | 9 |

Referring now to FIG. 17 and associated Table XII, a method is seen to be useful when inertial weights are too high, this method utilizing specified inertial weight and balance weight. The method further utilizes keyleads such as the keyleads 116 of FIG. 1 in conjunction with wippen support springs as seen at 122 in FIG. 1 to provide the method of FIG. 17 which relates to Table XII. Top action balance weights are surveyed and are seen in the column designated Top of Table XII. These values are derived from upweight, downweight and front weight values measured in the keys just prior to key balancing. Key weights are estimated and are seen in the column designated Key, while specified inertial weights are specified and are seen in the column designated Totalspec. In the case shown, specified Total inertial weight ranges from 165 grams to 95 grams in a curved taper. The Total specification can be either straight or curved depending on the quality of touch desired in the completed action. Smoothed top action balance weight values are derived and are seen in the column designated SmoothTop3 by adding SmoothTop values to Backlead values as seen in Table XII. SmoothTop values are the smoothed values of Top as derived by one of any statistical methods which derive the average trend of the column designated Top in Table XII. The Backlead factor is equal to the minimum hole number which causes SmoothTop3 minus Top to yield few or no negative numbers. In this case, the backlead factor is taken to be three. The front weights are derived from the subtraction of SmoothTop and Key values from Totalspec values, these derived values being seen in the column designated Front. Each key is balanced to front weight specifications derived in this step. Note that the progression of yielded front weight values from key to key is straight line linear regression. Backlead weights are derived by subtracting Top values from SmoothTop3 values with the resulting values being seen in the column designated Backlead. Any negative Backlead values are changed to zero. Inertial weights found in the column designated Total in Table XII are derived from the sum of the values of Top, Backlead, Front and Key. The values of Total are confirmed to match the values of Totalspec. Balance weights are derived by subtracting the values of Front from the sum of the Top values and the Backlead values, the resulting values being seen in the column designated BW.

The column designated BWD in Table XII shows balance weight depression values which result from the subtraction of BWspec values from BW values where the BWspec value is 35. The BWD values illustrate the work which the wippen support springs 122 of FIG. 1 have to achieve in order to produce the final balance weight. Once proper sized springs are installed, the springs are adjusted to achieve the appropriate balance weight specification values.

The values of Table XII are seen as follows:

TABLE XII

Top = Surveyed
Key = Estimated
Totalspec = Specified
SmoothTop = Specified
Front = Totalspec − SmoothTop − Key
Backlead = SmoothTop − Top
Front2 = Front − Backlead
Total = Top + Backlead + Key + Front
BW = Top + Backlead − Front
BWspec = Specified (Spring Adjusted Balance Weight)
BWD = BW − BWspec

| Note | Top | Key | Totalspec | SmoothTop | Front | Backlead | Total | BW | BWspec | BWD |
|---|---|---|---|---|---|---|---|---|---|---|
| 1 | 85.9 | 44.0 | 165 | 90.6 | 30.1 | 4.7 | 165 | 60.5 | 35.0 | 26 |
| 2 | 89.2 | 44.0 | 164 | 90.4 | 29.8 | 1.2 | 164 | 60.6 | 35.0 | 26 |
| 3 | 86.3 | 44.0 | 164 | 90.1 | 29.5 | 3.8 | 164 | 60.6 | 35.0 | 26 |
| 4 | 83.5 | 44.0 | 163 | 89.8 | 29.3 | 6.3 | 163 | 60.6 | 35.0 | 26 |
| 5 | 87.3 | 44.0 | 163 | 89.5 | 29.0 | 2.2 | 163 | 60.6 | 35.0 | 26 |
| 6 | 86.0 | 44.0 | 162 | 89.3 | 28.7 | 3.3 | 162 | 60.6 | 35.0 | 26 |
| 7 | 90.0 | 44.0 | 161 | 89.0 | 28.4 | 0.0 | 162 | 61.6 | 35.0 | 27 |
| 8 | 85.1 | 44.0 | 161 | 88.7 | 28.2 | 3.6 | 161 | 60.5 | 35.0 | 26 |
| 9 | 83.2 | 44.0 | 160 | 88.4 | 27.9 | 5.2 | 160 | 60.5 | 35.0 | 26 |
| 10 | 83.6 | 44.0 | 160 | 88.1 | 27.6 | 4.5 | 160 | 60.5 | 35.0 | 26 |
| 11 | 84.3 | 44.0 | 159 | 87.8 | 27.3 | 3.5 | 159 | 60.5 | 35.0 | 25 |
| 12 | 83.6 | 44.0 | 159 | 87.5 | 27.1 | 3.9 | 159 | 60.5 | 35.0 | 25 |
| 13 | 85.7 | 44.0 | 158 | 87.2 | 26.8 | 1.5 | 158 | 60.4 | 35.0 | 25 |
| 14 | 83.0 | 44.0 | 157 | 86.9 | 26.5 | 3.9 | 157 | 60.4 | 35.0 | 25 |
| 15 | 85.2 | 44.0 | 157 | 86.6 | 26.3 | 1.4 | 157 | 60.4 | 35.0 | 25 |
| 16 | 86.4 | 44.0 | 156 | 86.3 | 26.0 | 0.0 | 156 | 60.4 | 35.0 | 25 |
| 17 | 83.9 | 44.0 | 156 | 86.0 | 25.7 | 2.1 | 156 | 60.3 | 35.0 | 25 |
| 18 | 85.2 | 44.0 | 155 | 85.7 | 25.5 | 0.5 | 155 | 60.3 | 35.0 | 25 |
| 19 | 85.3 | 44.0 | 155 | 85.4 | 25.2 | 0.1 | 155 | 60.2 | 35.0 | 25 |
| 20 | 82.1 | 44.0 | 154 | 85.1 | 25.0 | 3.0 | 154 | 60.2 | 35.0 | 25 |
| 21 | 81.4 | 44.0 | 154 | 84.9 | 24.7 | 3.5 | 154 | 60.1 | 35.0 | 25 |
| 22 | 85.3 | 44.0 | 153 | 84.6 | 24.5 | 0.0 | 154 | 60.8 | 35.0 | 26 |
| 23 | 82.6 | 44.0 | 152 | 84.2 | 24.3 | 1.6 | 152 | 60.0 | 35.0 | 25 |
| 24 | 81.2 | 44.0 | 152 | 83.9 | 24.0 | 2.7 | 152 | 59.8 | 35.0 | 25 |
| 25 | 82.5 | 44.0 | 151 | 83.5 | 23.8 | 1.0 | 151 | 59.7 | 35.0 | 25 |
| 26 | 79.0 | 44.0 | 151 | 83.2 | 23.6 | 4.2 | 151 | 59.5 | 35.0 | 25 |
| 27 | 79.8 | 44.0 | 150 | 82.8 | 23.5 | 3.0 | 150 | 59.4 | 35.0 | 24 |
| 28 | 77.0 | 44.0 | 150 | 82.4 | 23.3 | 5.4 | 150 | 59.2 | 35.0 | 24 |
| 29 | 75.3 | 44.0 | 149 | 82.1 | 23.1 | 6.8 | 149 | 59.0 | 35.0 | 24 |
| 30 | 77.0 | 44.0 | 149 | 81.7 | 22.9 | 4.7 | 149 | 58.7 | 35.0 | 24 |
| 31 | 78.0 | 44.0 | 148 | 81.2 | 22.7 | 3.2 | 148 | 58.5 | 35.0 | 24 |
| 32 | 78.2 | 44.0 | 147 | 80.8 | 22.6 | 2.6 | 147 | 58.3 | 35.0 | 23 |
| 33 | 78.0 | 44.0 | 147 | 80.4 | 22.4 | 2.4 | 147 | 58.0 | 35.0 | 23 |
| 34 | 79.1 | 44.0 | 146 | 80.0 | 22.2 | 0.9 | 146 | 57.8 | 35.0 | 23 |
| 35 | 76.9 | 44.0 | 146 | 79.5 | 22.0 | 2.6 | 146 | 57.5 | 35.0 | 23 |
| 36 | 74.7 | 44.0 | 145 | 79.1 | 21.8 | 4.4 | 145 | 57.3 | 35.0 | 22 |
| 37 | 73.2 | 44.0 | 144 | 78.7 | 21.6 | 5.5 | 144 | 57.1 | 35.0 | 22 |
| 38 | 77.4 | 44.0 | 144 | 78.3 | 21.4 | 0.9 | 144 | 56.8 | 35.0 | 22 |
| 39 | 76.1 | 44.0 | 143 | 77.8 | 21.2 | 1.7 | 143 | 56.6 | 35.0 | 22 |
| 40 | 75.1 | 44.0 | 142 | 77.4 | 21.0 | 2.3 | 142 | 56.4 | 35.0 | 21 |
| 41 | 76.0 | 44.0 | 142 | 76.9 | 20.8 | 0.9 | 142 | 56.1 | 35.0 | 21 |
| 42 | 72.3 | 44.0 | 141 | 76.5 | 20.6 | 4.2 | 141 | 55.9 | 35.0 | 21 |
| 43 | 72.9 | 44.0 | 141 | 76.1 | 20.5 | 3.2 | 141 | 55.6 | 35.0 | 21 |
| 44 | 72.5 | 44.0 | 140 | 75.6 | 20.2 | 3.1 | 140 | 55.4 | 35.0 | 20 |
| 45 | 72.8 | 44.0 | 139 | 75.2 | 20.0 | 2.4 | 139 | 55.1 | 35.0 | 20 |
| 46 | 73.0 | 44.0 | 139 | 74.7 | 19.8 | 1.7 | 139 | 54.9 | 35.0 | 20 |
| 47 | 72.2 | 44.0 | 138 | 74.3 | 19.6 | 2.1 | 138 | 54.6 | 35.0 | 20 |
| 48 | 69.5 | 44.0 | 137 | 73.8 | 19.4 | 4.3 | 137 | 54.4 | 35.0 | 19 |
| 49 | 69.4 | 44.0 | 136 | 73.3 | 19.1 | 3.9 | 136 | 54.2 | 35.0 | 19 |
| 50 | 71.4 | 44.0 | 136 | 72.8 | 18.9 | 1.4 | 136 | 53.9 | 35.0 | 19 |
| 51 | 70.2 | 44.0 | 135 | 72.3 | 18.6 | 2.1 | 135 | 53.7 | 35.0 | 19 |
| 52 | 69.8 | 44.0 | 134 | 71.8 | 18.3 | 2.0 | 134 | 53.5 | 35.0 | 18 |
| 53 | 70.9 | 44.0 | 133 | 71.3 | 18.1 | 0.4 | 133 | 53.3 | 35.0 | 18 |
| 54 | 65.2 | 44.0 | 133 | 70.8 | 17.8 | 5.6 | 133 | 53.1 | 35.0 | 18 |
| 55 | 64.0 | 44.0 | 132 | 70.3 | 17.5 | 6.3 | 132 | 52.8 | 35.0 | 18 |
| 56 | 65.1 | 44.0 | 131 | 69.8 | 17.2 | 4.7 | 131 | 52.6 | 35.0 | 18 |
| 57 | 68.0 | 44.0 | 130 | 69.2 | 16.9 | 1.2 | 130 | 52.3 | 35.0 | 17 |
| 58 | 64.2 | 44.0 | 129 | 68.7 | 16.7 | 4.5 | 129 | 52.0 | 35.0 | 17 |

TABLE XII-continued

Top = Surveyed
Key = Estimated
Totalspec = Specified
SmoothTop = Specified
Front = Totalspec − SmoothTop − Key
Backlead = SmoothTop − Top
Front2 = Front − Backlead
Total = Top + Backlead + Key + Front
BW = Top + Backlead − Front
BWspec = Specified (Spring Adjusted Balance Weight)
BWD = BW − BWspec

| Note | Top | Key | Totalspec | SmoothTop | Front | Backlead | Total | BW | BWspec | BWD |
|---|---|---|---|---|---|---|---|---|---|---|
| 59 | 65.6 | 44.0 | 129 | 68.1 | 16.4 | 2.5 | 129 | 51.7 | 35.0 | 17 |
| 60 | 64.0 | 44.0 | 128 | 67.5 | 16.2 | 3.5 | 128 | 51.4 | 35.0 | 16 |
| 61 | 65.4 | 44.0 | 127 | 67.0 | 15.9 | 1.6 | 127 | 51.0 | 35.0 | 16 |
| 62 | 67.0 | 44.0 | 126 | 66.4 | 15.7 | 0.0 | 127 | 51.3 | 35.0 | 16 |
| 63 | 62.5 | 44.0 | 125 | 65.8 | 15.5 | 3.3 | 125 | 50.3 | 35.0 | 15 |
| 64 | 65.2 | 44.0 | 124 | 65.2 | 15.2 | 0.0 | 124 | 50.0 | 35.0 | 15 |
| 65 | 62.3 | 44.0 | 124 | 64.7 | 14.9 | 2.4 | 124 | 49.7 | 35.0 | 15 |
| 66 | 63.3 | 44.0 | 123 | 64.1 | 14.6 | 0.8 | 123 | 49.4 | 35.0 | 14 |
| 67 | 57.7 | 44.0 | 122 | 63.5 | 14.3 | 5.8 | 122 | 49.2 | 35.0 | 14 |
| 68 | 61.9 | 44.0 | 121 | 62.9 | 14.0 | 1.0 | 121 | 48.9 | 35.0 | 14 |
| 69 | 60.0 | 44.0 | 120 | 62.2 | 13.6 | 2.2 | 120 | 48.7 | 35.0 | 14 |
| 70 | 54.6 | 44.0 | 119 | 61.6 | 13.1 | 7.0 | 119 | 48.5 | 35.0 | 13 |
| 71 | 57.4 | 44.0 | 118 | 61.0 | 12.6 | 3.6 | 118 | 48.4 | 35.0 | 13 |
| 72 | 58.5 | 44.0 | 116 | 60.3 | 12.0 | 1.8 | 116 | 48.3 | 35.0 | 13 |
| 73 | 56.1 | 44.0 | 115 | 59.7 | 11.4 | 3.6 | 115 | 48.3 | 35.0 | 13 |
| 74 | 57.6 | 44.0 | 114 | 59.0 | 10.7 | 1.4 | 114 | 48.3 | 35.0 | 13 |
| 75 | 54.8 | 44.0 | 112 | 58.4 | 10.0 | 3.6 | 112 | 48.4 | 35.0 | 13 |
| 76 | 53.9 | 44.0 | 111 | 57.8 | 9.3 | 3.9 | 111 | 48.5 | 35.0 | 13 |
| 77 | 53.3 | 44.0 | 110 | 57.1 | 8.6 | 3.8 | 110 | 48.6 | 35.0 | 14 |
| 78 | 54.3 | 44.0 | 108 | 56.5 | 7.8 | 2.2 | 108 | 48.6 | 35.0 | 14 |
| 79 | 53.0 | 44.0 | 107 | 55.8 | 7.1 | 2.8 | 107 | 48.7 | 35.0 | 14 |
| 80 | 52.8 | 44.0 | 106 | 55.2 | 6.4 | 2.4 | 106 | 48.8 | 35.0 | 14 |
| 81 | 52.6 | 44.0 | 104 | 54.5 | 5.7 | 2.0 | 104 | 48.8 | 35.0 | 14 |
| 82 | 50.5 | 44.0 | 103 | 53.9 | 5.1 | 3.4 | 103 | 48.8 | 35.0 | 14 |
| 83 | 55.1 | 44.0 | 102 | 53.2 | 4.5 | 0.0 | 104 | 50.6 | 35.0 | 16 |
| 84 | 50.3 | 44.0 | 100 | 52.6 | 3.9 | 2.3 | 100 | 48.7 | 35.0 | 14 |
| 85 | 46.8 | 44.0 | 99 | 51.9 | 3.3 | 5.1 | 99 | 48.6 | 35.0 | 14 |
| 86 | 47.9 | 44.0 | 98 | 51.3 | 2.7 | 3.4 | 98 | 48.5 | 35.0 | 14 |
| 87 | 43.6 | 44.0 | 97 | 50.6 | 2.2 | 7.0 | 97 | 48.4 | 35.0 | 13 |
| 88 | 47.5 | 44.0 | 96 | 50.0 | 1.6 | 2.5 | 96 | 48.3 | 35.0 | 13 |

Through the use of the methods of FIGS. 15, 16 and 17, it is possible to produce substantial reductions in the inertial weight in piano actions which have a predisposition to being heavy or to make normal actions feel light. The applications of these methods in customizing pianos either inside or outside of a factory environment offers a wide range of possibilities for pianos. It has been observed that by reducing and causing inertial weights to be lighter and more uniform when such weights might otherwise be too high, many physical symptoms or ailments such as carpal tunnel syndrome can be reduced or eliminated.

While the invention has been described with reference to particular embodiments, it will be apparent to those skilled in the art that variations and modifications can be substituted therefore without departing from the scope of the invention as hereinafter claimed.

What is claimed is:

1. A method for balancing key assemblies of a stringed keyboard instrument, each key assembly having a keystick, comprising the steps of:

determining a hypothetical smoothed top action balance weight for the key assemblies;

determining a smoothed front weight for the key assemblies based on the smoothed top action balance weight; and, balancing the keystick to the smoothed front weight.

2. The method of claim 1 wherein the first mentioned step comprises the step of:

deriving hypothetical smoothed top action balance weight values for all of the key assemblies by determination of the average trend of the top action balance weight values derived from a sampling of less than the total number of key assemblies.

3. The method of claim 1 wherein the first-mentioned step comprises the steps of:

determining the balance weight of each of said key assemblies;

measuring a front weight of each keystick; and, calculating the top action balance weight of each of said key assemblies.

4. The method of claim 3 wherein smoothed top action balance weight values are derived for all of the key assemblies by determination of the average trend of the top action balance weight values derived from a sampling of less than the total number of key assemblies.

5. The method of claim 3 wherein the step of determining the balance weight of each of said key assemblies includes the step of measuring the upweight and downweight of each of said key assemblies, the balance weight being one-half of the sum of the downweight and upweight.

6. The method of claim 1 wherein each key assembly has a specified balance weight and the step of determining a smoothed front weight for each key assembly comprises the steps of subtracting the specified balance weight from the hypothetical smoothed top action balance weight for a given key assembly.

7. The method of claim 1 wherein each key assembly has a specified balance weight and the step of determining the smoothed front weight comprises determining the smoothed front weight by subtracting the specified balance weight from the hypothetical smoothed top action balance weight.

8. The method of claim 7 and further comprising the step of:

deriving smoothed top action balance weight values for all of the key assemblies by determination of the average trend of the top action balance weight values derived from a sampling of less than the total number of key assemblies.

9. A method for balancing key assemblies of a stringed keyboard instrument such as a piano, each key assembly having a keystick and a specified balance weight, comprising the steps of:

measuring the upweight and downweight of each of said key assemblies;

determining the actual balance weight of each of said key assemblies;

removing each keystick of each said key assembly from each key assembly;

measuring the front weight of each keystick;

calculating the top action balance weight of each key assembly;

determining a hypothetical smoothed top action balance weight of each key assembly;

determining a smoothed front weight for each of said key assemblies by subtracting the specified balance weight from the hypothetical smoothed top action balance weight; and, balancing the keystick to the smoothed front weight.

10. The method of claim 9 and further comprising the step of:

deriving smoothed top action balance weight values for all of the key assemblies by determination of the average trend of the top action balance weight values derived from a sampling of less than the total number of key assemblies.

11. The method of claim 9 and further comprising the following steps prior to the last-mentioned step:

determining the key weight of each of said key assemblies;

calculating the inertial weight from the sum of the real top action weight, the specified front weight and the key weight for each of said key assemblies; and, comparing the inertial weight with the range of acceptable inertial weights.

12. The method of claim 9 wherein each keystick of each key assembly has a balance point and a measuring point wherein the said step of measuring the front weight of each of said keysticks is accomplished by the steps of:

placing the keystick of each key assembly with its balance point disposed on top of a low friction pivot member;

providing a scale under the measuring point at the front end of said keystick, the top of which scale is disposed horizontally in alignment with the top of said low friction pivot member;

reading from said scale the front weight of each keystick; and, placing weights at various positions along each keystick for determining the adjustment of said front weight.

13. The method of claim 12 and further comprising the step of deriving uniform front weight by determining the front weight of only selected key assemblies and extrapolating the front weight of the remaining key assemblies.

14. The method of claim 9 and further comprising the step of deriving front weights of at least certain key assemblies by determining the front weight of only selected key assemblies and extrapolating the front weight of at least certain of the remaining key assemblies.

15. The method of claim 9 wherein the step of calculating the top action balance weight of said key assemblies comprises the steps of:

calculating top action weights of selected key assemblies; and, extrapolating the top action weights of at least certain of the remaining key assemblies from the average trend of the top action balance weight values derived from calculation of top action balance weight values of the selected key assemblies.

16. The method of claim 9 wherein each keystick of each key assembly has a balance point and a measuring point and wherein said step of determining the front weight of each of said key assemblies comprises the steps of:

placing each keystick with its balance point disposed on top of a low friction pivot member;

providing a scale under the measuring point at the front end of said keystick, the top of which scale is disposed horizontally in alignment with the top of said low friction pivot member;

reading from said scale the front weight of each keystick; and, determining the front weight of each of said key assemblies to create a continuous front weight.

17. A method for balancing piano key assemblies comprising the steps of: a stringed keyboard instrument, each key assembly having a keystick, comprising the steps of:

adjusting the inertial weight of each of said key assemblies to be of a weight which decreases uniformly in a substantially linear descending progression from the low pitched keys to the pitched keys;

adjusting the front weight of each of said key assemblies to balance said key assemblies;

wherein each key assembly has a keystick and wherein each key assembly has a specified balance weight, the method further comprising, before the step of adjusting the inertial weight of each of said key assemblies, the steps of:

measuring the upweight and downweight of each of said key assemblies;

calculating the balance weight of each of said key assemblies;

removing each keystick of each key assembly from said piano;

measuring the front weight of each of said keysticks;

calculating the top action weight of each of said key assemblies;

computing a hypothetical smoothed top action weight for each of said key assemblies;

calculating a smoothed front weight for each of said key assemblies by subtracting the specified balance weight from a hypothetical smoothed top action weight;

determining the key weight of each of said key assemblies; and, calculating the inertial weight from the sum of the real top action weight, front weight and key weight for each of said key assemblies.

18. The method of claim 17 wherein each keystick of each key assembly has a balance point, a measuring point and a back side and wherein said step of measuring the front weight for each of said key assemblies is accomplished by the steps of:

placing each keystick of each key assembly with its balance point disposed on top of a low-friction pivot member;

providing a scale under the measuring point at the front end of said keystick the top of which scale is disposed horizontally in alignment with the top of said low-friction pivot member;

reading from said scale the front weight of each keystick; and, placing weights at various positions along each of said keysticks for determining the adjustment of said front weight to balance the inertial weight of each said key assembly.

19. The method of claim 18 further including the step of deriving smoothed front weight by determining the top action weight of only selected key assemblies and extrapolating the top action weight of the remaining key assemblies.

20. The method of claim 18 further including the step of placing said weights in said keysticks not only to adjust for front weight but also for backside weight of each of said key assemblies.

21. The method of claim 20 wherein each keystick of each key assembly has a balance point, a measuring point and a back weight and wherein said step of determining the front weight and for each of said key assemblies is accomplished by the steps of:

placing each keystick of each key assembly with its balance point disposed on top of a low-friction pivot member;

providing a scale under the measuring point at the front end of said keystick the top of which scale is disposed horizontally in alignment with the top of said low-friction pivot member; and reading from said scale the front weight of each key assembly.

22. The method of claim 17 wherein the step to calculate the top action weight of each key assembly is replaced by the step of calculating selected key top action weights and extrapolating the top action remaining key assemblies.

23. The method of claim 17 wherein each keystick of each key assembly has a balance point, a measuring point and a back weight and wherein said step of determining the front weight and back weight for each of said keystick is accomplished by the steps of:

placing each keystick of each key assembly with its balance point disposed on top of a low-friction pivot member;

providing a scale under the measuring point at the front end of said keystick the top of which scale is disposed horizontally in alignment with the top of said low-friction pivot member;

reading from said scale the front weight of each key assembly; and, determining the front weight of each of said key assemblies to create a smoothed front weight and fitting wippen support springs on each key assembly, said wippen support springs being adjusted for each key assembly to a specified balance weight to adjust the inertial weight of each key assembly.

24. A method for balancing piano key assemblies comprising the steps of:

adjusting the inertial weight of each of said key assemblies to be of a weight which decreases uniformly in a curved linear descending progression from the low pitched keys to the high pitched keys;

adjusting the front weight of each of said key assemblies to be continuous in weight;

wherein each key assembly has a keystick and wherein each key assembly has a specified balance weight, the method further comprising, before the step of adjusting the inertial weight of each of said key assemblies, the steps of:

measuring the upweight and downweight of each of said key assemblies;

calculating the balance weight of each of said key assemblies;

removing each key stick from said piano;

measuring the front weight of each of said keysticks;

calculating the top action weight of each of said key assemblies;

computing a hypothetical smoothed top action weight for each of said key assemblies;

calculating a smoothed front weight for each of said key assemblies by subtracting the specified balance weight from a hypothetical smoothed top action weight;

determining the key weight of each of said key assemblies; and, calculating the inertial weight from the sum of the real top action weight, front weight and key weight for each of said key assemblies.

25. The method of claim 24 wherein each keystick of each key assembly has a balance point, a measuring point and a back side and wherein said step of measuring the front weight for each of aid said assemblies is accomplished by the steps of:

placing each keystick of each key assembly with its balance point disposed on top of a low-friction pivot member;

providing a scale under the measuring point at the front end of said keystick the top of which scale is disposed horizontally in alignment with the top of said low-friction pivot member;

reading from said scale the front weight of each keystick; and, placing weights at various positions along each of said keysticks for determining the adjustment of said front weight to balance the inertial weight of each said key assembly.

26. The method of claim 25 further including the step of deriving smoothed front weight by determining the top action weight of only selected key assemblies and extrapolating the top action weight of the remaining key assemblies.

27. The method of claim 25 further including the step of placing said weights in said keysticks not only to adjust for front weight but also for backside weight of each said key assemblies.

28. The method of claim 26 wherein the step to calculate the top action weight of each key assembly is replaced by the step of calculating selected key top action weights and extrapolating the top action weights of the remaining key assemblies.

29. The method for balancing piano key assemblies wherein each key assembly has a keystick and wherein each key assembly has a specific balance weight, the method comprising the steps of:

measuring the upweight and downweight of each of said key assemblies;

calculating the balance weight of each of said key assemblies;

removing each keystick of each key assembly from said piano;

measuring the front weight of each of said keysticks;

calculating the top action weight of each of said keysticks;

computing a hypothetical smoothed top action weight for each of said key assemblies;

calculating a smoothed front weight for each of said key assemblies by subtracting the specified balance weight from the hypothetical smoothed top action weight; and balancing each keystick to the smoothed front weight.

30. The method of claim 29 further including the step of adjusting the front weight of each of said key assemblies so that the front weights of said key assemblies are substantially continuous in weight.

31. The method of claim 30 further including the step of placing each keystick of each said key assembly from each key assembly prior to measuring a front weight of each keystick.

32. A method for balancing key assemblies of a stringed keyboard instrument, each key assembly having a keystick, comprising the steps of:

determining a smoothed balance weight of each key assembly;

determining the smoothed top action balance weight of each key assembly;

determining the front weight for each keystick of each key assembly derived from the top action balance weight for each said key assembly by subtracting the specified balance weight of each key assembly from the top action balance weight; and balancing the keystick to the front weight thereof.

33. A method for balancing key assemblies of a stringed keyboard instrument, each key assembly having a keystick, comprising the steps of:

determining the top action balance weight for at least certain of the key assemblies;

determining a top action balance weight for each key assembly by deriving the average trend of top action balance weight values from at least certain of the key assemblies;

determining a specified smoothed balance weight of at least certain of the key assemblies;

determining front weight values for each key assembly by subtracting the specified balance weight of each key assembly from the top action balance weight of each key assembly; and balancing the keystick of each key assembly to the front weight value thereof.

34. The method for balancing key assemblies of a stringed keyboard instrument, each key assembly having a keystick and having a specified balance weight, comprising the steps of:

measuring the upweight and downweight of each key assembly;

measuring the front weight of each keystick of each key assembly;

determining the balance weight of each key assembly as the average of the sum of th upweight and downweight;

determining the top action balance weight of each key assembly by adding the balance weight and the front weigh of each key assembly;

determining a front weight specification of each key assembly by subtracting the specified balance weight of each key assembly from the top action balance weight of said key assembly; and balancing each keystick to the front weight specification derived therefor.

35. A method for balancing key assemblies of a stringed keyboard instrument such as a piano, each key assembly having a keystick and each key assembly having a specified balance weight, comprising the steps of:

measuring the upweight and downweight for at least certain of the key assemblies;

measuring the front weight of the keystick of said at least certain of the key assemblies;

determining the balance weight of said at least certain of the key assemblies by averaging the sum of the upweight and downweight of said at least certain of the key assemblies;

determining the top action balance weight of said at least certain of the key assemblies by summation of the balance weight and the front weight of each said at least certain of the key assemblies;

deriving the average trend of top action balance weight values of the key assemblies to yield smoothed top action balance weights for said at least certain others of said key assemblies;

deriving smoothed front weight values for said at least certain others of said key assemblies by subtracting the specified balance weight from the smoothed top action balance weight of said at least certain others of said key assemblies; and balancing said at least certain others of said keysticks to the smoothed front weight values thereof.

36. The method of claim 35 wherein the average trend of the top action balance weight values is derived by locally weighted regression.

37. The method of claim 35 wherein the average trend of the top action balance weight values is derived by locally weighted regression.

38. The method of claim 35 wherein the balancing step comprises the step of adding at least one keylead to the keystick of said at least certain others of said key assemblies.

39. The method of claim 35 wherein each of the key assemblies is balanced to the smoothed front weight value thereof, each key assembly exhibiting a smoothed decremental value relative to adjacent key assemblies from bass end to treble end.

40. The method of claim 35 wherein the key assemblies each have a wippen support spring and associated action parts, the balancing step comprising the step of adjusting wippen spring tension to balance each key assembly to the smoothed balance weight value thereof.

41. The method of claim 35 wherein at least certain of the key assemblies comprises approximately every tenth key assembly.

42. A method for balancing key assemblies of a stringed keyboard instrument, each key assembly having a keystick, comprising the steps of:

specifying a smoothed strike weight, a smoothed strike ratio, a smoothed wippen weight, a smoothed key ratio and a smoothed balance weight for each key assembly;

deriving a front weight specification for each key assembly from the smoothed strike weight, smoothed strike ratio, smoothed wippen weight, smoothed key ratio and smoothed balance weight; and balancing each keystick of each key assembly to the front weight specification.

43. The method of claim 42 wherein the front weight specification is derived by taking the sum of the product of the strike weight and the strike ratio and of the product of the wippen weight and the key ratio and reducing said sum by the value of the specified smoothed balance weight.

44. A keyboard for a stringed instrument having key assemblies and a keystick for each key assembly, the key assemblies of the keyboard being balanced by specifying a smoothed strike weight, a smoothed strike ratio, a smoothed wippen weight, a smoothed key ratio and a smoothed balance weight for each key assembly, deriving a front weight specification for each key assembly from the values so specified, and balancing each keystick of each key assembly to the front weight specification.

45. A keyboard for a stringed instrument having key assemblies and a keystick for each key assembly, the key assemblies of the keyboard being balanced by deriving a front weight value for at least certain of the key assemblies, deriving smoothed front weight values of the key assemblies from the front weight values of the at least certain of the key assemblies, and balancing at least the remaining key assemblies to the smoothed front weight values so derived.

46. A keyboard for a stringed instrument having key assemblies and a keystick for each key assembly, the key assemblies of the keyboard being balanced by specifying a smoothed strike weight, a smoothed strike ratio, a smoothed wippen weight, a smoothed key ratio and a smoothed balance weight for each key assembly, taking the sum of the product of the strike weight and the strike ratio and of the product of the wippen weight and the key ratio and reducing said sum by the value of the specified balance weight to yield a front weight specification for each key assembly, and balancing each keystick of each key assembly to the front weight specification.

* * * * *